US009922610B2

(12) United States Patent
Nakanishi et al.

(10) Patent No.: US 9,922,610 B2
(45) Date of Patent: Mar. 20, 2018

(54) DISPLAY DEVICE

(71) Applicant: Panasonic Liquid Crystal Display Co., Ltd., Hyogo (JP)

(72) Inventors: Hideyuki Nakanishi, Hyogo (JP); Junichi Maruyama, Hyogo (JP); Toshikazu Koudo, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 123 days.

(21) Appl. No.: 14/960,022

(22) Filed: Dec. 4, 2015

(65) Prior Publication Data

US 2016/0210919 A1 Jul. 21, 2016

Related U.S. Application Data

(63) Continuation of application No. PCT/JP2014/000934, filed on Feb. 21, 2014.

(30) Foreign Application Priority Data

Oct. 16, 2013 (JP) ..... 2013-215338

(51) Int. Cl.
*G09G 3/36* (2006.01)

(52) U.S. Cl.
CPC ..... *G09G 3/3648* (2013.01); *G09G 3/3614* (2013.01); *G09G 3/3688* (2013.01); *G09G 2300/0495* (2013.01); *G09G 2310/024* (2013.01); *G09G 2310/0224* (2013.01); *G09G 2330/021* (2013.01); *G09G 2330/022* (2013.01)

(58) Field of Classification Search
None
See application file for complete search history.

(56) References Cited

U.S. PATENT DOCUMENTS

| | | | |
|---|---|---|---|
| 5,734,367 | A | 3/1998 | Tsuboyama et al. |
| 6,229,515 | B1 | 5/2001 | Itoh et al. |
| 2006/0044251 | A1 | 3/2006 | Kato et al. |

FOREIGN PATENT DOCUMENTS

| | | | |
|---|---|---|---|
| JP | 62-22181 | A | 9/1987 |
| JP | H06-308459 | A | 11/1994 |
| JP | H09-159999 | A | 6/1997 |
| JP | 2006-064964 | A | 3/2006 |

OTHER PUBLICATIONS

International Search Report dated May 27, 2014 issued International Patent Application No. PCT/JP2014/000934 (English translation).

*Primary Examiner* — Kenneth B Lee, Jr.
(74) *Attorney, Agent, or Firm* — McDermott Will & Emery LLP

(57) ABSTRACT

A display device including a controller configured to control the source driver and the gate driver based on a control mode for displaying the frame image on the display portion, wherein: in the basic control mode, the controller is configured to display the frame image on the display portion by causing the gate driver to progressively scan all of the N gate signal lines within a predetermined time period, in the low-power control mode, the controller is configured to display a sub-frame image on the display portion by causing the gate driver to scan W gate signal lines within the predetermined time period, and to perform interlaced scanning of the plurality of gate signal lines every K lines, the control mode is configured to shift from the basic control mode to the low-power control mode by way of the first shift control mode.

19 Claims, 26 Drawing Sheets

FIG. 5

| | MD1 (60Hz) | | | MD2 (TF) | | | | | MD3 (15Hz) | | | | | | | | | | | | | | MD4 (TF) | MD1 (60Hz) | |
|---|---|---|---|---|---|---|---|---|---|---|---|---|---|---|---|---|---|---|---|---|---|---|---|---|---|
| | FR0 | FR1 | FR2 | SF3 | SF4 | SF5 | SF6 | SF7 | SF8 | SF9 | SF10 | SF11 | SF12 | SF13 | SF14 | SF15 | SF16 | SF17 | SF18 | SF19 | SF20 | SF21 | SF22 | FR23 | FR24 |
| G1 | − | + | − | + | | | | − | | | | + | | | | − | | | | + | | | ○ | + | − |
| G2 | − | + | − | | | + | | | | − | | | | + | | | | − | | | | + | ○ | + | − |
| G3 | − | + | − | ○ | − | | | | + | | | | − | | | | + | | | | − | | | + | − |
| G4 | − | + | − | ○ | | | − | | | | + | | | | − | | | | + | | | | − | + | − |
| G5 | − | + | − | + | | | | − | | | | + | | | | − | | | | + | | | ○ | + | − |
| G6 | − | + | − | | | + | | | | − | | | | + | | | | − | | | | + | ○ | + | − |
| G7 | − | + | − | ○ | − | | | | + | | | | − | | | | + | | | | − | | | + | − |
| G8 | − | + | − | ○ | | | − | | | | + | | | | − | | | | + | | | | − | + | − |
| G9 | − | + | − | + | | | | − | | | | + | | | | − | | | | + | | | ○ | + | − |
| G10 | − | + | − | | | + | | | | − | | | | + | | | | − | | | | + | ○ | + | − |
| G11 | − | + | − | ○ | − | | | | + | | | | − | | | | + | | | | − | | | + | − |
| G12 | − | + | − | ○ | | | − | | | | + | | | | − | | | | + | | | | − | + | − |
| G13 | − | + | − | + | | | | − | | | | + | | | | − | | | | + | | | ○ | + | − |
| G14 | − | + | − | | | + | | | | − | | | | + | | | | − | | | | + | ○ | + | − |
| G15 | − | + | − | ○ | − | | | | + | | | | − | | | | + | | | | − | | | + | − |
| G16 | − | + | − | ○ | | | − | | | | + | | | | − | | | | + | | | | − | + | − |

FIG. 8A

43

| | | | | |
|---|---|---|---|---|
| G1 | + | | | |
| G2 | | | + | |
| G3 | | − | | |
| G4 | | | | − |

FIG. 8B

43

| | | | | |
|---|---|---|---|---|
| G1 | − | | | |
| G2 | | | − | |
| G3 | | + | | |
| G4 | | | | + |

FIG. 9A

| | | | | |
|---|---|---|---|---|
| G1 | + | | | |
| G2 | | | + | |
| G3 | + | − | | |
| G4 | + | | | − |

FIG. 9B

| | | | | |
|---|---|---|---|---|
| G1 | − | | | |
| G2 | | | − | |
| G3 | − | + | | |
| G4 | − | | | + |

FIG. 13

| | COMBINATION OF DATA ENABLE SIGNALS (15Hz) | | | | | SG23 |
|---|---|---|---|---|---|---|
| | SG7 | SG7D1 | SG7D2 | SG7D3 | SG70 | |
| 1 | High | Low | Low | Low | High | SG21 |
| 2 | don't care | High | Low | Low | High | SG21D1 |
| 3 | don't care | don't care | High | Low | High | SG21D2 |
| 4 | don't care | don't care | don't care | High | High | SG21D3 |
| 5 | OTHER THAN ABOVE | | | | | SG210 |

High: ENABLED, Low: DISABLED, don't care: NO REQUIREMENT

FIG. 20

| | MD1(60Hz) | | MD2 (TF) | MD5(20Hz) | | | | MD6 (TF) (TF) | | MD3(12Hz) | | | | | | | | | | | |
|---|---|---|---|---|---|---|---|---|---|---|---|---|---|---|---|---|---|---|---|---|---|
| | FR0 | FR1 | FR2 | SF3 | SF4 | SF5 | SF6 | SF7 | SF8 | SF9 | SF10 | SF11 | SF12 | SF13 | SF14 | SF15 | SF16 | SF17 | SF18 | SF19 | SF20 | SF21 | SF22 | SF23 |
| G1 | − | + | − | + | − | | − | | | + | | | | | − | | | | | + | | | | |
| G2 | − | + | − | ○ | − | | | + | | | | | − | | | | | + | | | | | − | |
| G3 | − | + | − | | | + | | | − | | | + | | | | | − | | | | | + | | |
| G4 | − | + | − | + | | | − | | | ○ | − | | | | | + | | | | | − | | | |
| G5 | − | + | − | ○ | − | | | + | ○ | | | | | + | | | | | − | | | | | + |
| G6 | − | + | − | | | + | | | − | + | | | | | − | | | | | + | | | | |
| G7 | − | + | − | + | | | − | | | ○ | | | − | | | | | + | | | | | − | |
| G8 | − | + | − | ○ | − | | | + | ○ | | | + | | | | − | | | | | | + | | |
| G9 | − | + | − | | − | + | | | − | ○ | − | | | | | + | | | | | − | | | |
| G10 | − | + | − | + | | | − | | | | | | | + | | | | | − | | | | | + |
| G11 | − | + | − | ○ | − | | | + | ○ | + | | | | | − | | | | | + | | | | |
| G12 | − | + | − | | | + | | | − | ○ | | | − | | | | | + | | | | | − | |
| G13 | − | + | − | + | | | − | | | | | + | | | | | − | | | | | + | | |
| G14 | − | + | − | ○ | − | | | + | | | − | | | | | + | | | | | − | | | |
| G15 | − | + | − | | | + | | | − | | | | | + | | | | | − | | | | | + |

FIG. 21

| | MD3(12Hz) | | | | | | | | | | | | | | MD7 (TF) | (TF) | MD5(20Hz) | | | | MD4 (TF) | MD1 |
|---|---|---|---|---|---|---|---|---|---|---|---|---|---|---|---|---|---|---|---|---|---|---|
| | SF24 | SF25 | SF26 | SF27 | SF28 | SF29 | SF30 | SF31 | SF32 | SF33 | SF34 | SF35 | SF36 | SF37 | SF38 | SF39 | SF40 | SF41 | SF42 | SF43 | SF44 | FR45 |
| G1 | − | | | | | + | | | | | − | | | | | + | | | − | | | + |
| G2 | | | | + | | | | | − | | | | | + | | | − | | | + | ○ | + |
| G3 | | | − | | | | | + | | | | | − | | | | | + | | | − | + |
| G4 | | + | | | | | − | | | | | + | | | ○ | + | | | − | | | + |
| G5 | | | | | − | | | | | + | | | | | − | ○ | − | | | + | ○ | + |
| G6 | − | | | | | + | | | | | − | | | | | | | + | | | − | + |
| G7 | | | | + | | | | | − | | | | | + | ○ | + | | | − | | | + |
| G8 | | | − | | | | | + | | | | | − | | | ○ | − | | | + | ○ | + |
| G9 | | + | | | | | − | | | | | + | | | ○ | | | + | | | − | + |
| G10 | | | | | − | | | | | + | | | | | − | + | | | − | | | + |
| G11 | − | | | | | + | | | | | − | | | | | ○ | − | | | + | ○ | + |
| G12 | | | | + | | | | | − | | | | | + | ○ | | | + | | | − | + |
| G13 | | | − | | | | | + | | | | | − | | | + | | | − | | | + |
| G14 | | + | | | | | − | | | | | + | | | | | − | | | + | ○ | + |
| G15 | | | | | − | | | | | + | | | | | − | | | + | | | − | + |

FIG. 27A

57

| | | | | | |
|---|---|---|---|---|---|
| G1 | + | | | | |
| G2 | | | | − | |
| G3 | | | + | | |
| G4 | | − | | | |
| G5 | | | | | + |

FIG. 27B

57

| | | | | | |
|---|---|---|---|---|---|
| G1 | − | | | | |
| G2 | | | | + | |
| G3 | | | − | | |
| G4 | | + | | | |
| G5 | | | | | − |

DISPLAY DEVICE

CROSS-REFERENCE TO RELATED APPLICATION

This application is bypass continuation of international patent application PCT/JP2014/000934, filed: Feb. 21, 2014 designating the United States of America, the entire disclosure of which is incorporated herein by reference. Priority is claimed based on Japanese patent applications JP 2013-215338, filed: Oct. 16, 2013. The entire disclosures of this Japanese patent application are incorporated herein by reference in its entirety.

TECHNICAL FIELD

This disclosure is related with a display device including a display portion configured to display a frame image.

BACKGROUND

A liquid crystal display device is one example of display devices that are used as high-definition color monitors for computers and other information devices, and as television receivers. A liquid crystal display device fundamentally includes a display portion in which liquid crystals are sandwiched between two substrates at least one of which is made of transparent glass or the like. In addition, a liquid crystal display device includes a driver for selectively applying voltages to pixel electrodes formed on the substrate of the display portion. Pixels of the respective pixel electrodes are controlled based on the voltage application by the driver.

The display portion generally includes a plurality of gate signal lines, a plurality of source signal lines, and a plurality of pixel electrodes. The gate signal lines, for example, respectively extend in a horizontal direction (main scanning direction), and are aligned in a vertical direction (sub scanning direction). The source signal lines, for example, respectively extend in the vertical direction (sub scanning direction), and are aligned in the horizontal direction (main scanning direction). A plurality of thin film transistors (TFTs) and a plurality of the pixel electrodes are disposed in a matrix at intersection points of the gate signal lines and the source signal lines.

A gate driver outputs voltages (gate signals) to the gate signal lines for turning the TFTs on and off. A source driver outputs voltages (source signals) based on an input image signal to the pixel electrodes via the source signal lines to thereby control transmittance of liquid crystals provided corresponding to the pixel electrodes to values according to the source signals.

A display device smoothly displays images on a display portion by successively switching frame images to be displayed on the display portion, for example, based on image signals input from outside. Conventionally, there is a known display device that determines whether an image to be displayed on a display portion is a still picture or a moving picture, and switches between interlaced scanning and progressive scanning of gate signal lines based on a result of the determination. A display device disclosed in a prior art prevents deterioration of image qualities by progressively scanning gate signal lines when an image to be displayed on a display portion is a moving picture, and attempts to reduce power consumption by interlaced scanning of the gate signal lines when the image is a still picture (See Japanese Unexamined Patent Application Publication No. 2006-064964).

Unfortunately, with the device disclosed in the prior art, when the method of scanning the gate signal lines is switched between interlaced scanning and progressive scanning too quickly, a power-supply voltage changes due to load changes and an influence of a leakage of voltages held in pixels, and thus brightness changes. Therefore, it becomes difficult to smoothly switch images to be displayed on the display portion, which may possibly result in excessive deterioration in image qualities.

SUMMARY

To address the above problem, an object of the present disclosure is to provide a display device capable of preventing qualities of images displayed on a display portion from excessively deteriorating when a method of scanning gate signal lines is switched between interlaced scanning and progressive scanning.

In one general aspect, the instant application describes a display device includes that a display portion including a plurality of source signal lines, a plurality of gate signal lines, and a plurality of pixel electrodes, each pixel electrode being connected to one of the plurality of source signal lines and one of the plurality of gate signal lines, the display portion being configured to display a frame image for a vertical synchronizing signal, the frame image being represented by image signals corresponding to the pixel electrodes; a source driver configured to apply voltages to the pixel electrodes corresponding to the image signals via the plurality of source signal lines; a gate driver configured to scan the plurality of gate signal lines by outputting a gate signal to each of the plurality of gate signal lines; and a controller configured to control the source driver and the gate driver based on a control mode for displaying the frame image on the display portion, the control mode including a basic control mode, a low-power control mode, and a first shift control mode. The display portion includes N adjacent gate signal lines as the plurality of gate signal lines, where N is an integer not less than 3. In the basic control mode, the controller is configured to display the frame image on the display portion by causing the gate driver to progressively scan all of the N gate signal lines within a predetermined time period. In the low-power control mode, the controller is configured to display a sub-frame image on the display portion by causing the gate driver to scan W gate signal lines within the predetermined time period, and to perform interlaced scanning of the plurality of gate signal lines every K lines, where W is an integer that is not less than 2 and is less than N and K is an integer expressed by N/W. In the low-power control mode, the controller is configured to cause the gate driver to scan all of the N gate signal lines by repeating display of the sub-frame image for K times, and thus displaying the frame image constituted by K sub-frame images on the display portion. In the first shift control mode, the controller is configured to display a first intermediate sub-frame image on the display portion by causing the gate driver to scan Z1 gate signal lines within the predetermined time period, where Z1 is an integer expressed by $W<Z1<N$. The control mode is configured to shift from the basic control mode to the low-power control mode by way of the first shift control mode.

According to the present disclosure, it is possible to reduce an amount of change in the number of the gate signal lines to be scanned within the certain time period when the control mode shifts from the basic control mode to the low-power control mode by way of the first shift control mode, as compared to the case in which the control mode directly shifts from the basic control mode to the low-power control mode. Therefore, it is possible to prevent qualities of frame images displayed on the display portion from excessively deteriorating when the control mode shifts from the basic control mode to the low-power control mode.

BRIEF DESCRIPTION OF DRAWINGS

FIG. 5 is a diagram schematically showing polarities of voltages applied to one of the source signal lines in performing the operation shown in FIG. 4 of the control mode shifting from the basic control mode to the low-power control mode and returning to the basic control mode from the low-power control mode.

FIGS. 8A and 8B are diagram schematically showing the thinning pattern used in the low-power control mode.

FIGS. 9A and 9B are diagram schematically showing polarities of the voltages applied in one frame when the thinning pattern is used shown in FIGS. 6A and 6B.

FIG. 13 is a truth table of a selector in a data delay portion shown in FIG. 12

FIG. 20 is a diagram schematically showing polarities of voltages applied to one of the source signal lines in performing the operation shown in FIG. 19 of the control mode shifting from the basic control mode to the low-power control mode by way of the second low-power control mode, and returning to the basic control mode from the low-power control mode by way of the second low-power control mode.

FIG. 21 is a diagram schematically showing polarities of voltages applied to one of the source signal lines in performing the operation shown in FIG. 19 of the control mode shifting from the basic control mode to the low-power control mode by way of the second low-power control mode, and returning to the basic control mode from the low-power control mode by way of the second low-power control mode.

FIGS. 27A and 27B are diagrams schematically showing the thinning pattern used in the low-power control mode.

DETAILED DESCRIPTION

Figure 1:
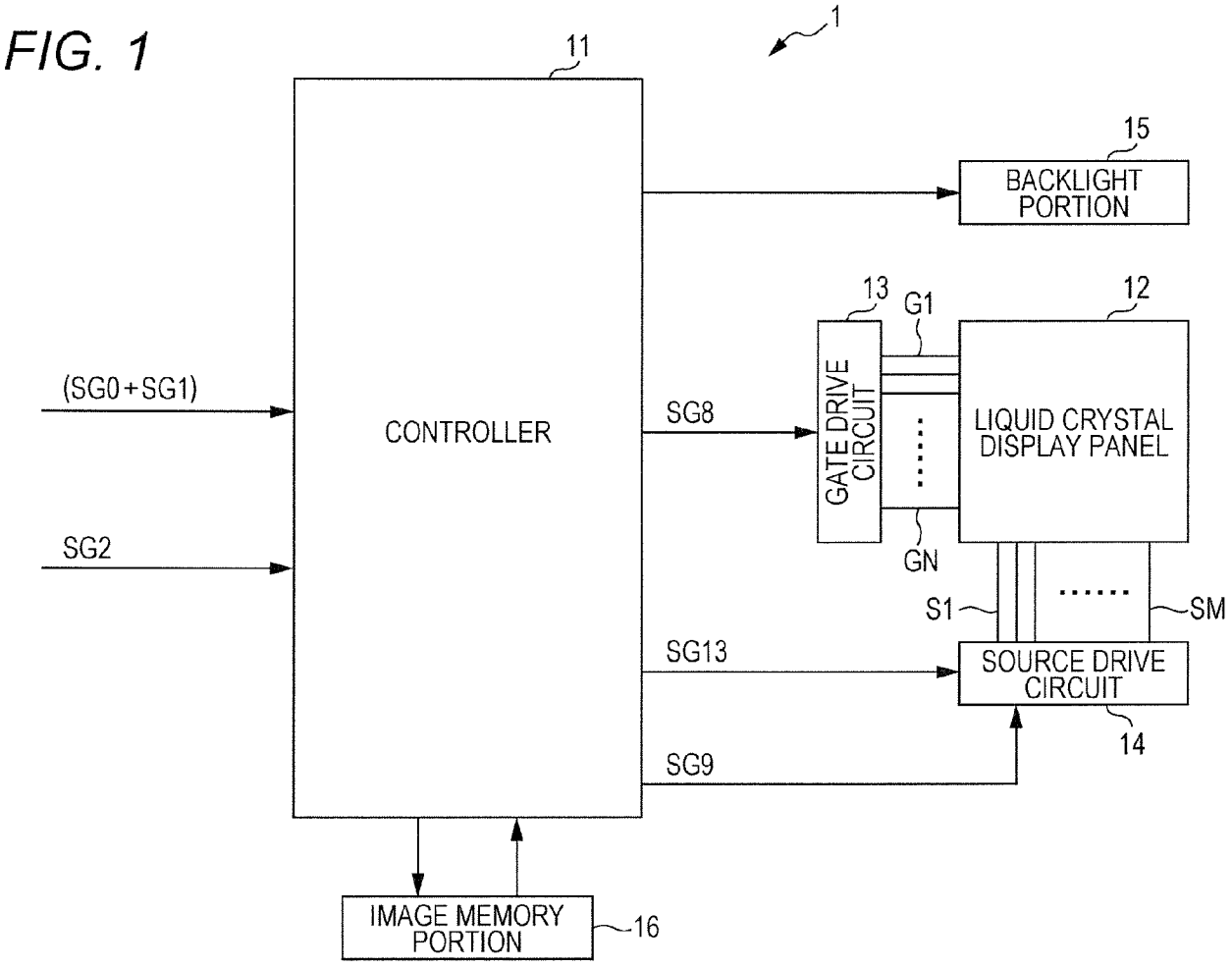
FIG. 1 is a block diagram showing a configuration of a display device according to a first embodiment.

Exemplary display devices are described below with reference to the drawings. In the following embodiments, similar constituent elements are assigned with similar reference numerals. Redundant explanation is omitted as appropriate to clarify the description. Configurations, arrangements and shapes shown in the drawings and description relating to the drawings aim to make principles of the embodiments easily understood. Therefore, the principles of the present embodiments are not limited thereto.

It is to be understood that the following disclosure provides many different embodiments, or examples, for implementing different features of the present subject matter. Specific embodiments or examples of components and arrangements are described below to simplify the present disclosure. These are, of course, merely examples and are not intended to be limiting. In addition, the term "made of" may mean either "comprising" or "consisting of."

First Embodiment

Figure 2:
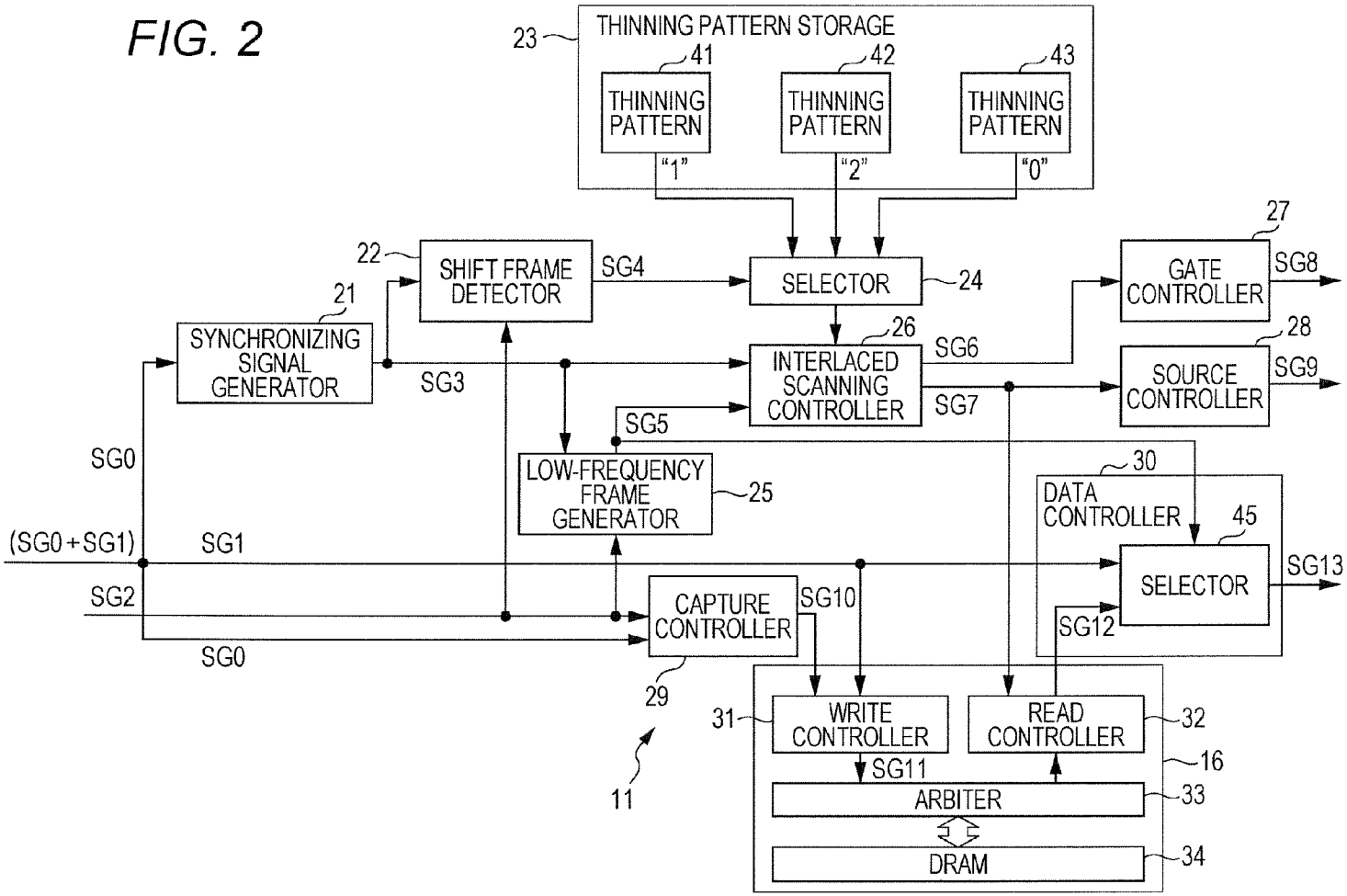
FIG. 2 is a block diagram showing a configuration of a controller and an image memory portion shown in FIG. 1.
Figure 3:
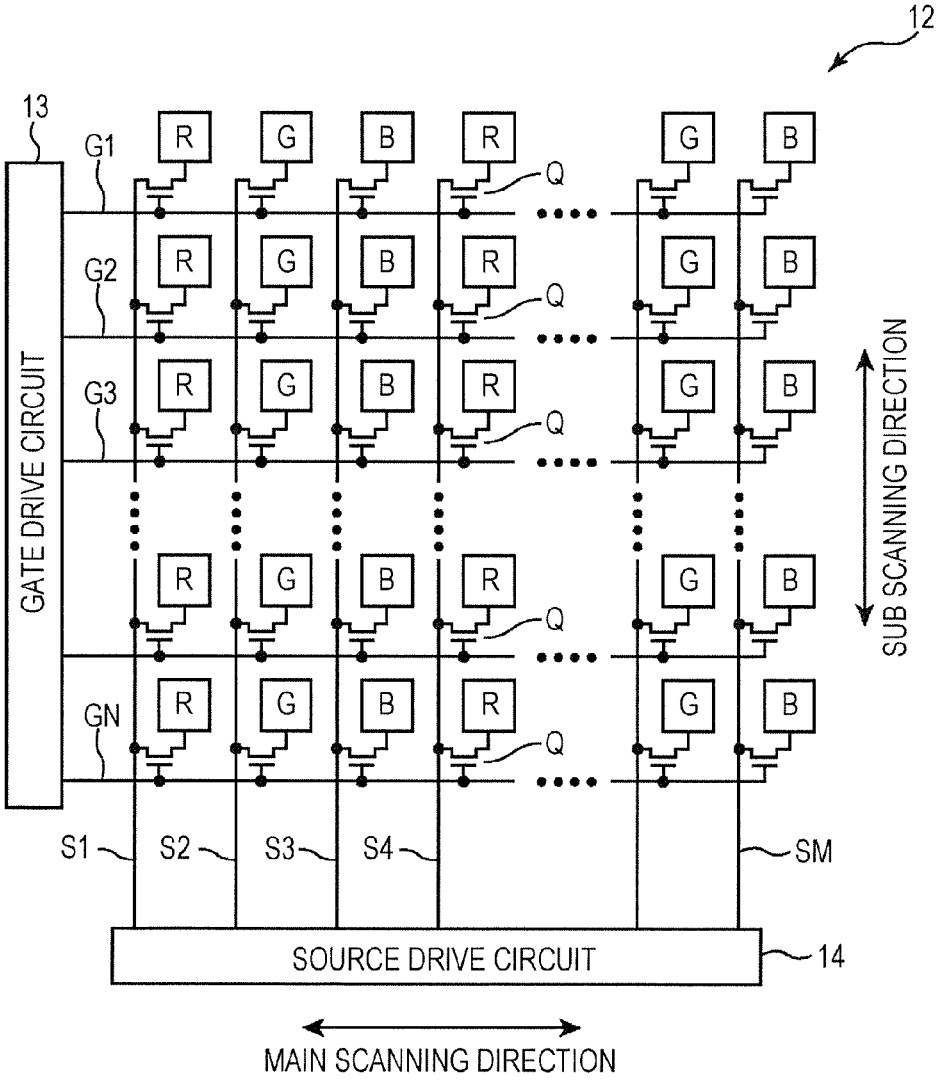
FIG. 3 is a circuit diagram showing a state of connection of signal lines in a liquid crystal display panel shown in FIG. 1.

FIG. 1 is a block diagram showing a configuration of a display device according to a first embodiment. FIG. 2 is a block diagram showing a configuration of a controller and an image memory portion shown in FIG. 1. FIG. 3 is a circuit diagram showing a state of connection of signal lines in a liquid crystal display panel shown in FIG. 1.

Referring to FIG. 1, a display device 1 includes a controller 11, a liquid crystal display panel 12, a gate drive circuit 13, a source drive circuit 14, a backlight portion 15, and an image memory portion 16. The controller 11 includes, as shown in FIG. 2, a synchronizing signal generator 21, a shift frame detector 22, a thinning pattern storage 23, a selector 24, a low-frequency frame generator 25, an interlaced scanning controller 26, a gate controller 27, a source controller 28, a capture controller 29, and a data controller 30. The image memory portion 16 includes a write controller 31, a read controller 32, an arbiter 33, and a dynamic random access memory (DRAM) 34. The thinning pattern storage 23 stores thinning patterns 41, 42, and 43. The data controller 30 includes a selector 45.

The liquid crystal display panel 12 includes, as shown in FIG. 3, a plurality of source signal lines S1, S2, . . . , SM, a plurality of gate signal lines G1, G2, . . . , GN, a plurality of thin film transistors Q, and a plurality of pixel electrodes R, G, and B (i.e., the pixel electrode R corresponding to a red sub-pixel, the pixel electrode G corresponding to a green sub-pixel, and the pixel electrode B corresponding to a blue sub-pixel). The source signal lines S1, S2, . . . , SM extend along a vertical direction (sub scanning direction), and are aligned in a horizontal direction (main scanning direction). The gate signal lines G1, G2, . . . , GN extend along the horizontal direction (main scanning direction), and are aligned in the vertical direction (sub scanning direction). The thin film transistors Q and the pixel electrodes R, G, and B are disposed in a matrix at intersections between the source signal lines S1, S2, . . . , SM and the gate signal lines G1, G2, . . . , GN.

The backlight portion 15 includes a light source, and is configured to illuminate the liquid crystal display panel 12 from the back side of the liquid crystal display panel 12. The backlight portion 15 may employ a lighting method of either of an edge lighting type and a direct lighting type.

To the controller 11, an input signal including a synchronizing signal SG0 and an image signal SG1, and a standby mode signal SG2 are input from outside. The synchronizing signal SG0 includes a vertical synchronizing signal Vsync and a horizontal synchronizing signal Hsync. The image signal SG1 represents a frame image. The image signal SG1 includes image signals respectively corresponding to the pixel electrodes R, G, and B of the liquid crystal display panel 12. The standby mode signal SG2 is turned on when the frame image represented by the image signal SG1 that has been input is switched from a moving picture to a still picture. When the standby mode signal SG2 is turned on, then, an input of the image signal SG1 representing the still picture is stopped. This helps reduction of power consumption. Further, the standby mode signal SG2 is turned off when the frame image represented by the image signal SG1 that has been input is switched from a still picture to a moving picture.

The controller 11 controls the source drive circuit 14 to apply a voltage, in a column inversion drive mode, to the pixel electrodes R, G, and B, which are disposed in a matrix, of the liquid crystal display panel 12. The column inversion drive mode is a drive mode in which voltages of the same polarity are applied to the pixel electrodes connected to the same source signal line in each frame, polarities of voltages applied to the pixel electrodes connected to adjacent ones of source signal lines are inverted, and polarities of the voltages applied to the pixel electrodes are inverted for each frame.

The controller 11 controls the gate drive circuit 13 and the source drive circuit 14 according to a control mode. The controller 11 includes a basic control mode and a low-power control mode as the control mode. The controller 11 normally takes the basic control mode as the control mode. The controller 11 causes the control mode to shift from the basic control mode to the low-power control mode when the standby mode signal SG2 is turned on. When the standby mode signal SG2 is turned off, the controller 11 causes the control mode to return to the basic control mode from the low-power control mode.

In the basic control mode, as a result of completion of application of the voltage to the gate signal lines G1, G2, . . . , GN from the top to the bottom (that is, the gate signal lines G1, G2, . . . , GN are progressively scanned) by the gate drive circuit 13 and the source drive circuit 14, image data corresponding to the image signal SG1 is written once into pixels (liquid crystals) of all of the pixel electrodes R, G, and B. Writing of the image data to all of the pixels generates an image for one frame. The liquid crystal display panel 12 is a holding-type display portion that holds the written image data for one frame period until the image data is next written. The liquid crystal display panel 12 may employ an IPS (In Plane Switching) method, a VA (Vertical Alignment) method, or any other methods.

In the basic control mode, the controller 11 repeats image generation for one frame at a frame frequency F1. In the first embodiment, F1=60 Hz. This allows a moving picture displayed on the liquid crystal display panel 12 to be visually recognized by a viewer. When the standby mode signal SG2 is turned on, the controller 11 stores an image signal representing a frame image at this time in the DRAM 34 of the image memory portion 16, and causes the control mode to shift from the basic control mode to the low-power control mode.

In the low-power control mode, the controller 11 repeats image generation for one frame at a frame frequency F2 using the image signal stored in the DRAM 34. In the first embodiment, F2=15 Hz. In the low-power control mode, the controller 11 displays an image for one frame on the liquid crystal display panel 12 by performing interlaced scanning of the gate signal lines by every four gate signal lines (that is, thinning the gate signal lines to be scanned), generating a sub-frame image at the same frequency as the frame frequency F1, and repeating an operation of displaying the generated sub-frame image on the liquid crystal display panel 12 four times. This allows a still picture displayed on the liquid crystal display panel 12 to be visually recognized by the viewer.

The controller 11 further includes a first shift control mode and a second shift control mode as the control mode. When the control mode shifts from the basic control mode to the low-power control mode, the controller 11 causes the control mode to shift from the basic control mode to the low-power control mode by way of the first shift control mode. When the controller 11 causes the control mode to return to the basic control mode from the low-power control mode, the controller 11 causes the control mode to shift from the low-power control mode to the basic control mode by way of the second shift control mode. The first shift control mode and the second shift control mode will be described in detail later.

The controller 11 controls light-on and light-off of the backlight portion 15. The controller 11 repeats light-on and light-off of the backlight portion 15 at the same frequency as the frame frequency F1 regardless of the frame frequency.

In FIG. 2, when the synchronizing signal SG0 and the image signal SG1 are input, the synchronizing signal generator 21 generates the input synchronizing signal SG0 as a synchronizing signal SG3 for display an image. When the synchronizing signal SG0 and the image signal SG1 are not input, the synchronizing signal generator 21 generates the synchronizing signal SG3 for displaying an image. The synchronizing signal generator 21 outputs the generated synchronizing signal SG3 to the shift frame detector 22, the low-frequency frame generator 25, and the interlaced scanning controller 26. The synchronizing signal SG3 includes the vertical synchronizing signal Vsync and the horizontal synchronizing signal Hsync, as the synchronizing signal SG0 does.

The shift frame detector 22 includes a previously set sequence for causing the control mode to shift from the basic control mode to the low-power control mode by way of the first shift control mode, and a previously set sequence for causing the control mode to return to the basic control mode from the low-power control mode by way of the second shift control mode. The shift frame detector 22 generates a selection signal SG4 based on these sequences. The shift frame detector 22 outputs the generated selection signal SG4 to the selector 24.

The selection signal SG4 includes a signal "0" representing a thinning pattern in the low-power control mode, a signal "1" representing a thinning pattern in the first shift control mode when the control mode shifts from the basic control mode to the low-power control mode, and a signal "2" representing a thinning pattern in the second shift control mode when the control mode returns to the basic control mode from the low-power control mode.

The thinning patterns 41, 42, and 43 stored in the thinning pattern storage 23 represent thinning patterns when the gate signal lines are subjected to interlaced scanning. The thinning pattern 41 represents a thinning pattern in the first shift control mode. The thinning pattern 42 represents a thinning pattern in the second shift control mode. The thinning pattern 43 represents a thinning pattern in the low-power control mode. The thinning patterns 41 to 43 will be described in detail later.

The selector 24 outputs the thinning pattern 41 to the interlaced scanning controller 26 when the selection signal SG4 output from the shift frame detector 22 is "1", outputs the thinning pattern 42 to the interlaced scanning controller 26 when the selection signal SG4 is "2", and outputs the thinning pattern 43 to the interlaced scanning controller 26 when the selection signal SG4 is "0".

When the standby mode signal SG2 is turned on, the low-frequency frame generator 25 outputs a switching signal SG5 that is turned on in synchronization with the synchronizing signal SG3 delayed one frame or more after the standby mode signal SG2 is turned on. The switching signal SG5 is a signal for executing interlaced scanning of the gate signal lines in the first shift control mode, the second shift control mode, and the low-power control mode. In order to store the frame image immediately before an input of the image signal SG1 is stopped in the DRAM 34, the standby mode signal SG2 is turned on one frame before the input of the image signal SG1 is stopped. Accordingly, the switching signal SG5 needs to be delayed one frame or more after the standby mode signal SG2 is turned on.

Further, when the standby mode signal SG2 is turned off, the low-frequency frame generator 25 turns the switching signal SG5 off in synchronization with the synchronizing signal SG3 delaying one frame or more after the standby mode signal SG2 is turned off. When a still picture is switched to a moving picture and an input of an input signal is restarted, for example, depending on the timing of the restart, the synchronizing signal SG0 included in the input signal is not in synchronization with the synchronizing signal SG3 generated by the synchronizing signal generator 21 while the input has been stopped. Accordingly, it is intended to prevent the switching signal SG5 from being turned off without synchronizing with the synchronizing signal SG0 that is restarted to be input.

While the switching signal SG5 is turned off, that is, during the basic control mode, the interlaced scanning controller 26 generates an output enable signal SG6 at the frame frequency F1 of 60 Hz in synchronization with the synchronizing signal SG3. Further, during the low-power control mode in which the switching signal SG5 is turned on, the interlaced scanning controller 26 generates the output enable signal SG6 at the frame frequency F2 of 15 Hz based on the thinning pattern 43 input from the selector 24. Moreover, during the first shift control mode in which the switching signal SG5 is turned on, the interlaced scanning controller 26 generates the output enable signal SG6 based on the thinning pattern 41 which is input from the selector 24.

Furthermore, during the second shift control mode in which the switching signal SG5 is turned on, the interlaced scanning controller 26 generates the output enable signal SG6 based on the thinning pattern 42 which is input from the selector 24. The interlaced scanning controller 26 outputs the generated output enable signal SG6 to the gate controller 27. The interlaced scanning controller 26 also generates a data enable signal SG7 which is similar to the output enable signal SG6. The interlaced scanning controller 26 outputs the generated data enable signal SG7 to the source controller 28 and the read controller 32. Specific examples of the output enable signal SG6 and the data enable signal SG7 will be described later.

The gate controller 27 generates a gate drive signal SG8. The gate drive signal SG8 includes a gate start signal, a gate shift clock signal, and an output enable signal. The gate controller 27 outputs the generated gate drive signal SG8 to the gate drive circuit 13.

In the basic control mode, the gate drive circuit 13 applies a scan voltage (gate signal) progressively to the gate signal lines G1, G2, . . . , GN from the top to the bottom based on the gate drive signal SG8, and sequentially turns thin film transistors Q of the corresponding gate signal lines G1, G2, . . . , GN on.

In the low-power control mode, the gate drive circuit 13 repeats interlaced scanning of applying a scan voltage (gate signal) to the gate signal lines G1, G2, . . . , GN based on the gate drive signal SG8 every four lines in this first embodiment four times, and sequentially turns the thin film transistors Q of the corresponding gate signal lines G1, G2, . . . , GN on.

The source controller 28 generates a latch timing signal SG9 based on the data enable signal SG7 from the interlaced scanning controller 26. The latch timing signal SG9 is for controlling operational timing of the source drive circuit 14. The source controller 28 outputs the generated latch timing signal SG9 to the source drive circuit 14.

The capture controller 29 generates a range signal SG10 when the standby mode signal SG2 is turned on. The range signal SG10 represents a range of data stored in the DRAM 34 of the image memory portion 16 out of the image signal SG1. The capture controller 29 outputs the generated range signal SG10 to the write controller 31 of the image memory portion 16.

The write controller 31 generates a write address, and makes a write request to the arbiter 33 for the range of the range signal SG10 out of the image signal SG1. The write controller 31 outputs an image signal SG11 of the write request to the arbiter 33. The read controller 32 generates a read address, and makes a read request to the arbiter 33. The arbiter 33 coordinates and arbitrates the write request and the read request, and writes data to the DRAM 34 and reads data written in the DRAM 34. Further, the read controller 32 outputs an image signal SG12 that has been read by the arbiter 33 to the selector 45.

The selector 45 outputs the image signal SG1 included in the input signal as an image signal SG13 to the source drive circuit 14 while the switching signal SG5 is turned off. Further, the selector 45 outputs the image signal SG12 which is output from the read controller 32 as the image signal SG13 to the source drive circuit 14 while the switching signal SG5 is turned on.

The source drive circuit 14 outputs a voltage (source signal) based on the input image signal SG13 to the source signal lines S1, S2, . . . , SM. This allows a voltage (source signal) based on the image signal SG13 to be applied to the pixels (liquid crystals) of the pixel electrodes R, G, and B corresponding to the gate signal lines G1, G2, . . . , GN selected by the gate drive circuit 13 (that is, the pixel electrodes whose thin film transistors Q are turned on), and thus transmittance of the pixels (liquid crystals) of the pixel electrodes R, G, and B is controlled. In this embodiment, the liquid crystal display panel 12 corresponds to one example of the display portion, the gate drive circuit 13 corresponds to one example of the gate driver, the source drive circuit 14 corresponds to one example of the source driver, the thinning pattern storage 23 corresponds to one example of the pattern storage, and the DRAM 34 corresponds to one example of an image storage.

Figure 4:
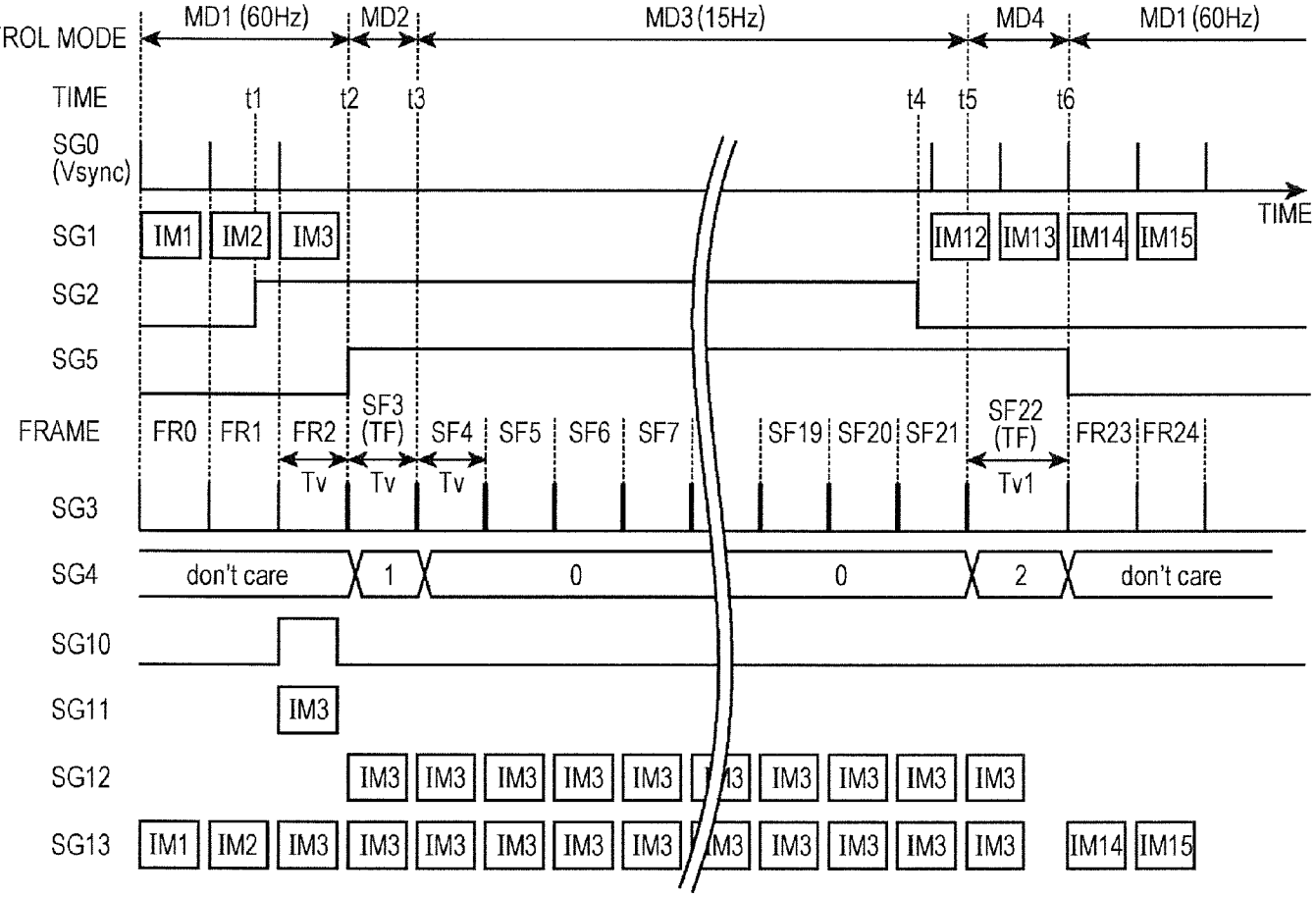
FIG. 4 is a timing chart schematically showing main signals shown in FIG. 2 in a case in which the control mode shifts from the basic control mode to the low-power control mode, and returns to the basic control mode from the low-power control mode.

FIG. 4 is a timing chart schematically showing main signals shown in FIG. 2 in a case in which the control mode shifts from the basic control mode to the low-power control mode, and returns to the basic control mode from the low-power control mode. An operation of the display device 1 according to the first embodiment will be described with reference to FIG. 1 through FIG. 4.

Referring to FIG. 4, in frames FR0 to FR2, the image signal SG1 representing images IM1 to IM3 is input from outside every frame in synchronization with the synchronizing signal SG0 (the vertical synchronizing signal Vsync). During this time, as described above, the synchronizing signal SG0 input from outside is output as the synchronizing signal SG3 from the synchronizing signal generator 21. Then, the image signal SG13 representing the images IM1 to IM3 is output from the selector 45 to the source drive circuit 14. The control mode in the frames FR0 to FR2 is a basic control mode MD1.

When the standby mode signal SG2 is turned on at time t1 in the course of the frame FR1, the capture controller 29 generates the range signal SG10 in synchronization with the synchronizing signal SG0 that comes next. As a result, the image signal SG11 representing the image IM3 is output from the write controller 31 by way of the arbiter 33 and stored in the DRAM 34. Thereafter, an input of the synchronizing signal SG0 and the image signal SG1 is stopped. After stopping the input of the synchronizing signal SG0, the synchronizing signal generator 21 generates and outputs the synchronizing signal SG3 (Vsync).

In synchronization with the synchronizing signal SG3 output by the synchronizing signal generator 21 at time t2, the low-frequency frame generator 25 turns the switching signal SG5 on. When the switching signal SG5 is turned on, the selector 45 outputs, as the image signal SG13 to the source drive circuit 14, the image signal SG12 that has been read from the DRAM 34 in place of the image signal SG1.

On the other hand, when the standby mode signal SG2 is turned on, the shift frame detector 22 outputs the signal "1" representing the thinning pattern in the first shift control mode as the selection signal SG4 to the selector 24, in synchronization with the synchronizing signal SG3 at time t2 at which the switching signal SG5 is turned on. As the selection signal SG4 is "1", the selector 24 outputs the thinning pattern 41 to the interlaced scanning controller 26. In this manner, a sub-frame SF3 functions as a shift frame TF, and the control mode in the sub-frame SF3 is a first shift control mode MD2.

The shift frame detector 22 outputs the signal "0" representing the thinning pattern in the low-power control mode as the selection signal SG4 to the selector 24, in synchronization with the synchronizing signal SG3 that comes next at time t3. As the selection signal SG4 is "0", the selector 24 outputs the thinning pattern 43 to the interlaced scanning controller 26. The control mode in sub-frames SF4 to SF21 after time t3 is a low-power control mode MD3, and the frame frequency F2 in the first embodiment is expressed by F2=15 Hz.

The standby mode signal SG2 is turned off at time t4 in the course of the sub-frame SF21, and the input of the synchronizing signal SG0 and the image signal SG1 is restarted. In synchronization with the synchronizing signal SG3 that comes next (at time t5) after the standby mode signal SG2 is turned off, the shift frame detector 22 outputs the signal "2" representing the thinning pattern in the second shift control mode as the selection signal SG4 to the selector 24. As the selection signal SG4 is "2", the selector 24 outputs the thinning pattern 42 to the interlaced scanning controller 26. In this manner, a sub-frame SF22 functions as the shift frame TF, and the control mode in the sub-frame SF22 is a second shift control mode MD4.

After the synchronizing signal SG0 that is input from outside when one frame period or more has lapsed after the synchronizing signal SG3 at time t5 (time t6), the synchronizing signal generator 21 outputs the synchronizing signal SG0 from outside as the synchronizing signal SG3. Then, the low-frequency frame generator 25 turns the switching signal SG5 off in synchronization with the synchronizing signal SG3 at time t6.

When the switching signal SG5 is turned off, the selector 45 outputs, as the image signal SG13 to the source drive circuit 14, the image signal SG1 in place of the image signal SG12. Accordingly, after the synchronizing signal SG0 (SG3) at time t6, images IM14 and IM15 are displayed respectively in frames FR23 and FR24 at the frame frequency F1 of 60 Hz on the liquid crystal display panel 12. In this manner, the control mode in and after the frames FR23 and FR24 is the basic control mode MD1.

As shown in FIG. 4, a period, for example, of the frame FR2 in the basic control mode MD1, a period, for example, of the sub-frame SF3 in the first shift control mode MD2, and a period, for example, of the sub-frame SF4 in the low-power control mode MD3 are equal to a vertical scanning period Tv when the frame frequency is 60 Hz. Further, for a period Tv1 of the sub-frame SF22 in the second shift control mode MD4, a relation between Tv and Tv1 is expressed by Tv1>Tv as the synchronizing signal SG0 at which the input is restarted is out of synchronization. In this embodiment, the vertical scanning period Tv is one example of a certain time period.

FIG. 5 is a diagram schematically showing polarities of voltages applied to one of the source signal lines (e.g., the source signal line S1) in performing the operation shown in FIG. 4 of the control mode shifting from the basic control mode to the low-power control mode and returning to the basic control mode from the low-power control mode. In FIG. 5, the frames FR0 to FR2, the sub-frames SF3 to SF22, and the frames FR23 and FR24 are shown, similarly to FIG. 4. Further, in FIG. 5, the number N of the gate signal lines is expressed by N=16.

Figure 6A:
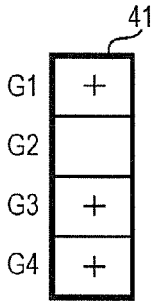
FIGS. 6A and 6B are diagrams schematically showing the thinning pattern used in the first shift control mode when the control mode shifts from the basic control mode to the low-power control mode by way of the first shift control mode.
Figure 6B:
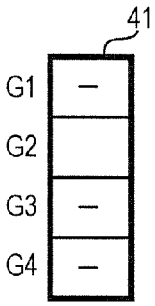

FIGS. 6A and 6B schematically show the thinning pattern 41 used in the first shift control mode when the control mode shifts from the basic control mode to the low-power control mode by way of the first shift control mode. FIGS. 7A to 7H schematically show the thinning pattern 42 used in the second shift control mode when the control mode returns to the basic control mode from the low-power control mode by way of the second shift control mode. FIGS. 8A and 8B schematically show the thinning pattern 43 used in the low-power control mode. FIGS. 9A and 9B schematically show polarities of the voltages applied in one frame when the thinning pattern is used shown in FIGS. 6A and 6B.

In FIGS. 6A to 9B, as the patterns for the gate signal lines G5 to G8, G9 to G12, and G13 to G16 are the same as the pattern for the gate signal lines G1 to G4, only the pattern for the gate signal lines G1 to G4 is shown. The thinning patterns 41 to 43 stored in the thinning pattern storage 23 will be described with reference to FIG. 5 to FIG. 9B.

As described with reference to FIG. 4, in the frames FR0 to FR2 in FIG. 5, the control mode is the basic control mode MD1, and the frame frequency F1 for image display is expressed by F1=60 Hz. As shown in FIG. 5, the pixel electrodes are driven in the column inversion drive mode taking the polarity of a voltage applied to the source signal line S1 in the frame FR0 as "−", the polarity of a voltage applied to the source signal line S1 in the frame FR1 as "+", and the polarity of a voltage applied to the source signal line S1 in the frame FR2 as "−".

Further, as described with reference to FIG. 4, the sub-frame SF3 functions as the shift frame TF, and the control mode is the first shift control mode MD2. Moreover, in and after the sub-frame SF4, the control mode is the low-power control mode MD3, the frame frequency F2 for image display is expressed by F2=15 Hz. In the first shift control mode MD2 and the low-power control mode MD3, the gate signal lines to be scanned are thinned every sub-frame.

Specifically, in the low-power control mode MD3, the gate signal lines G1 to G16 are subjected to interlaced scanning at 60 Hz every four gate signal lines, the interlaced scanning is repeated four times, and thus all of the gate signal lines G1 to G16 are scanned. In other words, by displaying four sub-frame images at 60 Hz in the four sub-frames SF3 to SF6, an image is displayed at the frame frequency F2 expressed by F2=15 Hz.

In this manner, a set of the sub-frames SF3 to SF6 constitutes one frame. Similarly, each set of the sub-frames SF7 to SF10, SF11 to SF14, SF15 to SF18, and SF19 to SF22 constitutes one frame.

Here, if the thinning pattern 43 in the low-power control mode shown in FIG. 8A is used as it is in the sub-frames SF3 to SF6, to the gate signal lines G3, G7, G11, and G15 indicated by a circle in FIG. 5, voltages of "−" polarity are applied continuously in the frame FR2 and the sub-frame SF4. Similarly, to the gate signal lines G4, G8, G12, and G16 indicated by a circle in FIG. 5, voltages of "−" polarity are applied continuously in the frame FR2 and the sub-frame SF6.

In this manner, if voltages of the same polarity are continuously applied to a part of the pixel electrodes during the shift of the control mode although the pixel electrodes are driven in the column inversion drive mode, image qualities deteriorate too much due to reasons such as flickers being produced.

Thus, in the first embodiment, the first shift control mode MD2 is taken as the control mode in the sub-frame SF3, and the thinning pattern 41 shown in FIG. 6A is used. As a result, the gate signal lines are scanned by the thinning pattern shown in FIG. 9A in the sub-frames SF3 to SF6. With this, continuous application of voltages of "−" polarity to the pixel electrodes connected to the source signal line S1 is avoided.

If a voltage of "+" polarity is applied in the last frame in the basic control mode MD1 as in the frame FR1, the thinning pattern 41 shown in FIG. 6B may be used. As a result, the gate signal lines are scanned by the thinning pattern shown in FIG. 9B in the sub-frames SF3 to SF6. With this, continuous application of voltages of "+" polarity to the pixel electrodes connected to the source signal line S1 can be avoided.

Further, patterns of the thinning pattern 43 in the low-power control mode MD3 shown in FIGS. 8B and 8A are alternately used in the sub-frames SF7 to SF10, SF11 to SF14, SF15 to SF18, and SF19 to SF22. Then, as described with reference to FIG. 4, the control mode returns to the basic control mode MD1 in the frame FR23, and a voltage is applied to the source signal line S1 at the frame frequency of 60 Hz in the frames FR23 and FR24.

However, if the thinning pattern 43 in the low-power control mode MD3 shown in FIG. 8A is used as it is in the sub-frame SF22, to the gate signal lines G1, G5, G9, and G13 indicated by a circle in FIG. 5, voltages of "+" polarity are applied continuously in the sub-frame SF19 and the frame FR23. Similarly, to the gate signal lines G2, G6, G10, and G14 indicated by a circle in FIG. 5, voltages of "+" polarity are applied continuously in the sub-frame SF21 and the frame FR23.

Figure 7A:
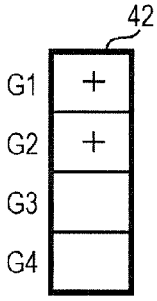
FIGS. 7A to 7H are diagrams schematically showing the thinning pattern used in the second shift control mode when the control mode returns to the basic control mode from the low-power control mode by way of the second shift control mode.
Figure 7B:
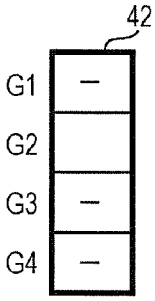
Figure 7C:
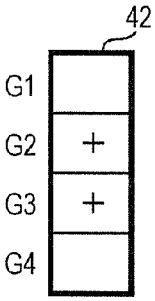
Figure 7D:
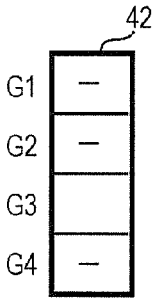

Thus, in the first embodiment, the second shift control mode MD4 is taken as the control mode in the sub-frame SF22, the sub-frame SF22 functions as the shift frame TF, and the thinning pattern 42 shown in FIG. 7D is used in the sub-frame SF22. With this, continuous application of voltages of "+" polarity to the pixel electrodes connected to the source signal line S1 is avoided.

If a timing at which the standby mode signal SG2 is turned off comes earlier than the case shown in FIG. 4 by one sub-frame period (the vertical scanning period Tv), the second shift control mode MD4 is taken as the control mode in the sub-frame SF21. Accordingly, in the sub-frame SF22 in which the control mode is the basic control mode MD1, a voltage of "−" polarity is applied to the source signal line S1 as in the frame FR24. This means that voltages of "−" polarity are continuously applied to the gate signal lines G3, G7, G11, and G15. Therefore, when the second shift control mode MD4 is taken as the control mode of the sub-frame SF21, the thinning pattern 42 shown in FIG. 7C is used.

If a timing at which the standby mode signal SG2 is turned off comes earlier than the case shown in FIG. 4 by two sub-frame periods, the second shift control mode MD4 is taken as the control mode in the sub-frame SF20. Accordingly, in the sub-frame SF21 in which the control mode is the basic control mode MD1, a voltage of "+" polarity is applied to the source signal line S1 as in the frame FR23. This means that voltages of "+" polarity are continuously applied to the gate signal lines G1, G4, G5, G8, G9, G12, G13, and G16. Therefore, when the second shift control mode MD4 is taken as the control mode of the sub-frame SF20, the thinning pattern 42 shown in FIG. 7B is used.

If a timing at which the standby mode signal SG2 is turned off comes earlier than the case shown in FIG. 4 by three sub-frame period, the second shift control mode MD4 is taken as the control mode in the sub-frame SF19. Accordingly, in the sub-frame SF20 in which the control mode is the basic control mode MD1, a voltage of "−" polarity is applied to the source signal line S1 as in the frame FR24. This means that voltages of "−" polarity are continuously applied to the gate signal lines G2, G6, G10, and G14. Therefore, when the second shift control mode MD4 is taken as the control mode of the sub-frame SF19, the thinning pattern 42 shown in FIG. 7A is used.

Figure 7E:
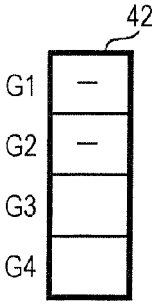
Figure 7F:
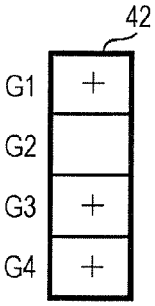
Figure 7G:
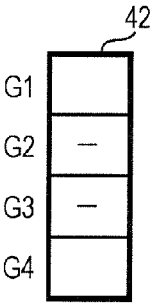
Figure 7H:
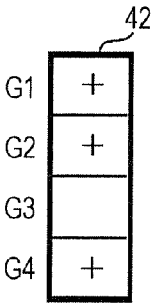

Similarly, if the timing at which the standby mode signal SG2 is turned off comes earlier than the case shown in FIG. 4 by 4 sub-frame periods, the second shift control mode MD4 is taken as the control mode in the sub-frame SF18, and the thinning pattern 42 shown in FIG. 7H is used.

Similarly, if the timing at which the standby mode signal SG2 is turned off comes earlier than the case shown in FIG. 4 by 5 sub-frame periods, the second shift control mode MD4 is taken as the control mode in the sub-frame SF17, and the thinning pattern 42 shown in FIG. 7G is used.

Similarly, if the timing at which the standby mode signal SG2 is turned off comes earlier than the case shown in FIG. 4 by 6 sub-frame periods, the second shift control mode MD4 is taken as the control mode in the sub-frame SF16, and the thinning pattern 42 shown in FIG. 7F is used.

Similarly, if the timing at which the standby mode signal SG2 is turned off comes earlier than the case shown in FIG. 4 by 7 sub-frame periods, the second shift control mode MD4 is taken as the control mode in the sub-frame SF15, and the thinning pattern 42 shown in FIG. 7E is used.

Based on the above operation, regardless of the timing at which the standby mode signal SG2 is turned off, continuous application of voltages of the same polarity to the pixel electrodes connected to the source signal line S1 can be avoided.

As shown in FIG. 6A to FIG. 8B, the thinning patterns 41 to 43 indicate gate signal lines to which a voltage is applied (that are to be scanned). In the drawings, for the thinning pattern 41 in FIG. 6A and the thinning pattern 41 in FIG. 6B, gate signal lines to be scanned are the same and only polarities of voltages to be applied are different from each other. Therefore, the thinning pattern storage 23 may store only one of the thinning patterns as the thinning pattern 41. In this case, the interlaced scanning controller 26 or the source controller 28 may determine the polarity of a voltage to be applied in the first shift control mode MD2 such that the polarity is opposite of the polarity of the voltage applied in the last frame in the basic control mode MD1.

Further, in the thinning pattern 42 in the FIG. 7A and the thinning pattern 42 in FIG. 7E, gate signal lines to be scanned are the same and only polarities of voltages to be applied are different from each other. In the thinning pattern 42 in the FIG. 7B and the thinning pattern 42 in FIG. 7F, gate signal lines to be scanned are the same and only polarities of voltages to be applied are different from each other. In the thinning pattern 42 in the FIG. 7C and the thinning pattern 42 in FIG. 7G, gate signal lines to be scanned are the same and only polarities of voltages to be applied are different from each other. In the thinning pattern 42 in the FIG. 7D and the thinning pattern 42 in FIG. 7H, gate signal lines to be scanned are the same and only polarities of voltages to be applied are different from each other.

Therefore, the thinning pattern storage 23 may store only the thinning patterns shown in FIGS. 7A to 7D as the thinning pattern 42. In this case, the interlaced scanning controller 26 or the source controller 28 may determine the polarity of a voltage to be applied in the second shift control mode MD4 such that the polarity is opposite of the polarity of the voltage applied in the last sub-frame in the low-power control mode MD3.

Further, in the thinning pattern 43 in FIG. 8A and the thinning pattern 43 in FIG. 8B, gate signal lines to be scanned are the same and only polarities of voltages to be applied are different from each other. Therefore, the thinning pattern storage 23 may store only one of the thinning patterns as the thinning pattern 43, and use the thinning pattern by inverting the polarities alternately.

In FIG. 5, the number N of the gate signal lines is expressed by N=16. Further, in the basic control mode MD1, for example, in the frame FR2, a gate signal is progressively output to all of the 16 gate signal lines G1 to G16 to generate a frame image.

Moreover, in the low-power control mode MD3, for example, in the sub-frame SF7, a gate signal is output to the W gate signal lines (W=4 in FIG. 5) to generate a sub-frame image. Then, the generation of the sub-frame image is repeated by K times (K=4 in FIG. 5) in the sub-frames SF7 to SF10, and the gate signal is output to all of the 16 gate signal lines G1 to G16.

Furthermore, as can be seen from FIG. 5 and FIG. 6A, in the sub-frame SF3 in the first shift control mode MD2, a gate signal is output to the Z1 gate signal lines (Z1=12 in FIG. 5) to generate a sub-frame image. In other words, W<Z1<N. Further, as can be seen from FIG. 5 and FIG. 7D, in the sub-frame SF22 in the second shift control mode MD4, a gate signal is output to the Z2 gate signal lines (Z2=12 in FIG. 5) to generate a sub-frame image. In other words, W<Z2<N is established.

Figure 10:
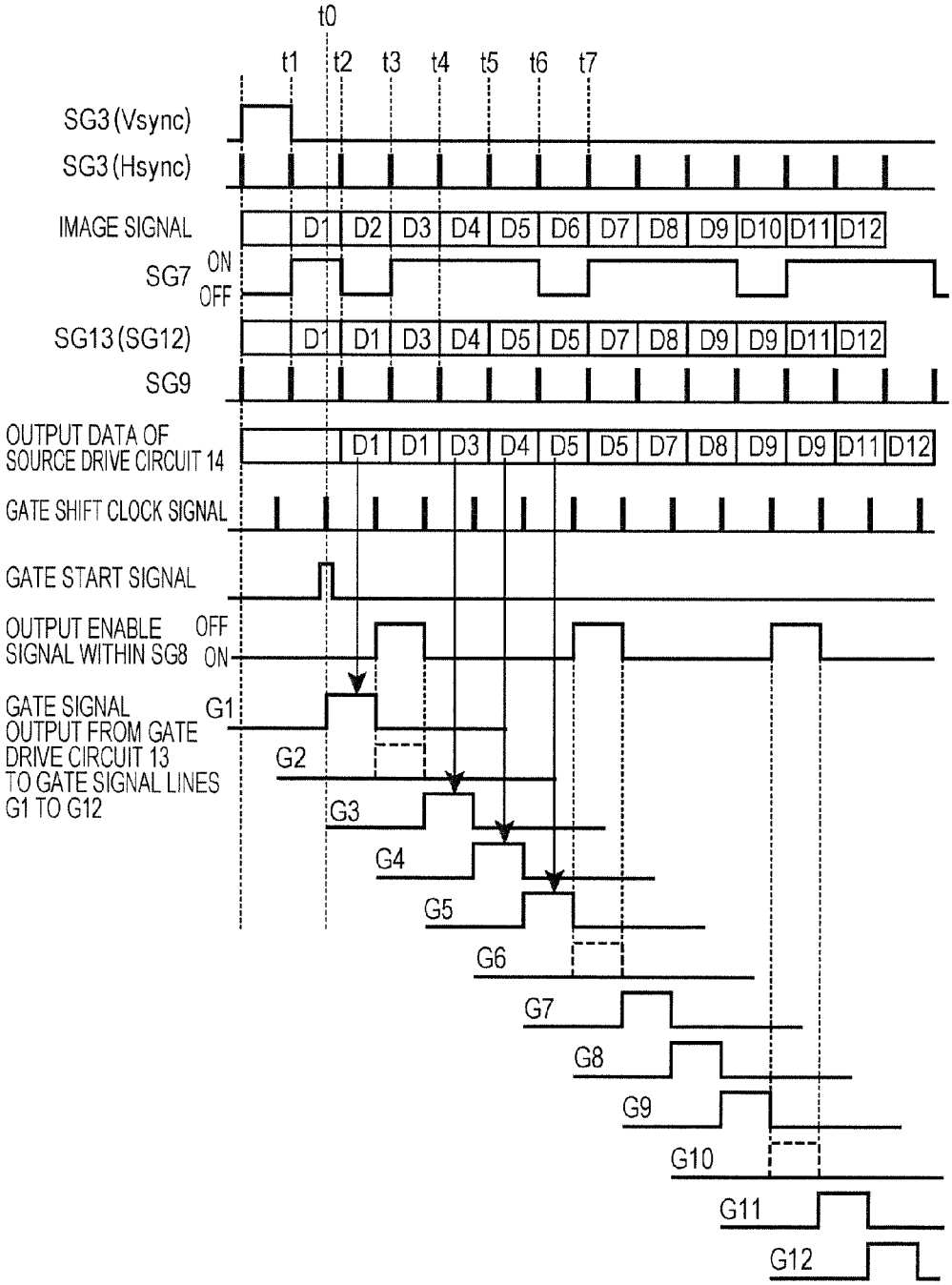
FIG. 10 is a timing chart schematically showing operations of the gate drive circuit and the source drive circuit in the sub-frame in FIG. 5 in which the control mode is the first shift control mode.

FIG. 10 is a timing chart schematically showing operations of the gate drive circuit and the source drive circuit in the sub-frame SF3 in FIG. 5 in which the control mode is the first shift control mode MD2. In FIG. 10, the gate signal lines G13 to G16 are not depicted. With reference to FIG. 2, FIG. 5, and FIG. 10, a description will be given of operations of the gate drive circuit 13 and the source drive circuit 14 in the sub-frame SF3 in FIG. 5 in which the control mode is the first shift control mode MD2.

First, signals shown in FIG. 10 will be described. The synchronizing signal generator 21 generates the synchronizing signal SG3 including the vertical synchronizing signal Vsync and the horizontal synchronizing signal Hsync. The synchronizing signal generator 21 outputs the generated synchronizing signal SG3 to the shift frame detector 22, the low-frequency frame generator 25, and the interlaced scanning controller 26.

In the sub-frame SF3 in FIG. 5, the thinning pattern 41 in the first shift control mode is input to the interlaced scanning controller 26 from the selector 24. Therefore, the interlaced scanning controller 26 generates the data enable signal SG7 that is turned off at timing corresponding to the gate signal lines G2, G6, G10, and G14. The interlaced scanning controller 26 outputs the generated data enable signal SG7 to the read controller 32 and the source controller 28.

When the data enable signal SG7 is turned off, the read controller 32 holds a DRAM read address. Accordingly, when the data enable signal SG7 is turned off, the read controller 32 outputs, as the image signal SG12, data that is the same as data output when an immediately previous data enable signal SG7 has been turned on. Therefore, at timing corresponding to the gate signal lines G2, G6, and G10 when the data enable signal SG7 is turned off, the read controller 32 outputs, as the image signal SG12, image signals D1, D5, and D9 corresponding to the gate signal lines G1, G5, and G9 to the selector 45. The selector 45 outputs, as the image signal SG13 to the source drive circuit 14, the data that has been input as the image signal SG12.

The source controller 28 outputs the latch timing signal SG9 to the source drive circuit 14. As described above, the latch timing signal SG9 is for controlling operational timing of the source drive circuit 14. The latch timing signal SG9 is output in synchronization with the horizontal synchronizing signal Hsync. The latch timing signal SG9 indicates a leading head of the data input to the source drive circuit 14. Specifically, the image signal SG13 is input to the source drive circuit 14 in synchronization with the latch timing signal SG9.

Further, the source drive circuit 14 outputs a voltage based on the image signal SG13 that has been input, to the source signal lines in synchronization with the latch timing signal SG9. Specifically, the source drive circuit 14 outputs the voltage based on the image signal SG13 that has been input in synchronization with the latch timing signal SG9, to the source signal lines in synchronization with the latch timing signal SG9 that comes next.

In this manner, when one latch timing signal SG9 is input to the source drive circuit 14, in synchronization with the input, the image signal SG13 is input to the source drive circuit 14, and the source drive circuit 14 outputs, to the source signal lines, the voltage based on the image signal SG13 that has been input in synchronization with the last latch timing signal SG9.

The interlaced scanning controller 26 generates the output enable signal SG6 whose content is the same as that of the data enable signal SG7, and outputs the generated output enable signal SG6 to the gate controller 27.

The gate controller 27 outputs a gate start signal after predetermined delay time from rising of the vertical synchronizing signal Vsync. The gate drive circuit 13 starts outputting a gate signal to the gate signal line G1 in synchronization with the gate start signal. The gate controller 27 outputs a gate shift clock signal with the same period as the horizontal synchronizing signal Hsync. The gate drive circuit 13 switches the gate signal line to which the gate signal is output every time the gate shift clock signal is input.

The gate controller 27 outputs a signal obtained by delaying the output enable signal SG6 which is input from the interlaced scanning controller 26 by a predetermined time as an output enable signal. In FIG. 10 (as well as in FIG. 14 and FIG. 17 that will be later referred), the output enable signal in the gate drive signal SG8 enables output of the gate signal from the gate drive circuit 13 at a low level, and masks output of the gate signal from the gate drive circuit 13 at a high level.

Next, a specific operation will be described. In FIG. 10, first, the vertical synchronizing signal Vsync is output and the horizontal synchronizing signal Hsync is output in synchronization with rising of the vertical synchronizing signal Vsync. In synchronization with the latch timing signal SG9 at time t1 after the vertical synchronizing signal Vsync is output, the image signal D1 (the image signal SG13) corresponding to the gate signal line G1 is input to the source drive circuit 14 from the selector 45. A voltage based on the image signal SG13, that is, a voltage corresponding to the image signal D1 is output from the source drive circuit 14 in synchronization with the latch timing signal SG9 at time t2 that comes next.

On the other hand, at time t0 between time t1 and time t2, a gate start signal is output. Specifically, the gate controller 27 outputs the gate start signal after delay time of a time period $(1+Tg)*H$ $(0 \leq Tg < 1)$ from the rising of the vertical synchronizing signal Vsync. The delay time is the same as that in the basic control mode MD1. In other words, in the basic control mode MD1, the gate controller 27 also outputs the gate start signal after the delay time of the time period $(1+Tg)*H$ from the rising of the vertical synchronizing signal Vsync.

At time t0, the output enable signal in the gate drive signal SG8 is turned on. Accordingly, a gate signal corresponding to the gate signal line G1 is output in synchronization with the gate start signal. Therefore, while the gate signal is output to the gate signal line G1, a voltage corresponding to the image signal D1 is output from the source drive circuit 14.

Normally, an image signal D2 corresponding to the gate signal line G2 should be output in synchronization with the horizontal synchronizing signal Hsync at time t2. However, at time t2, the data enable signal SG7 is turned off. Therefore, at the latch timing signal SG9 at time t2, the image signal D1 corresponding to the gate signal line G1 (the image signal SG13) is input to the source drive circuit 14 as at previous time t1.

In synchronization with the latch timing signal SG9 at time t3 that comes next, a voltage corresponding to the image signal D1 that has been input to the source drive circuit 14 in synchronization with the latch timing signal SG9 at previous time t2 is output to the source signal lines from the source drive circuit 14. However, as the output enable signal in the gate drive signal SG8 is turned off, a gate signal is not output to the gate signal line G2 from the gate drive circuit 13. Therefore, a voltage corresponding to the image signal D1 that has been output to the source signal lines from the source drive circuit 14 is not applied to the pixel electrodes.

On the other hand, at time t3, the data enable signal SG7 is turned on. Therefore, in synchronization with the latch timing signal SG9 at time t3, an image signal D3 corresponding to the gate signal line G3 (the image signal SG13) is input to the source drive circuit 14.

In synchronization with the latch timing signal SG9 at time t4 that comes next, a voltage corresponding to the image signal D3 that has been input to the source drive circuit 14 in synchronization with the latch timing signal SG9 at previous time t3 is output to the source signal lines from the source drive circuit 14. At this time, the output enable signal in the gate drive signal SG8 is turned on, and a gate signal is output to the gate signal line G3. Accordingly, a voltage corresponding to the image signal D3 that has been output to the source signal lines from the source drive circuit 14 is applied to the pixel electrodes.

On the other hand, at time t4, the data enable signal SG7 is turned on. Therefore, in synchronization with the latch timing signal SG9 at time t4, an image signal D4 corresponding to the gate signal line G4 (the image signal SG13) is input to the source drive circuit 14.

In synchronization with the latch timing signal SG9 at time t5 that comes next, a voltage corresponding to the image signal D4 that has been input to the source drive circuit 14 in synchronization with the latch timing signal SG9 at previous time t4 is output to the source signal lines from the source drive circuit 14. At this time, the output enable signal in the gate drive signal SG8 is turned on. Accordingly, a gate signal is output to the gate signal line G4. Therefore, a voltage corresponding to an image signal D4 that has been output to the source signal lines from the source drive circuit 14 is applied to the pixel electrodes.

On the other hand, at time t5, the data enable signal SG7 is turned on. Therefore, in synchronization with the latch timing signal SG9 at time t5, an image signal D5 corresponding to the gate signal line G5 (the image signal SG13) is input to the source drive circuit 14.

In synchronization with the latch timing signal SG9 at time t6 that comes next, a voltage corresponding to the image signal D5 that has been input to the source drive circuit 14 in synchronization with the latch timing signal SG9 at previous time t5 is output to the source signal lines from the source drive circuit 14. At this time, the output enable signal in the gate drive signal SG8 is turned on. Accordingly, a gate signal is output to the gate signal line G5. Therefore, a voltage corresponding to an image signal D5 that has been output to the source signal lines from the source drive circuit 14 is applied to the pixel electrodes.

On the other hand, normally, an image signal D6 corresponding to the gate signal line G6 should be output in synchronization with the horizontal synchronizing signal Hsync at time t6. However, at time t6, the data enable signal SG7 is turned off. Therefore, at the latch timing signal SG9 at time t6, the image signal D5 corresponding to the gate signal line G5 (the image signal SG13) is input to the source drive circuit 14 as at previous time t5.

In synchronization with the latch timing signal SG9 at time t7 that comes next, a voltage corresponding to the image signal D5 is output to the source signal lines from the source drive circuit 14. However, as the output enable signal in the gate drive signal SG8 is turned off, a gate signal is not output to the gate signal line G6 from the gate drive circuit 13. Therefore, a voltage corresponding to the image signal D5 that has been output to the source signal lines from the source drive circuit 14 is not applied to the pixel electrodes.

Then, the gate drive circuit 13 and the source drive circuit 14 operate in the same manner, and a voltage is applied to the pixel electrodes corresponding to the gate signal lines other than the gate signal lines G2, G6, G10, and G14, the operation in the sub-frame SF3 in FIG. 5 in which the control mode is the first shift control mode MD2 is performed. In FIG. 10, gate signals which are not output to the gate signal lines G2, G3, and G10 are indicated by broken lines.

Here, in the first shift control mode MD2 shown in FIG. 10, a description will be given of a relation between an interval of scanning of the gate signal lines and a voltage output from the source drive circuit 14.

In the first shift control mode MD2 shown in FIG. 10, the gate drive circuit 13 first scans the first gate signal line G1, and then the third gate signal line G3, for example. In this case, the data controller 30 causes the source drive circuit 14 to output a voltage corresponding to the image signal D1 which is output from the source drive circuit 14 in response to the scanning of the first gate signal line G1 continuously for a period 2H. Specifically, for a horizontal scanning period 1H corresponding to the gate signal line G2 that is not scanned, a voltage corresponding to the image signal D1 output corresponding to the gate signal line G1 is continuously output.

Further, the gate drive circuit 13 scans, for example, the third gate signal line G3, and then the fourth gate signal line G4. In this case, the data controller 30 causes the source drive circuit 14 to output a voltage corresponding to the image signal D3 which is output from the source drive circuit 14 in response to the scanning of the third gate signal line G3 continuously for one horizontal scanning period 1H.

Further, the gate drive circuit 13 scans, for example, the fourth gate signal line G4, and then the fifth gate signal line G5. In this case, the data controller 30 causes the source drive circuit 14 to output a voltage corresponding to the image signal D4 which is output from the source drive circuit 14 in response to the scanning of the third gate signal line G4 continuously for one horizontal scanning period 1H.

Further, the gate drive circuit 13 scans, for example, the fifth gate signal line G5, and then the seventh gate signal line G7. In this case, the data controller 30 causes the source drive circuit 14 to output a voltage corresponding to the image signal D5 which is output from the source drive circuit 14 in response to the scanning of the fifth gate signal line G5 continuously for one horizontal scanning period 1H. Specifically, for the horizontal scanning period 1H corresponding to the gate signal line G6 that is not scanned, a voltage corresponding to the image signal D5 output corresponding to the gate signal line G5 is continuously output.

Hereinafter, this also applies to a case of the seventh gate signal line G7 and thereafter. Specifically, in the first shift control mode MD2, in a case in which the gate drive circuit 13 first scans a U-th gate signal line out of the N gate signal lines (U is an integer that is not less than 1 and less than N), and then a (U+V)-th gate signal line (V is an integer that is not less than 1 and not greater than K), the data controller 30 causes the source drive circuit 14 to output a voltage output from the source drive circuit 14 in response to scanning of the U-th gate signal line for a period V*H (V times of the horizontal scanning period 1H).

As described above, in the first embodiment, the control mode shifts from the basic control mode MD1 to the low-power control mode MD3 by way of the first shift control mode MD2, and returns to the basic control mode MD1 from the low-power control mode MD3 by way of the second shift control mode MD4, and thus continuous application of voltages of the same polarity to the pixel electrodes is avoided. Therefore, according to the first embodiment, it is possible to prevent image qualities from deteriorating too much due to flickers produced by voltages of the same polarity being continuously applied to the pixel electrodes. Further, as the control mode shifts by way of the first shift control mode MD2 and the second shift control mode MD4, it is possible to perform the shift of the control mode smoothly.

Moreover, in the first embodiment, the read controller 32 holds the DRAM read address when the data enable signal SG7 is turned off. Accordingly, data that is the same as data when the data enable signal SG7 is turned on immediately before is output as the image signal SG13 output from the selector 45 to the source drive circuit 14. Therefore, the source drive circuit 14 outputs a voltage that is the same as a voltage immediately previously output. As a result, as compared to a case in which a different voltage is output, discharge and charge may not be excessively produced in the source drive circuit 14. Therefore, according to the first embodiment, it is possible to prevent power consumption from increasing.

Further, in the first embodiment, a voltage is output from the source drive circuit 14 every time the latch timing signal SG9 is output. However, at timing at which gate signals are output to the gate signal lines G2, G6, and G10, the output enable signal in the gate drive signal SG8 is turned off, and gate signals are not output from the gate drive circuit 13 to the gate signal lines G2, G6, and G10. Therefore, it is possible to perform an output operation of a gate signal to the gate signal lines G1 to G16 corresponding to the thinning pattern 41 stored in the thinning pattern storage 23 even with a configuration in which the latch timing signal SG9 is output every time the horizontal synchronizing signal Hsync is output.

As can be seen from comparison between FIGS. 6A and 6B and FIGS. 7B and 7F, in the first embodiment, the gate signal lines to be scanned are the same in both examples. Therefore, regardless of the timing at which the standby mode signal SG2 is turned off, the thinning pattern 41 may be used in common when the second shift control mode MD4 is taken as the control mode in a sub-frame corresponding to the sub-frames SF16 and SF20 (that is, a second sub-frame out of the four successive sub-frames). Therefore, in this case, the thinning pattern storage 23 is not required to store the thinning pattern 42. As a result, it is possible to reduce a memory capacity required for the thinning pattern storage 23.

In the first embodiment, the control mode returns to the basic control mode from the low-power control mode by way of the second shift control mode. Alternatively, when the control mode returns to the basic control mode from the low-power control mode, the control mode may directly return to the basic control mode from the low-power control mode without going through the second shift control mode. With this, it is possible to display a returned moving picture on the liquid crystal display panel 12 more quickly.

In the first embodiment, the first shift control mode MD2 is used in one sub-frame. Alternatively, the first shift control mode MD2 may be used in a plurality of sub-frames. Similarly, while the second shift control mode MD4 is used in one sub-frame in the first embodiment, the second shift control mode MD4 may be alternatively used in a plurality of sub-frames.

Second Embodiment

Figure 11:
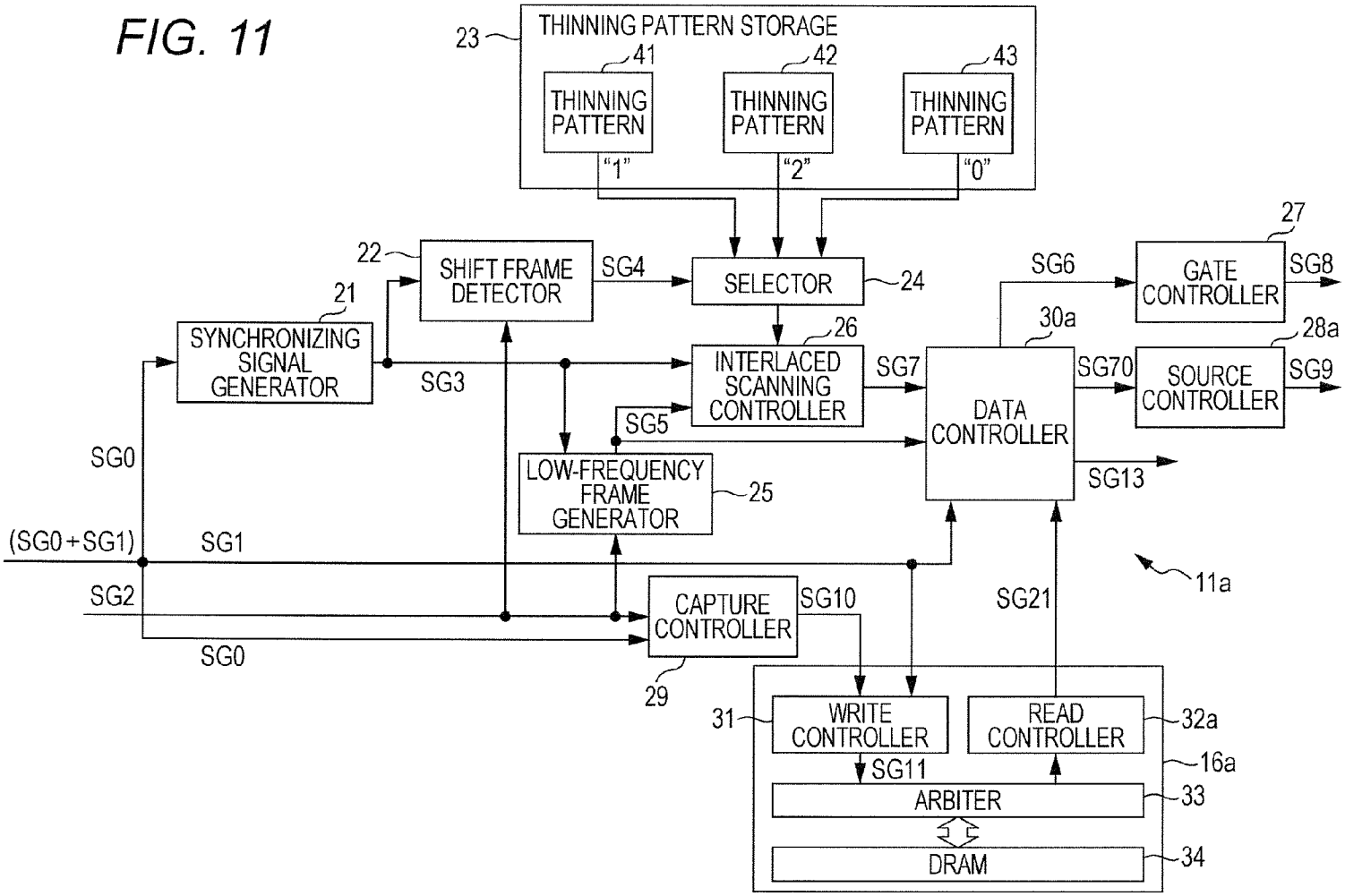
FIG. 11 is a block diagram showing a configuration of a controller and an image memory portion of a display device according to a second embodiment.
Figure 12:
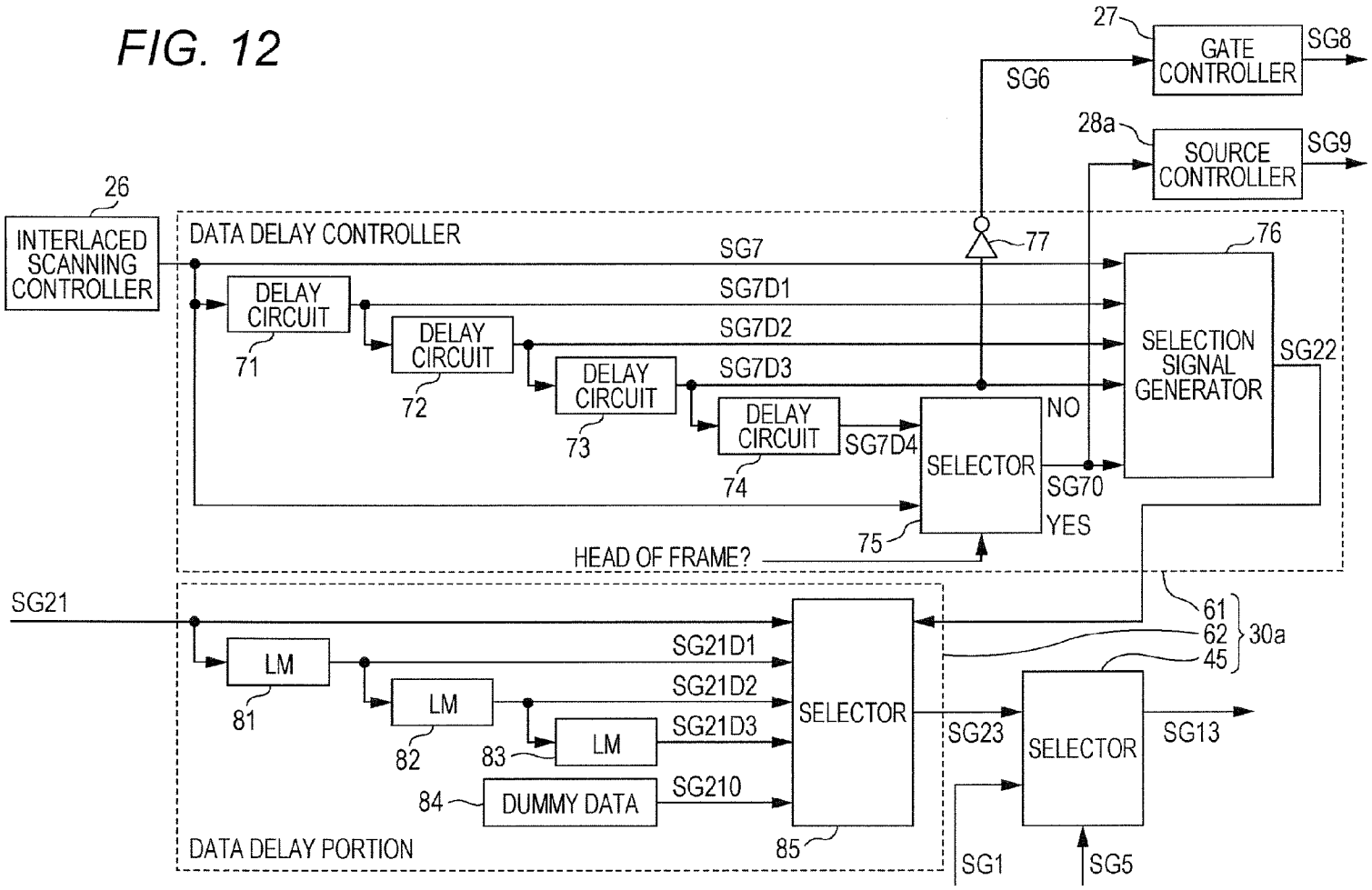
FIG. 12 is a block diagram showing a configuration of a data controller shown in FIG. 11.

FIG. 11 is a block diagram showing a configuration of a controller and an image memory portion of a display device according to a second embodiment. FIG. 12 is a block diagram showing a configuration of a data controller shown in FIG. 11. FIG. 13 is a truth table of a selector in a data delay portion shown in FIG. 12. In the second embodiment, similar components as in the first embodiment are denoted by similar reference numerals.

The configuration of the display device according to the second embodiment is substantially the same as the display device 1 according to the first embodiment shown in FIG. 1. The display device according to the second embodiment includes a controller 11*a* and an image memory portion 16*a* respectively in place of the controller 11 and the image memory portion 16 of the display device 1 according to the first embodiment. In the second embodiment, similarly to the first embodiment, a frame frequency F1 in the basic control mode is expressed by F1=60 Hz, and a frame frequency F2 in the low-power control mode is expressed by F2=15 Hz. Hereinafter, the second embodiment will be described focusing on differences from the first embodiment.

Referring to FIG. 11, the controller 11*a* includes the synchronizing signal generator 21, the shift frame detector 22, the thinning pattern storage 23, the selector 24, the low-frequency frame generator 25, the interlaced scanning controller 26, the gate controller 27, a source controller 28*a*, the capture controller 29, and a data controller 30*a*. The image memory portion 16*a* includes the write controller 31, the read controller 32*a*, the arbiter 33, and the DRAM 34.

Referring to FIG. 12, the data controller 30*a* includes the selector 45, a data delay controller 61, and a data delay portion 62. The data delay controller 61 includes a delay circuit 71 to 74, a selector 75, a selection signal generator 76, and an inverter 77. The data delay portion 62 includes line memories (LMs) 81 to 83, a dummy data generator 84, and a selector 85.

Unlike the first embodiment, the interlaced scanning controller 26 does not output the data enable signal SG7 to the read controller 32*a*. As a result, the read controller 32*a* outputs an image signal SG21 corresponding to the gate signal line to the data delay portion 62 of the data controller 30*a*.

The interlaced scanning controller 26 outputs the generated data enable signal SG7 to the delay circuit 71, the selector 75, and the selection signal generator 76 of the data delay controller 61. The delay circuit 71 delays the data enable signal SG7 by one horizontal scanning period (1H), and outputs a delayed data enable signal SG7D1 to the delay circuit 72 and the selection signal generator 76. The delay circuit 72 delays the data enable signal SG7D1 further by 1H, and outputs a delayed data enable signal SG7D2 to the delay circuit 73 and the selection signal generator 76.

The delay circuit 73 delays the data enable signal SG7D2 further by 1H, and outputs a delayed data enable signal SG7D3 to the delay circuit 74 and the selection signal generator 76. Further, the delay circuit 73 outputs the data enable signal SG7D3 to the gate controller 27 via the inverter 77. The delay circuit 74 delays the data enable signal SG7D3 further by 1H, and outputs a delayed data enable signal SG7D4 to the selector 75.

The selector 75 outputs the data enable signal SG7 as the data enable signal SG70 to the selection signal generator 76 at the head of a frame, that is, immediately after the vertical synchronizing signal Vsync. If not at the head of the frame, the selector 75 outputs the data enable signal SG7D4 as the data enable signal SG70 to the selection signal generator 76. The selector 75 also outputs the data enable signal SG70 to the source controller 28*a*.

The source controller 28*a* outputs the latch timing signal SG9 to the source drive circuit 14 in synchronization with the horizontal synchronizing signal Hsync when the data enable signal SG70 is turned on. The source controller 28*a* does not output the latch timing signal SG9 to the source drive circuit 14 when the data enable signal SG70 is turned off. In this manner, unlike the source controller 28 of the first embodiment, an interval at which the latch timing signal SG9 is output from the source controller 28*a* of the second embodiment is not a constant one-horizontal scanning period (1H).

The selection signal generator 76 outputs, as a selection signal SG22 to the selector 85, information indicating whether each of the data enable signals SG7, SG7D1 to SG7D3, and SG70 that are input is enabled or disabled.

The read controller 32*a* outputs the image signal SG21 that has been read to the line memory 81 and the selector 85 of the data delay portion 62. The line memory 81 delays the image signal SG21 for one line by one horizontal scanning period (1H), and outputs a delayed image signal SG21D1 to the line memory 82 and the selector 85.

The line memory 82 delays the image signal SG21D1 for one line by further 1H, and outputs a delayed image signal SG21D2 to the line memory 83 and the selector 85. The line memory 83 delays the image signal SG21D2 for one line by further 1H, and outputs a delayed image signal SG21D3 to the selector 85. The dummy data generator 84 outputs an image signal SG210 of 0 Gray levels as dummy data to the selector 85.

The selector 85 outputs, out of the input image signals, an image signal selected based on the truth table shown in FIG. 13 as an image signal SG23 to the selector 45. Specifically, the selector 85 outputs the image signal SG21 as the image signal SG23 to the selector 45 when the data enable signals SG7 and SG70 are enabled and the data enable signals SG7D1 to SG7D3 are disabled.

Further, the selector 85 outputs the image signal SG21D1 as the image signal SG23 to the selector 45 when the data enable signals SG7D1 and SG70 are enabled and the data enable signals SG7D2 and SG7D3 are disabled. Moreover, the selector 85 outputs the image signal SG21D2 as the image signal SG23 to the selector 45 when the data enable signal SG7D2, SG70 are enabled and the data enable signal SG7D3 are disabled.

Furthermore, the selector 85 outputs the image signal SG21D3 as the image signal SG23 to the selector 45 when the data enable signals SG7D3 and SG70 are enabled. In addition, the selector 85 outputs the image signal SG210 as the image signal SG23 to the selector 45 when a combination of the data enable signals is other than the above.

In this embodiment, the liquid crystal display panel 12 corresponds to one example of the display portion, the gate drive circuit 13 corresponds to one example of the gate driver, the source drive circuit 14 corresponds to one example of the source driver, the thinning pattern storage 23 corresponds to one example of the pattern storage, and the DRAM 34 corresponds to one example of the image storage.

Figure 14:
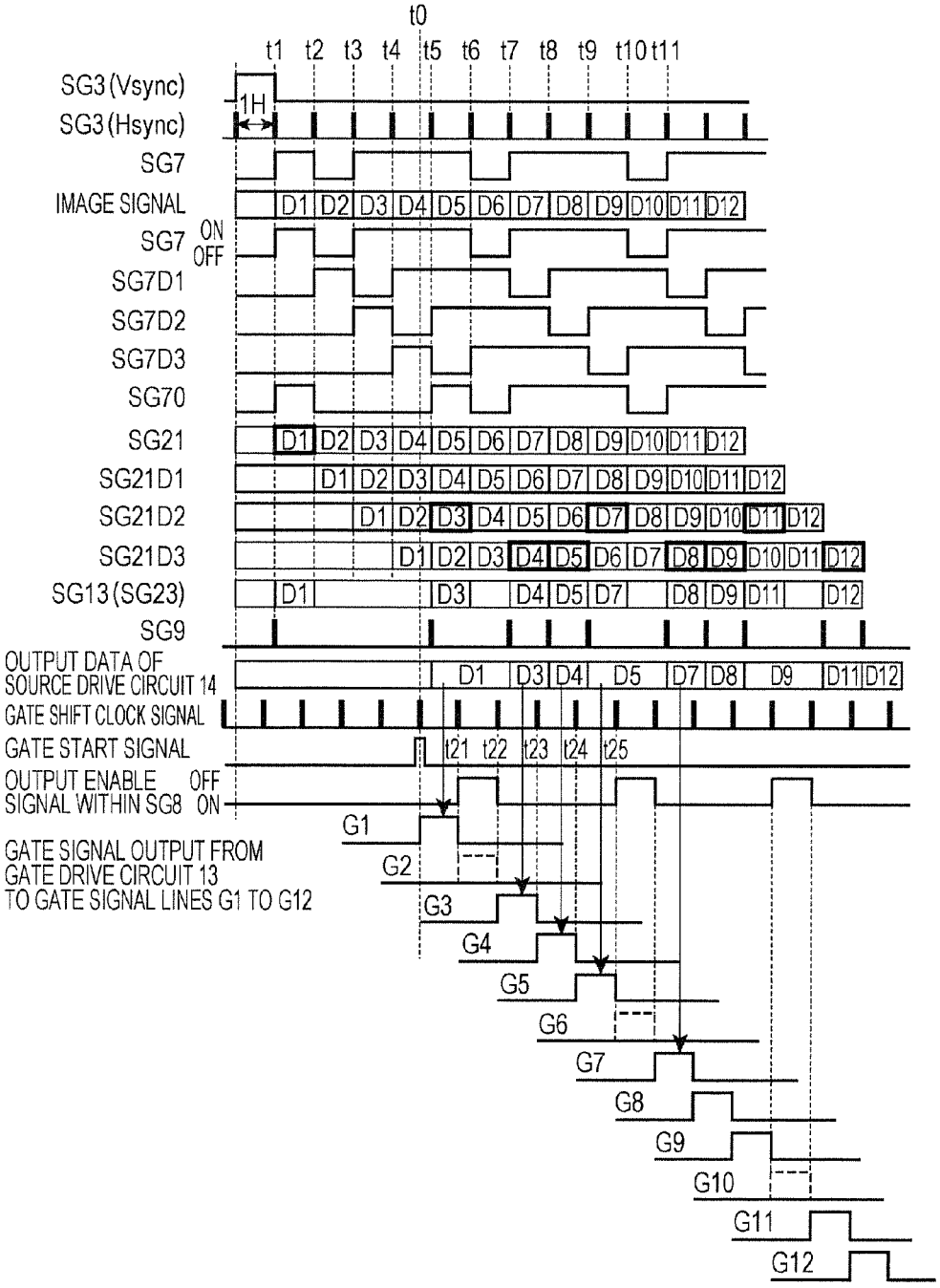
FIG. 14 is a timing chart schematically showing operations of the gate drive circuit and the source drive circuit in the sub-frame in FIG. 5 in which the control mode is the first shift control mode according to the second embodiment.

FIG. 14 is a timing chart schematically showing operations of the gate drive circuit and the source drive circuit in the sub-frame SF3 in FIG. 5 in which the control mode is the first shift control mode MD2 according to the second embodiment. In FIG. 14, the gate signal lines G13 to G16 are not depicted similarly to FIG. 10. With reference to FIG. 11 through FIG. 14, a description will be given of operations of the gate drive circuit 13 and the source drive circuit 14 in the sub-frame SF3 in FIG. 5 in which the control mode is the first shift control mode MD2 according to the second embodiment.

In FIG. 14, first, the vertical synchronizing signal Vsync is output and the horizontal synchronizing signal Hsync is output in synchronization with rising of the vertical synchronizing signal Vsync. As time t1 after the vertical synchronizing signal Vsync has been output corresponds to the head of the frame in the first shift control mode, the selector 75 outputs the data enable signal SG7 as the data enable signal SG70 in synchronization with the horizontal synchronizing signal Hsync at time t1. Therefore, the data enable signals SG7 and SG70 are enabled, and the data enable signals SG7D1 to SG7D3 are disabled.

Accordingly, from the truth table in FIG. 13, the selector 85 outputs the image signal SG21 as the image signal SG23. As a result, the image signal D1 corresponding to the gate signal line G1 (the image signal SG21) is input as the image signal SG13 to the source drive circuit 14 in synchronization with the latch timing signal SG9 at time t1.

For the horizontal synchronizing signal Hsync at each of succeeding time t2 to t4, the data enable signal SG70 is disabled. Accordingly, from the truth table in FIG. 13, the selector 85 outputs the image signal SG210 of 0 Gray level as the image signal SG23 at each time.

Further, at time t2 to t4, the latch timing signal SG9 is not output from the source controller 28*a* as the data enable signal SG70 is disabled. Therefore, during this period, an image signal is not input to the source drive circuit 14.

For the horizontal synchronizing signal Hsync at succeeding time t5, the data enable signals SG7D2 and SG70 are enabled and the data enable signal SG7D3 is disabled. Accordingly, from the truth table in FIG. 13, the selector 85 outputs the image signal SG21D2 as the image signal SG23.

Further, at time t5, as the data enable signal SG70 is turned on, the source controller 28*a* outputs the latch timing signal SG9 to the source drive circuit 14 in synchronization with the horizontal synchronizing signal Hsync. Therefore, in synchronization with the latch timing signal SG9 at time t5, the image signal SG21D2 is output as the image signal SG13 from the selector 45 to the source drive circuit 14.

Moreover, for the latch timing signal SG9 at time t5, a voltage based on the image signal SG13 that has been input to the source drive circuit 14 in synchronization with the latch timing signal SG9 at previous time t1, that is, a voltage corresponding to the image signal D1, is output from the source drive circuit 14 to the source signal lines.

On the other hand, a gate start signal is output at time t0 between time t4 and time t5. Specifically, the gate controller 27 outputs the gate start signal after delay time of a time period (4+Tg)*H ($0 \leq Tg < 1$) from the rising of the vertical synchronizing signal Vsync. As described above, in the basic control mode MD1, the gate controller 27 outputs the gate start signal after the delay time of the time period (4+Tg)*H from the rising of the vertical synchronizing signal Vsync.

Therefore, in the second embodiment, a difference between timing for outputting a gate start signal in the basic control mode MD1 and timing for outputting a gate start signal in the low-frequency control mode MD2 is expressed as follows.

$$(4+Tg)*H-(1+Tg)*H=3H$$

Here, K=4 in FIG. 5 as described above. Therefore, in the second embodiment, the gate controller 27 delays timing for outputting a gate start signal by a time period (K−1)*H in the first shift control mode MD2 as compared to the case in the basic control mode MD 1.

At this time, the output enable signal in the gate drive signal SG8 is turned on. Accordingly, a gate signal is output to the gate signal line G1 in synchronization with a gate start signal. Therefore, a voltage corresponding to the image signal D1 that has been output to the source signal lines from the source drive circuit 14 at time t5 is applied to the pixel electrodes.

For the horizontal synchronizing signal Hsync at succeeding time t6, the data enable signal SG70 is disabled. Accordingly, from the truth table in FIG. 13, the selector 85 outputs the image signal SG210 of 0 Gray level as the image signal SG23.

Further, at time t6, the latch timing signal SG9 is not output from the source controller 28*a* as the data enable signal SG70 is disabled. Therefore, at time t6, an image signal is not input to the source drive circuit 14. In addition, at time t6, as a voltage is not newly output from the source drive circuit 14 to the source signal lines, the voltage corresponding to the previous image signal D1 continues.

On the other hand, for a gate shift clock signal at time t21 succeeding the gate start signal, the output enable signal in the gate drive signal SG8 is turned off. Accordingly, a gate signal is masked and not output to the gate signal line G2. As a result, a voltage is not applied to the pixel electrodes corresponding to the gate signal line G2 from the source drive circuit 14.

For the horizontal synchronizing signal Hsync at succeeding time t7, the data enable signals SG7D3 and SG70 are enabled. Accordingly, from the truth table in FIG. 13, the selector 85 outputs the image signal SG21D3, that is, the image signal D4 corresponding to the gate signal line G4, as the image signal SG23.

Further, at time t7, as the data enable signal SG70 is turned on, the source controller 28*a* outputs the latch timing signal SG9 to the source drive circuit 14 in synchronization with the horizontal synchronizing signal Hsync. Therefore, in synchronization with the latch timing signal SG9 at time t7, the image signal SG21D3, that is, the image signal D4 corresponding to the gate signal line G4, is output as the image signal SG13 from the selector 45 to the source drive circuit 14.

Moreover, for the latch timing signal SG9 at time t7, a voltage based on the image signal SG13 that has been input to the source drive circuit 14 in synchronization with the latch timing signal SG9 at previous time t5, that is, a voltage corresponding to the image signal D3 is output from the source drive circuit 14 to the source signal lines.

On the other hand, for a gate shift clock signal at time t22, the output enable signal in the gate drive signal SG8 is turned on. Accordingly, a gate signal is output to the gate signal line G3. As a result, a voltage corresponding to the image signal D3 which is output from the source drive circuit 14 is applied to the pixel electrodes corresponding to the gate signal line G3.

For the horizontal synchronizing signal Hsync at succeeding time t8, the data enable signals SG7D3 and SG70 are enabled similarly to time t7. Accordingly, from the truth table in FIG. 13, the selector 85 outputs the image signal SG21D3 that is, the image signal D5 corresponding to the gate signal line G5, as the image signal SG23.

Further, at time t8, as the data enable signal SG70 is turned on, the source controller 28*a* outputs the latch timing signal SG9 to the source drive circuit 14. Therefore, in synchronization with the latch timing signal SG9 at time t8, the image signal SG21D3, that is, the image signal D5 corresponding to the gate signal line G5, is output as the image signal SG13 from the selector 45 to the source drive circuit 14.

Moreover, for the latch timing signal SG9 at time t8, a voltage based on the image signal SG13 that has been input to the source drive circuit 14 in synchronization with the latch timing signal SG9 at previous time t7, that is, a voltage corresponding to the image signal D4 is output from the source drive circuit 14 to the source signal lines.

On the other hand, for a gate shift clock signal at time t23, the output enable signal in the gate drive signal SG8 is turned on. Accordingly, a gate signal is output to the gate signal line G3. As a result, a voltage corresponding to the image signal D4 which is output from the source drive circuit 14 is applied to the pixel electrodes corresponding to the gate signal line G4.

For the horizontal synchronizing signal Hsync at succeeding time t9, the data enable signals SG7D2 and SG70 are enabled and the data enable signal. SG7D3 is disabled. Accordingly, from the truth table in FIG. 13, the selector 85 outputs the image signal SG21D2, that is, an image signal corresponding to the gate signal line G7, as the image signal SG23.

Further, at time t9, as the data enable signal SG70 is turned on, the source controller 28*a* outputs the latch timing signal SG9 to the source drive circuit 14. Therefore, in synchronization with the latch timing signal SG9 at time t9, the image signal SG21D2, that is, the image signal D7 corresponding to the gate signal line G7, is output as the image signal SG13 from the selector 45 to the source drive circuit 14.

Further, for the latch timing signal SG9 at time t9, a voltage based on the image signal SG13 that has been input to the source drive circuit 14 in synchronization with the latch timing signal SG9 at previous time t8, that is, a voltage corresponding to the image signal D5, is output from the source drive circuit 14 to the source signal lines.

On the other hand, for a gate shift clock signal at time t24, the output enable signal in the gate drive signal SG8 is turned on. Accordingly, a gate signal is output to the gate signal line G5. As a result, a voltage corresponding to the image signal D5 which is output from the source drive circuit 14 is applied to the pixel electrodes corresponding to the gate signal line G5.

For the horizontal synchronizing signal Hsync at succeeding time t10, the data enable signal SG70 is disabled. Accordingly, from the truth table in FIG. 13, the selector 85 outputs the image signal SG210 of 0 Gray level as the image signal SG23.

Further, at time t10, the latch timing signal SG9 is not output from the source controller 28*a* as the data enable signal. SG70 is disabled. Therefore, at time t10, an image signal is not input to the source drive circuit 14. In addition, at time t10, as a voltage is not newly output from the source drive circuit 14 to the source signal lines, the voltage corresponding to the previous image signal D5 continues.

On the other hand, for a gate shift clock signal at time t25, the output enable signal in the gate drive signal SG8 is turned off. Accordingly, a gate signal is masked and not output to the gate signal line G6. As a result, a voltage is not applied to the pixel electrodes corresponding to the gate signal line G6 from the source drive circuit 14.

Then, the gate drive circuit 13 and the source drive circuit 14 operate in the same manner, and a voltage is applied to the pixel electrodes corresponding to the gate signal lines other than the gate signal lines G2, G6, G10, and G14, so that the operation in the sub-frame SF3 in FIG. 5 in which the control mode is the first shift control mode MD2 is performed. In FIG. 14, gate signals which are not output to the gate signal lines G2, G3, and G10 are indicated by broken lines.

In the second embodiment, similarly to the first embodiment, the frame frequency F1 in the basic control mode MD1 is expressed by F1=60 Hz, and the frame frequency F2 in the low-power control mode MD3 is expressed by F2=15 Hz. Therefore, in the second embodiment, similarly to the first embodiment, K=F1/F2=4 is established.

Further, also in the second embodiment, similarly to the first embodiment, the number N of the gate signal lines is expressed by N=16. Further, within a certain time period (in the second embodiment, similarly to the first embodiment, the vertical scanning period from the vertical synchronizing signal Vsync to the next vertical synchronizing signal Vsync) in the basic control mode MD1, a gate signal is progressively output to all of the 16 gate signal lines G1 to G16 to generate a frame image.

Therefore, also in the second embodiment, similarly to the first embodiment, in a certain time period in the low-power control mode MD3, a gate signal is output to the W gate signal lines (in the second embodiment, W=4, similarly to the first embodiment) to generate a sub-frame image. Then, the generation of the sub-frame image is repeated by K times (in the second embodiment, K=4, similarly to the first embodiment), and the gate signal is output to all of the 16 gate signal lines G1 to G16.

Further, also in the second embodiment, similarly to the first embodiment, in the sub-frame SF3 in the first shift control mode MD2, a gate signal is output to the Z1 gate signal lines (in the second embodiment, Z1=12, similarly to the first embodiment) within a certain time period to generate a sub-frame image. In other words, W<Z1<N is established.

Here, in the first shift control mode MD2 shown in FIG. 14, a description will be given of a relation between an interval between scan target signal lines, and the number of lines to be delayed for the image signal SG21 by the data delay portion 62. Gate signal lines to which a gate signal is output from the gate drive circuit 13 are defined as the scan target signal lines.

In the first shift control mode in FIG. 14, the gate signal line G3, for example, is a scan target signal line that is being selected. Here, the gate signal line G2 is not selected as a scan target signal line as described above. Accordingly, the gate signal line G3 that is the selected scan target signal line is an L-th line from the gate signal line G1 that is a previous scan target signal line (L=2 in FIG. 14). Therefore, the image signal SG21D2 obtained by delaying the image signal SG21 by (K−L)=2 lines (the image signal D3) is input as the image signal SG13 corresponding to the gate signal line G3 from the selector 45 to the source drive circuit 14.

In the first shift control mode in FIG. 14, the gate signal line G4, for example, is a scan target signal line that is being selected. Accordingly, the gate signal line G4 that is the selected scan target signal line is an L-th line from the gate signal line G3 that is a previous scan target signal line (L=1 in FIG. 14). Therefore, the image signal SG21D3 obtained by delaying the image signal SG21 by (K−L)=3 lines (the image signal D4) is input as the image signal SG13 corresponding to the gate signal line G4 from the selector 45 to the source drive circuit 14.

In the first shift control mode in FIG. 14, the gate signal line G5, for example, is a scan target signal line that is being selected. Accordingly, the gate signal line G5 that is the selected scan target signal line is an L-th line from the gate signal line G4 that is a previous scan target signal line (L=1 in FIG. 14). Therefore, the image signal SG21D3 obtained by delaying the image signal SG21 by (K−L)=3 lines (the image signal D5) is input as the image signal SG13 corresponding to the gate signal line G5 from the selector 45 to the source drive circuit 14.

In the first shift control mode in FIG. 14, the gate signal line G7, for example, is a scan target signal line that is being selected. Here, the gate signal line G6 is not selected as a scan target signal line as described above. Accordingly, the gate signal line G7 that is the selected scan target signal line is an L-th line from the gate signal line G5 that is a previous scan target signal line (L=2 in FIG. 14). Therefore, the image signal SG21D2 obtained by delaying the image signal SG21 by (K−L)=2 lines (the image signal D7) is input as the image signal SG13 corresponding to the gate signal line G7 from the selector 45 to the source drive circuit 14.

This also applies to a case in which the scan target signal line is the gate signal line G8 and thereafter. Specifically, in the first shift control mode MD2, if the selected scan target signal line is the L-th line from the previous scan target signal line (L is an integer that is not less than 1 and not greater than K), the data controller 30*a* delays an image signal corresponding to the selected scan target signal line by (K−L) lines, and outputs the delayed image signal to the source drive circuit 14.

Next, in the first shift control mode MD2 shown in FIG. 14, a description will be given of a relation between an interval of the latch timing signal SG9, a gate signal line corresponding to the image signal input to the source drive circuit 14 in synchronization with the latch timing signal, and a gate signal line corresponding to a voltage output from the source drive circuit 14 in synchronization with the latch timing signal.

In the first shift control mode shown in FIG. 14, the source controller 28*a* changes the interval of the latch timing signal SG9 to be input to the source drive circuit 14 according to the interval between lines of the scanning for outputting a gate signal to the gate signal lines within a range of a period (1 to K)*H, that is, a period (1 to 4)*H for this case.

Here, I(J) is a number of the gate signal line, counted in a sub-scanning direction, corresponding to an image signal input to the source drive circuit 14 in synchronization with the latch timing signal SG9 that comes J-th from the vertical synchronizing signal Vsync. Further, O(J) is a number of the gate signal line, counted in a sub-scanning direction, corresponding to a voltage output from the source drive circuit 14 in synchronization with the latch timing signal SG9 that comes J-th from the vertical synchronizing signal Vsync.

An interval between the latch timing signal SG9 that comes second from the vertical synchronizing signal Vsync (time t5) and the latch timing signal SG9 that comes third from the vertical synchronizing signal. Vsync (time t7) is a period P*H (P=2 in FIG. 14). On the other hand, a gate signal line I(2) corresponding to the image signal SG13 input to the source drive circuit 14 in synchronization with the second latch timing signal SG9 (the image signal D3) is the gate signal line G3. Further, a gate signal line O(2) corresponding to the voltage output from the source drive circuit 14 in synchronization with the second latch timing signal SG9 (the image signal D1) is the gate signal line G1. Therefore, a relation of I(2)=O(2)+2 is established.

An interval between the latch timing signal SG9 that comes third from the vertical synchronizing signal Vsync (time t7) and the latch timing signal SG9 that comes fourth from the vertical synchronizing signal Vsync (time t8) is a period P*H (P=1 in FIG. 14). On the other hand, a gate signal line I(3) corresponding to the image signal SG13 input to the source drive circuit 14 in synchronization with the third latch timing signal SG9 (the image signal D4) is the gate signal line G4. Further, a gate signal line O(3) corresponding to the voltage output from the source drive circuit 14 in synchronization with the third latch timing signal SG9

(the image signal D3) is the gate signal line G3. Therefore, a relation of I(3)=O(3)+1 is established.

An interval between the latch timing signal SG9 that comes fourth from the vertical synchronizing signal Vsync (time t8) and the latch timing signal SG9 that comes fifth from the vertical synchronizing signal Vsync (time t9) is a period P*H (P=1 in FIG. 14). On the other hand, a gate signal line I(4) corresponding to the image signal SG13 input to the source drive circuit 14 in synchronization with the fourth latch timing signal SG9 (the image signal D5) is the gate signal line G5. Further, a gate signal line O(4) corresponding to the voltage output from the source drive circuit 14 in synchronization with the fourth latch timing signal SG9 (the image signal D4) is the gate signal line G4. Therefore, a relation of I(4)=O(4)+1 is established.

An interval between the latch timing signal SG9 that comes fifth from the vertical synchronizing signal Vsync (time t9) and the latch timing signal SG9 that comes sixth from the vertical synchronizing signal Vsync (time t11) is a period P*H (P=2 in FIG. 14). On the other hand, a gate signal line I(5) corresponding to the image signal SG13 input to the source drive circuit 14 in synchronization with the fifth latch timing signal SG9 (the image signal D7) is the gate signal line G7. Further, a gate signal line O(5) corresponding to the voltage output from the source drive circuit 14 in synchronization with the fifth latch timing signal SG9 (the image signal D5) is the gate signal line G5. Therefore, a relation of I(5)=O(5)+2 is established.

This also applies to a case in which the sixth latch timing signal SG9 and thereafter. Specifically, in the first shift control mode MD2, the data controller 30*a* changes the interval of the latch timing signal SG9 to be input to the source drive circuit 14 within the range of the period (1 to K)*H according to the interval between lines of the scanning for outputting a gate signal to the gate signal lines. Then, a relation of I(J)=O(J)+P is established when an interval between the J-th latch timing signal SG9 and the (J+1)-th latch timing signal SG9 from the vertical synchronizing signal Vsync (J is an integer that is not less than 2) is the period P*H (P is an integer that is not less than 1 and not greater than K).

Next, in the first shift control mode MD2 shown in FIG. 14, a description will be given of a relation between an interval of scanning of the gate signal lines and a voltage (image signal) output from the source drive circuit 14.

In the first shift control mode shown in FIG. 14, the gate drive circuit 13 first scans the first gate signal line G1, and then the third gate signal line G3, for example. In this case, the data controller 30*a* causes the source drive circuit 14 to output a voltage (the image signal D1) output from the source drive circuit 14 in response to the scanning of the first gate signal line G1 continuously for two horizontal scanning periods 2H. Specifically, for one horizontal scanning period 1H corresponding to the gate signal line G2 that is not scanned, a voltage output corresponding to the gate signal line G1 (the image signal D1) is continuously output.

Further, the gate drive circuit 13 scans, for example, the third gate signal line G3, and then the fourth gate signal line G4. In this case, the data controller 30*a* causes the source drive circuit 14 to output a voltage (the image signal D3) output from the source drive circuit 14 in response to the scanning of the third gate signal line G3 continuously for one horizontal scanning period 1H.

Further, the gate drive circuit 13 scans, for example, the fourth gate signal line G4, and then the fifth gate signal line G5. In this case, the data controller 30*a* causes the source drive circuit 14 to output a voltage (the image signal D4) output from the source drive circuit 14 in response to the scanning of the fourth gate signal line G4 continuously for one horizontal scanning period 1H.

Further, the gate drive circuit 13 scans, for example, the fifth gate signal line G5, and then the seventh gate signal line G7. In this case, the data controller 30*a* causes the source drive circuit 14 to output a voltage (the image signal D5) output from the source drive circuit 14 in response to the scanning of the fifth gate signal line G5 continuously for two horizontal scanning periods 2H. Specifically, for one horizontal scanning period 1H corresponding to the gate signal line G6 that is not scanned, a voltage (the image signal D5) output corresponding to the gate signal line G5 is continuously output.

Hereinafter, this also applies to a case of the seventh gate signal line G7 and thereafter. Specifically, in the first shift control mode MD2, in a case in which the gate drive circuit 13 first scans a U-th gate signal line out of the N gate signal lines (U is an integer that is not less than 1 and less than N), and then a (U+V)-th gate signal line (V is an integer that is not less than 1 and not greater than K), the data controller 30*a* causes the source drive circuit 14 to output a voltage output from the source drive circuit 14 in response to scanning of the U-th gate signal line continuously for V horizontal scanning periods V*H (V times of the horizontal scanning period 1H).

Next, a description will be given of delay time of an image signal input to the source drive circuit 14 in the first shift control mode MD2 shown in FIG. 14.

The image signal D1 corresponding to the gate signal line G1 is input as the image signal SG13 to the source drive circuit 14 in synchronization with the latch timing signal SG9 at time t1 without delay from the selector 45 of the data controller 30*a*. On the other hand, for the image signal D3 corresponding to the gate signal line G3, the image signal SG21D2 obtained by delaying the image signal SG21 by two horizontal scanning periods 2H is input as the image signal SG13 to the source drive circuit 14 in synchronization with the latch timing signal SG9 at time t5. Further, for the image signal D4 corresponding to the gate signal line G4, the image signal SG21D3 obtained by delaying the image signal SG21 by three horizontal scanning period 3H is input as the image signal SG13 to the source drive circuit 14 in synchronization with the latch timing signal SG9 at time t7.

In this manner, as K=4 in the first shift control mode MD2 in the second embodiment, the data controller 30*a* delays the image signal SG21 by a period C*H (C is an integer expressed by $0 \leq C \leq (K-1)$), inputs the delayed image signal to the source drive circuit 14. In the low-power control mode MD3, the data controller 30*a* may also delay an image signal and inputs the delayed image signal to the source drive circuit 14.

Next, in the first shift control mode MD2 shown in FIG. 14, a description will be given of a relation between delay time of a gate start signal in the gate drive signal SG8 output from the gate controller 27 and timing for outputting an image signal to be first input to the source drive circuit 14 after the vertical synchronizing signal Vsync.

As described above, in the second embodiment, the gate controller 27 delays timing for outputting a gate start signal by the time period (K−1)*H in the first shift control mode MD2 than in the basic control mode MD1.

On the other hand, as shown in FIG. 14, the image signal D1 first input to the source drive circuit 14 after the vertical synchronizing signal Vsync is input as the image signal SG13 from the selector 45 of the data controller 30*a* to the source drive circuit 14 in synchronization with the latch timing signal SG9 at time t1. Then, the image signal D1 is output from the source drive circuit 14 in synchronization with the latch timing signal SG9 at time t5 after a period 4H lapses.

In this manner, as K=4 in the first shift control mode MD2 in the second embodiment, the source controller 28*a* outputs the latch timing signal SG9 to the source drive circuit 14 such that the image signal D1 first input to the source drive circuit 14 after the vertical synchronizing signal Vsync is output from the source drive circuit 14 after a period K*H lapses from a time point at which the image signal D1 is input. With this, the first image signal D1 is output from the source drive circuit 14 matching a gate signal output from the gate drive circuit 13 to the gate signal line G1.

Similarly, the gate controller 27 may also delay a gate start signal in the low-power control mode MD3, and the source controller 28*a* may delay the image signal D1 first input to the source drive circuit 14 after the vertical synchronizing signal Vsync and may output the delayed image signal from the source drive circuit 14.

As described above, in the second embodiment, it is controlled whether the latch timing signal SG9 is output or not according to the turning on and off of the data enable signal SG70. Thus, it is possible to reduce power consumption as compared to the first embodiment in which the latch timing signal SG9 is output every time the horizontal synchronizing signal Hsync is output.

With a common source drive circuit, the latch timing signal for controlling timing of the source drive circuit has an address reset function of determining a leading pixel of the image signal, and a latch output function of outputting an image signal taken in the source drive circuit to a source signal line. In the second embodiment, even when the interval between the scan target signal lines among the gate signal lines is not constant, it is possible to match a gate signal line to which a gate signal is output from the gate drive circuit 13 with a voltage corresponding to an image signal output to the source signal line from the source drive circuit 14 using such a common source drive circuit. As a result, according to the second embodiment, it is possible to display a desired image based on an input image signal, and to reduce power consumption without using any special source drive circuit.

Third Embodiment

Figure 15:
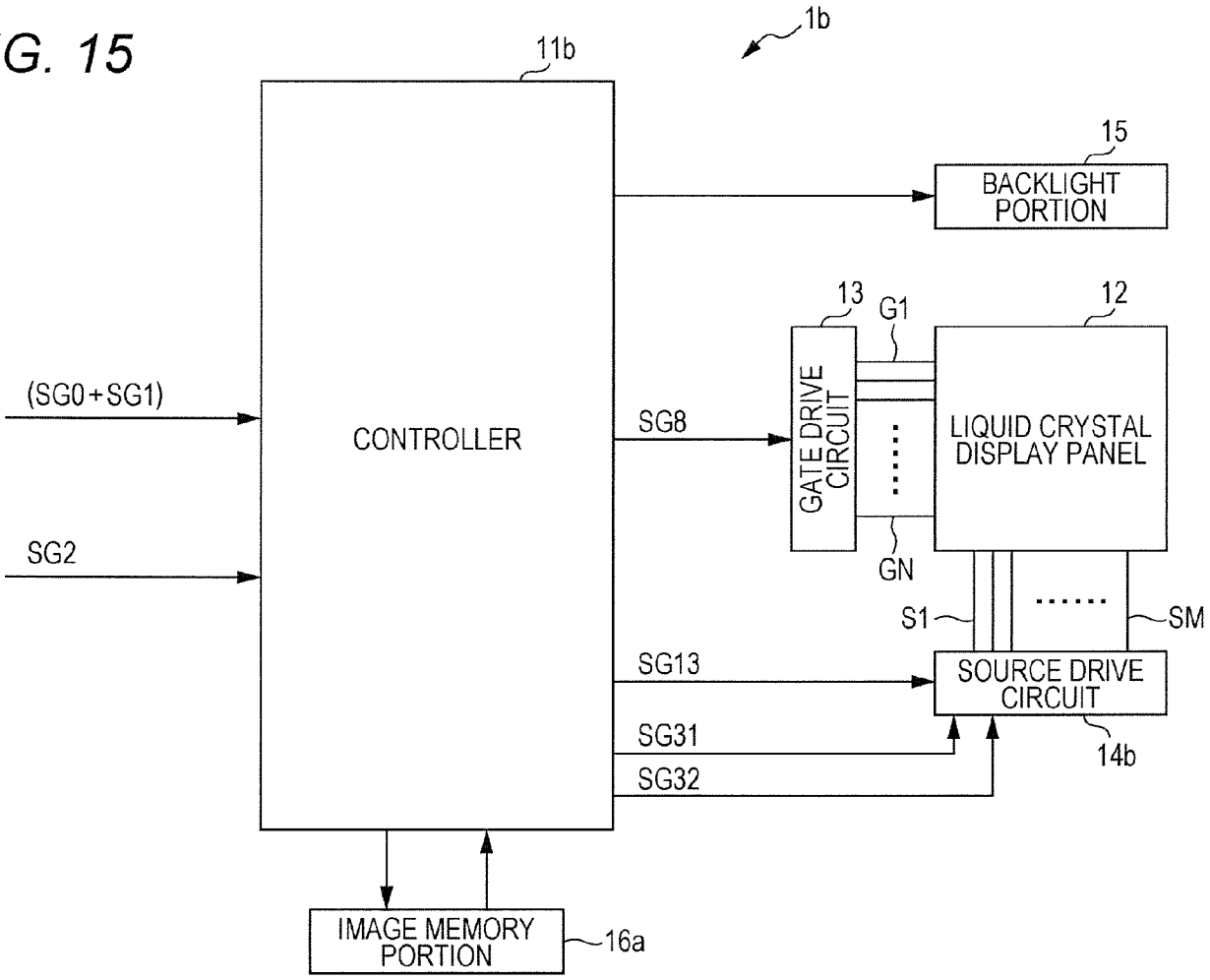
FIG. 15 is a block diagram showing a configuration of a display device according to a third embodiment.
Figure 16:
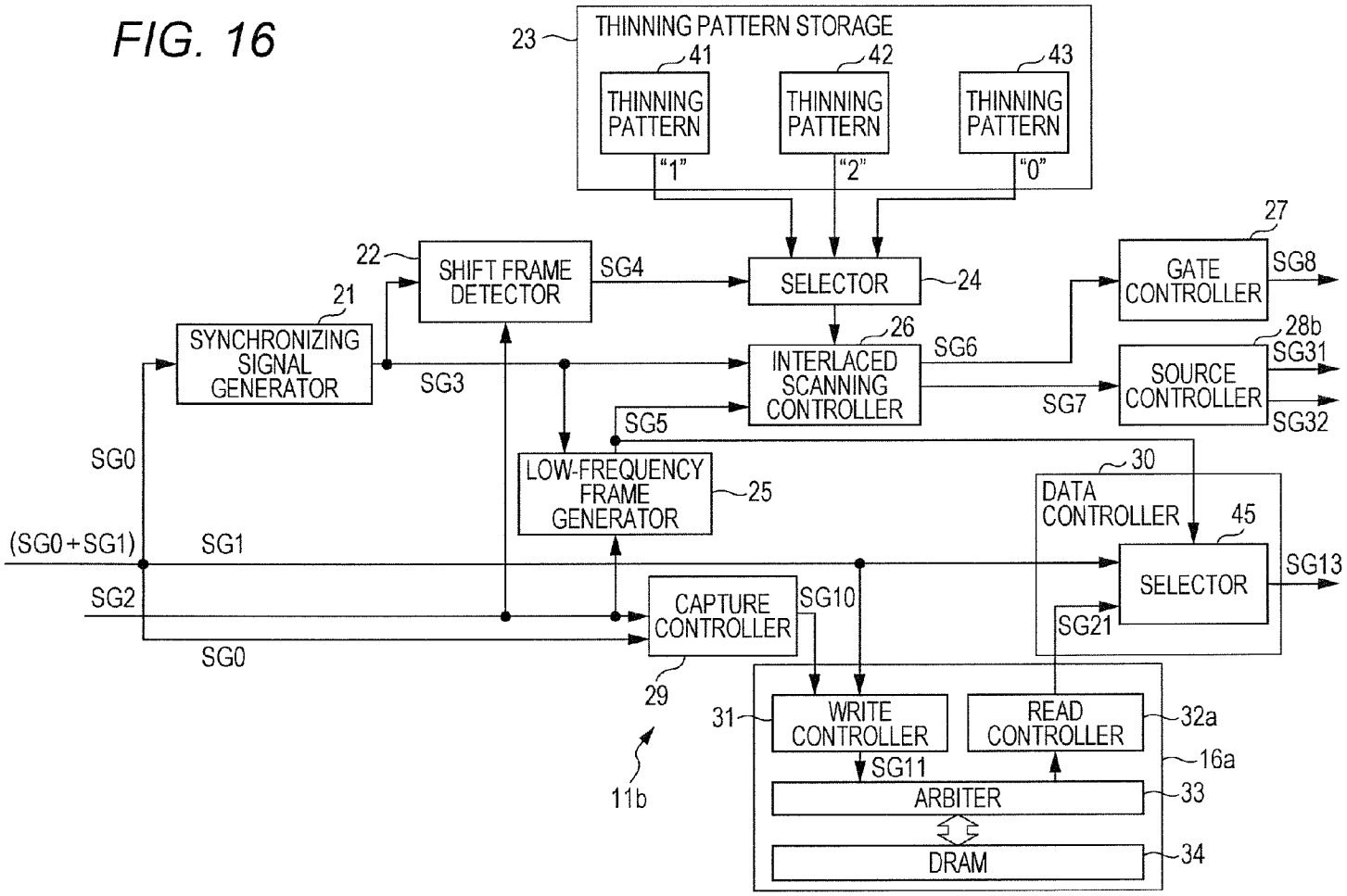
FIG. 16 is a block diagram showing a configuration of a controller and an image memory portion of the display device shown in FIG. 15 according to the third embodiment.

FIG. 15 is a block diagram showing a configuration of a display device according to a third embodiment. FIG. 16 is a block diagram showing a configuration of a controller and an image memory portion of the display device shown in FIG. 15 according to the third embodiment. In the third embodiment, similar components as in the first embodiment are denoted by similar reference numerals.

A display device 1*b* according to the third embodiment includes a controller 11*b*, a source drive circuit 14*b*, and the image memory portion 16*a* similar to that in the second embodiment respectively in place of the controller 11, the source drive circuit 14, and the image memory portion 16 of the display device 1 according to the first embodiment shown in FIG. 1. In the third embodiment, similarly to the first embodiment, the frame frequency F1 in the basic control mode is expressed by F1=60 Hz, and the frame frequency F2 in the low-power control mode is expressed by F2=15 Hz. Hereinafter, the third embodiment will be described focusing on differences from the first embodiment.

Referring to FIG. 16, the controller 11*b* includes the synchronizing signal generator 21, the shift frame detector 22, the thinning pattern storage 23, the selector 24, the low-frequency frame generator 25, the interlaced scanning controller 26, the gate controller 27, a source controller 28*b*, the capture controller 29, and the data controller 30.

Similarly to the second embodiment, the interlaced scanning controller 26 does not output the data enable signal SG7 to the read controller 32*a*. The source controller 28*b* generates a data reset signal SG31 based on a data enable signal SG7 from the interlaced scanning controller 26. The source controller 28*b* outputs the generated data reset signal SG31 to the source drive circuit 14*b* in synchronization with the horizontal synchronizing signal Hsync. Further, the source controller 28*b* generates a data latch signal SG32. The source controller 28*b* outputs the generated data latch signal SG32 to the source drive circuit 14*b* in synchronization with the horizontal synchronizing signal Hsync.

The data reset signal SG31 and the data latch signal SG32 are for controlling operational timing of the source drive circuit 14*b*. The data reset signal SG31 is a signal indicating the beginning of data for the source drive circuit 14*b* to start loading the data. The image signal SG13 that is input from the selector 45 to the source drive circuit 14*b* is input in synchronization with the data reset signal SG31.

The data latch signal SG32 is a signal indicating timing for the source drive circuit 14*b* to output a voltage based on the loaded data. The source drive circuit 14*b* outputs a voltage based on the input image signal SG13 to the source signal lines in synchronization with the data latch signal SG32.

In this manner, in the third embodiment, the functions of the latch timing signal SG9 according to the first embodiment and the second embodiment are divided into two signals of the data reset signal SG31 and the data latch signal SG32. In this embodiment, the liquid crystal display panel 12 corresponds to one example of the display portion, the gate drive circuit 13 corresponds to one example of the gate driver, the source drive circuit 14 corresponds to one example of the source driver, the thinning pattern storage 23 corresponds to one example of the pattern storage, and the DRAM 34 corresponds to one example of the image storage.

Figure 17:
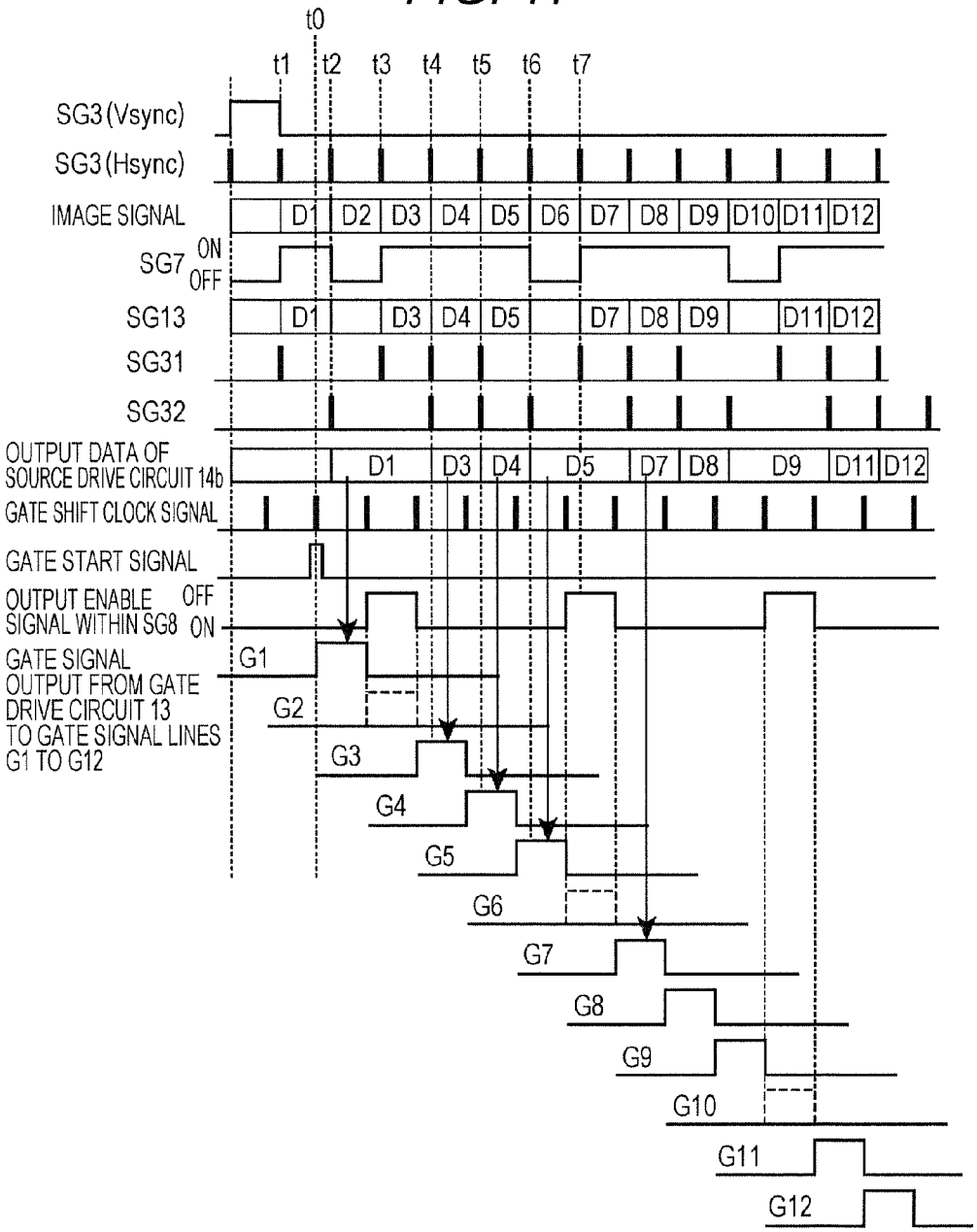
FIG. 17 is a timing chart schematically showing operations of the gate drive circuit and the source drive circuit in the sub-frame in FIG. 5 in which the control mode is the first shift control mode according to the third embodiment.

FIG. 17 is a timing chart schematically showing operations of the gate drive circuit and the source drive circuit in the sub-frame SF3 in FIG. 5 in which the control mode is the first shift control mode MD2 according to the third embodiment. In FIG. 17, the gate signal lines G13 to G16 are not depicted similarly to FIG. 10. With reference to FIG. 15 through FIG. 17, a description will be given of operations of the gate drive circuit 13 and the source drive circuit 14*b* in the sub-frame SF3 in FIG. 5 in which the control mode is the first shift control mode MD2 according to the third embodiment.

In FIG. 17, first, the vertical synchronizing signal Vsync is output and the horizontal synchronizing signal Hsync is output in synchronization with rising of the vertical synchronizing signal Vsync. At time t1 after the vertical synchronizing signal Vsync is output, the data enable signal SG7 is turned on. Therefore, the data reset signal SG31 is output in synchronization with the horizontal synchronizing signal Hsync at time t1. The image signal D1 corresponding to the gate signal line G1 (the image signal SG13) is input from the selector 45 to the source drive circuit 14*b* in synchronization with the data reset signal SG31 at time t1.

The data latch signal SG32 is output in synchronization with the horizontal synchronizing signal Hsync at time t2 after time t1. A voltage based on the image signal SG13, that is, a voltage corresponding to the image signal D1 is output from the source drive circuit 14*b* to the source signal lines in synchronization with the data latch signal SG32 at time t2.

On the other hand, a gate start signal is output at time t0 between time t1 and time t2. Specifically, the gate controller 27 outputs the gate start signal after delay time of a time period (1+Tg)*H (0≤Tg<1) from the rising of the vertical synchronizing signal Vsync. In addition, at time t0, the output enable signal in the gate drive signal SG8 is turned on. Therefore, a gate signal is output to the gate signal line G1 in synchronization with the gate start signal. As the gate signal corresponding to the gate signal line G1 is output, a voltage corresponding to the image signal D1 output from the source drive circuit 14*b* is applied to the pixel electrodes.

On the other hand, at time t2, the data enable signal SG7 is turned off. Accordingly, the data reset signal SG31 is not output at time t2. Therefore, an image signal corresponding to the gate signal line G2 is not input to the source drive circuit 14*b*.

At time t3 that comes next, the data enable signal SG7 is turned on. Accordingly, the data reset signal SG31 is output in synchronization with the horizontal synchronizing signal Hsync at time t3. The image signal D3 corresponding to the gate signal line G3 (the image signal SG13) is input from the selector 45 to the source drive circuit 14*b* in synchronization with the data reset signal SG31 at time t3.

On the other hand, the data latch signal SG32 is not output at time t3. Therefore, a voltage is not output from the source drive circuit 14*b* at time t3. Further, the output enable signal in the gate drive signal SG8 is turned off at time t3. Accordingly, a gate signal is not output from the gate drive circuit 13 to the gate signal line G2.

At time t4 that comes next, the data enable signal SG7 is turned on. Accordingly, the data reset signal SG31 is output in synchronization with the horizontal synchronizing signal Hsync at time t4. The image signal D4 corresponding to the gate signal line G4 (the image signal SG13) is input from the selector 45 to the source drive circuit 14*b* in synchronization with the data reset signal SG31 at time t4.

Further, the data latch signal SG32 is output in synchronization with the horizontal synchronizing signal Hsync at time t4. A voltage based on the image signal D3 corresponding to the gate signal line G3 input to the source drive circuit 14*b* in synchronization with the data reset signal SG31 at previous time t3 (the image signal SG13) is output from the source drive circuit 14*b* to the source signal lines in synchronization with the data latch signal SG32 at time t4.

At time t4, the output enable signal in the gate drive signal SG8 is turned on. Accordingly, a gate signal is output from the gate drive circuit 13 to the gate signal line G3. Therefore, a voltage based on the image signal D3 corresponding to the gate signal line G3 (the image signal SG13) output from the source drive circuit 14*b* to the source signal lines is applied to the pixel electrodes.

Then, the gate drive circuit 13 and the source drive circuit 14*b* operate in the same manner, and a voltage is applied to the pixel electrodes corresponding to the gate signal lines other than the gate signal lines G2, G6, G10, and G14, the operation in the sub-frame SF3 in FIG. 5 in which the control mode is the first shift control mode MD2 is performed. In FIG. 17, gate signals which are not output to the gate signal lines G2, G3, and G10 are indicated by broken lines.

As described above, in the third embodiment, the functions of the latch timing signal SG9 according to the first embodiment and the second embodiment are divided into two signals of the data reset signal SG31 and the data latch signal SG32. Therefore, according to the third embodiment, it is possible to perform scanning to the gate signal lines in the thinning pattern 41 in the first shift control mode MD2 in a favorable manner without outputting dummy data as in the first embodiment, or delaying data as in the second embodiment.

In the third embodiment, it is possible to easily match a gate signal line to which a gate signal is output from the gate drive circuit 13 with a voltage corresponding to an image signal output from the source drive circuit 14 to the source signal lines. As a result, according to the third embodiment, it is possible to display a desired image based on the input image signal, and to reduce power consumption.

Fourth Embodiment

Figure 18:
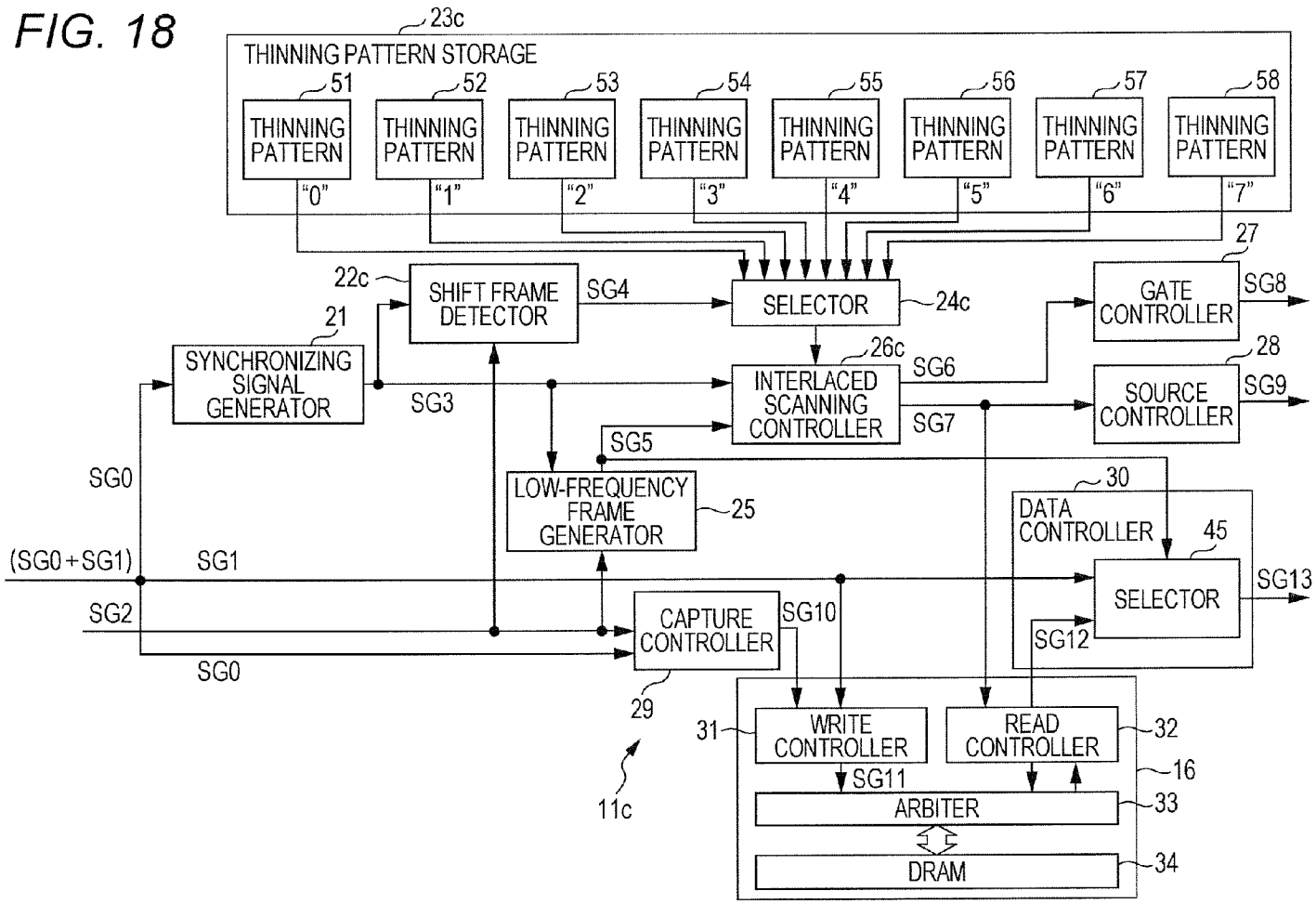
FIG. 18 is a block diagram showing a configuration of a controller and an image memory portion of a display device according to a fourth embodiment.

FIG. 18 is a block diagram showing a configuration of a controller and an image memory portion of a display device according to a fourth embodiment. In the fourth embodiment, similar components as in the first embodiment are denoted by similar reference numerals. Hereinafter, the fourth embodiment will be described focusing on differences from the first embodiment.

According to the display device of the fourth embodiment, the control mode shifts from the basic control mode to the low-power control mode by way of the second low-power control mode, and returns to the basic control mode from the low-power control mode by way of the second low-power control mode.

Similarly to the first embodiment, the frame frequency F1 in the basic control mode in the fourth embodiment is expressed by F1=60 Hz. Unlike the first embodiment, the frame frequency F2 in the low-power control mode in the fourth embodiment is expressed by F2=12 Hz. A frame frequency F3 in the second low-power control mode in the fourth embodiment is expressed by F3=20 Hz. In this manner, the frame frequency F3 in the second low-power control mode is set such that a relation of F1>F3>F2 is established.

The configuration of the display device according to the fourth embodiment is substantially the same as that of the display device 1 according to the first embodiment shown in FIG. 1. The display device according to the fourth embodiment includes a controller 11*c* in place of the controller 11 of the display device 1 according to the first embodiment.

As shown in FIG. 18, the controller 11*c* according to the fourth embodiment includes the synchronizing signal generator 21, a shift frame detector 22*c*, a thinning pattern storage 23*c*, a selector 24*c*, the low-frequency frame generator 25, an interlaced scanning controller 26*c*, the gate controller 27, the source controller 28, the capture controller 29, and the data controller 30. The thinning pattern storage 23*c* stores thinning patterns 51 to 58.

The shift frame detector 22*c* includes a previously set sequence for causing the control mode to shift from the basic control mode to the low-power control mode by way of the first shift control mode, the second low-power control mode, and a third shift control mode, and a previously set sequence for causing the control mode to return to the basic control mode from the low-power control mode by way of a fourth shift control mode, the second low-power control mode, and the second shift control mode. The shift frame detector 22*c* generates the selection signal SG4 based on these sequences. The shift frame detector 22*c* outputs the generated selection signal SG4 to the selector 24*c*.

The selection signal SG4 includes a signal "0" representing a thinning pattern in the first shift control mode when the control mode shifts from the basic control mode to the second low-power control mode, signals "1" and "2" representing a thinning pattern in the third shift control mode when the control mode shifts from the second low-power control mode to the low-power control mode, signals "3" and "4" representing a thinning pattern in the fourth shift control mode when the control mode returns to the second low-power control mode from the low-power control mode, a signal "5" representing a thinning pattern in the second low-power control mode, a signal "6" representing a thinning pattern in the low-power control mode, and a signal "7" representing a thinning pattern in the second shift control mode when the control mode returns to the basic control mode from the second low-power control mode.

The thinning patterns 51 to 58 stored in the thinning pattern storage 23*c* represent thinning patterns when the gate signal lines are subjected to interlaced scanning. In the fourth embodiment, when the control mode shifts from the basic control mode to the second low-power control mode, the control mode shifts through the first shift control mode. The thinning pattern 51 represents a thinning pattern in the first shift control mode.

In the fourth embodiment, when the control mode shifts from the second low-power control mode to the low-power control mode, the control mode shifts through the third shift control mode. In the third shift control mode, two shift frames are used. The thinning pattern 52 represents a thinning pattern for a former one of two shift frames used in the third shift control mode. The thinning pattern 53 represents a thinning pattern for a latter one of the two shift frames used in the third shift control mode.

In the fourth embodiment, when the control mode returns to the second low-power control mode from the low-power control mode, the control mode returns through the fourth shift control mode. In the fourth shift control mode, two shift frames are used. The thinning pattern 54 represents a thinning pattern for a former one of two shift frames used in the fourth shift control mode. The thinning pattern 55 represents a thinning pattern for a latter one of the two shift frames used in the fourth shift control mode.

The thinning pattern 56 represents a thinning pattern used in the second low-power control mode. The thinning pattern 57 represents a thinning pattern used in the low-power control mode. In the fourth embodiment, when the control mode returns to the basic control mode from the second low-power control mode, the control mode shifts through the second shift control mode. The thinning pattern 58 represents a thinning pattern used in the second shift control mode. Specific examples of the thinning patterns 51 to 58 will be described later.

The selector 24*c* outputs the thinning pattern 51 to the interlaced scanning controller 26*c* when the selection signal SG4 output from the shift frame detector 22*c* is "0", outputs the thinning pattern 52 when the selection signal SG4 is "1", outputs the thinning pattern 53 when the selection signal SG4 is "2", outputs the thinning pattern 54 when the selection signal SG4 is "3", outputs the thinning pattern 55 when the selection signal SG4 is "4", outputs the thinning pattern 56 when the selection signal SG4 is "5", outputs the thinning pattern 57 when the selection signal SG4 is "6", and outputs the thinning pattern 58 when the selection signal SG4 is "7".

Similarly to the first embodiment, the interlaced scanning controller 26*c* generates the output enable signal SG6 and the data enable signal SG7 based on the thinning patterns 51 to 58 output from the selector 24*c*. In this embodiment, the liquid crystal display panel 12 corresponds to one example of the display portion, the gate drive circuit 13 corresponds to one example of the gate driver, the source drive circuit 14 corresponds to one example of the source driver, the thinning pattern storage 23*c* corresponds to one example of the pattern storage, and the DRAM 34 corresponds to one example of the image storage.

Figure 19:
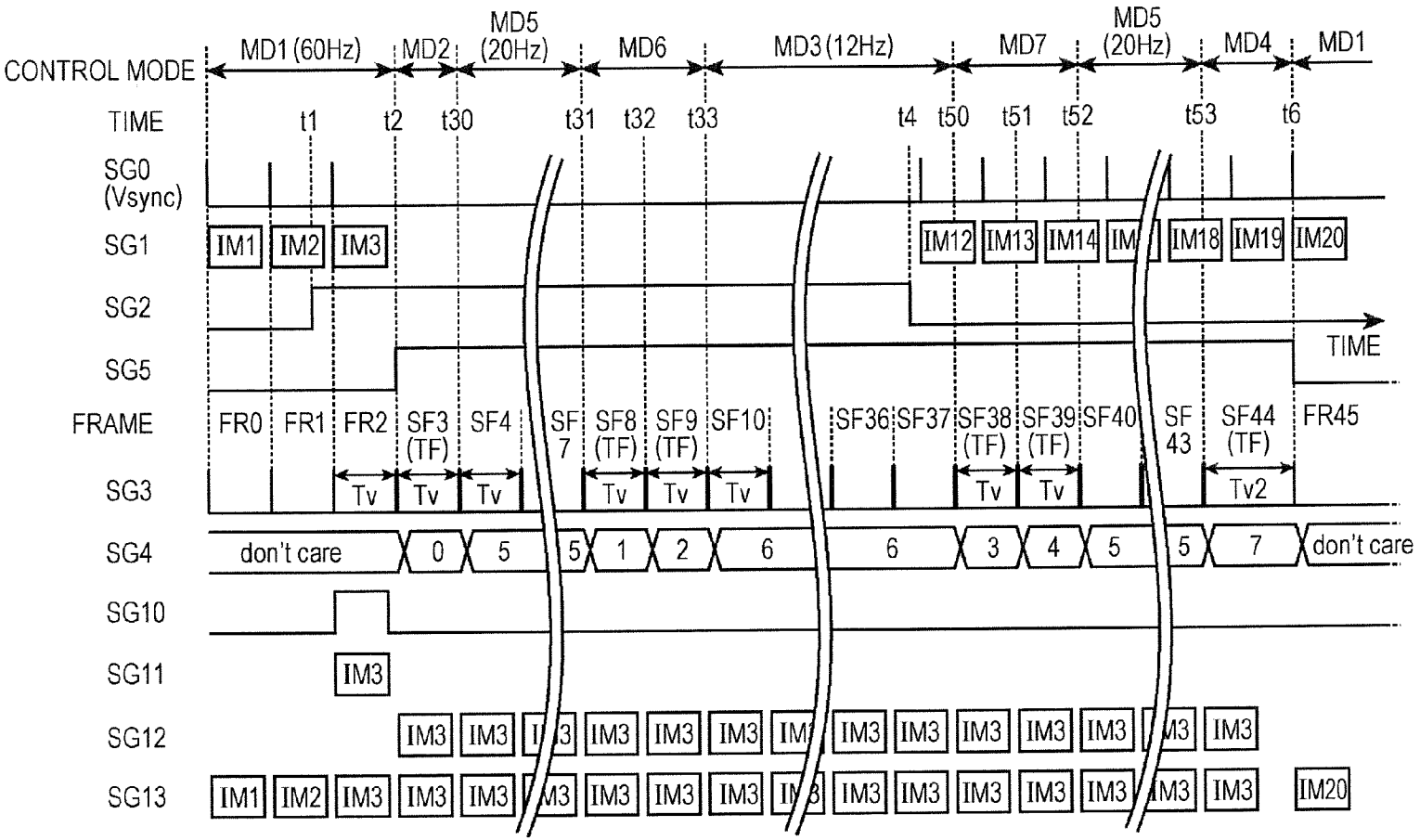
FIG. 19 is a timing chart schematically showing main signals shown in FIG. 18, in a case in which the control mode shifts from the basic control mode to the low-power control mode by ways of the second low-power control mode, and returns to the basic control mode from the low-power control mode by way of the second low-power control mode.

FIG. 19 is a timing chart schematically showing main signals shown in FIG. 18, in a case in which the control mode shifts from the basic control mode to the low-power control mode by ways of the second low-power control mode, and returns to the basic control mode from the low-power control mode by way of the second low-power control mode. An operation of the display device according to the fourth embodiment will be described focusing on differences from FIG. 4 of the first embodiment, with reference to FIG. 18 and FIG. 19.

Referring to FIG. 19, the operation in the frames FR0 to FR2 and until time t2 is similar to that shown in FIG. 4 of the first embodiment. Specifically, the control mode in the frames FR0 to FR2 is the basic control mode MD1.

The shift frame detector 22*c* outputs the signal "0" representing the thinning pattern in the shift frame TF used in the first shift control mode as the selection signal SG4 to the selector 24*c*, in synchronization with the synchronizing signal SG3 at time t2 at which the switching signal SG5 is turned on. The selector 24*c* outputs the thinning pattern 51 corresponding to the selection signal SG4 that is the signal "0" to the interlaced scanning controller 26*c*. Similarly to FIG. 4, in this manner, the sub-frame SF3 functions as the shift frame TF, and the control mode in the sub-frame SF3 is the first shift control mode MD2.

The shift frame detector 22*c* outputs the signal "5" representing the thinning pattern in the second low-power control mode as the selection signal SG4 to the selector 24*c*, in synchronization with the synchronizing signal SG3 that comes next at time t30. As the selection signal SG4 is "5", the selector 24*c* outputs the thinning pattern 56 to the interlaced scanning controller 26*c*. The control mode in the sub-frames SF4 to SF7 after time t30 is a second low-power control mode MD5, and the frame frequency F3 in the fourth embodiment is expressed by F3=20 Hz.

Then, in synchronization with the synchronizing signal SG3 at time t31, the shift frame detector 22*c* outputs the signal "1" representing the thinning pattern for the shift frame TF before used in the third shift control mode as the selection signal SG4 to the selector 24*c*. As the selection signal SG4 is the selector 24*c* outputs the thinning pattern 52 to the interlaced scanning controller 26*c*.

Then, in synchronization with the synchronizing signal SG3 at time t32, the shift frame detector 22*c* outputs the signal "2" representing the thinning pattern for the shift frame TF before used in the third shift control mode as the selection signal SG4 to the selector 24*c*. As the selection signal SG4 is "2", the selector 24*c* outputs the thinning pattern 53 to the interlaced scanning controller 26*c*. In this manner, the control mode in the sub-frames SF8 and SF9 is a third shift control mode MD6.

In synchronization with the synchronizing signal SG3 that comes next at time t33, the shift frame detector 22*c* outputs the signal "6" representing the thinning pattern in the low-power control mode as the selection signal SG4 to the selector 24*c*. As the selection signal SG4 is "6", the selector 24*c* outputs the thinning pattern 57 to the interlaced scanning controller 26*c*. The control mode in the sub-frames SF10 to SF37 after time t33 is the low-power control mode MD3, and the frame frequency F2 in the fourth embodiment is expressed by F2=12 Hz.

The standby mode signal SG2 is turned off at time t4 in the course of the sub-frame SF37, and the input of the synchronizing signal SG0 and the image signal SG1 is restarted.

In synchronization with the synchronizing signal SG3 that comes next (at time t50) after time t4 at which the standby mode signal SG2 is turned off, the shift frame detector 22*c* outputs the signal "3" representing the thinning pattern for the shift frame TF before used in the fourth shift control mode as the selection signal SG4 to the selector 24*c*. As the selection signal SG4 is "3", the selector 24*c* outputs the thinning pattern 54 to the interlaced scanning controller 26*c*.

Then, in synchronization with the synchronizing signal SG3 at time t51, the shift frame detector 22*c* outputs the signal "4" representing the thinning pattern for the shift frame TF before used in the fourth shift control mode as the selection signal SG4 to the selector 24*c*. As the selection signal SG4 is "4", the selector 24*c* outputs the thinning pattern 55 to the interlaced scanning controller 26*c*. In this manner, the control mode in the sub-frames SF38 and SF39 is a fourth shift control mode MD7.

In synchronization with the synchronizing signal SG3 that comes next at time t52, the shift frame detector 22*c* outputs the signal "5" representing the thinning pattern in the second low-power control mode as the selection signal SG4 to the selector 24*c*. As the selection signal SG4 is "5", the selector 24*c* outputs the thinning pattern 56 to the interlaced scanning controller 26*c*. The control mode in the sub-frames SF40 to SF43 after time t52 is the second low-power control mode MD5, and the frame frequency F3 in the fourth embodiment is expressed by F3=20 Hz.

In synchronization with the synchronizing signal SG3 at time t53, the shift frame detector 22*c* outputs the signal "7" representing the thinning pattern for the shift frame TF before used in the second shift control mode as the selection signal SG4 to the selector 24*c*. As the selection signal SG4 is "7", the selector 24*c* outputs the thinning pattern 58 to the interlaced scanning controller 26*c*.

After the synchronizing signal SG0 at time t6 when one frame period or more has lapsed after the synchronizing signal SG3 at time t53, the synchronizing signal generator 21 outputs the synchronizing signal SG0 from outside as the synchronizing signal SG3. Then, the low-frequency frame generator 25 turns the switching signal SG5 off in synchronization with the synchronizing signal SG3 at time t6.

Similarly to the first embodiment, when the switching signal SG5 is turned off, the selector 45 outputs, as the image signal SG13 to the source drive circuit 14, the image signal SG1 in place of the image signal SG12. With this, after the synchronizing signal SG0 (SG3) at time t6, an image IM20 is displayed in a frame FR45 at the frame frequency F1 of 60 Hz on the liquid crystal display panel 12. In this manner, the control mode in and after the frame FR45 is the basic control mode MD 1.

As shown in FIG. 19, a period, for example, of the frame FR2 in the basic control mode MD1, a period, for example, of the sub-frame SF3 in the first shift control mode MD2, a period, for example, of the sub-frame SF4 in the second low-power control mode MD5, a period of the sub-frame SF8 in the third shift control mode MD6, a period of the sub-frame SF9 in the third shift control mode MD6, a period, for example, of the sub-frame SF10 in the low-power control mode MD3, a period of the sub-frame SF38 in a fourth shift control mode MD7, a period of the sub-frame SF39 in the fourth shift control mode MD7 are equal to the vertical scanning period Tv when the frame frequency is 60 Hz. Further, a period Tv2 of the sub-frame SF44 in the second shift control mode MD4 is expressed by Tv2>Tv as the synchronizing signal SG0 at which the input is restarted is out of synchronization. In this embodiment, the vertical scanning period Tv is one example of a certain time period.

FIG. 20 and FIG. 21 are diagrams each schematically showing polarities of voltages applied to one of the source signal lines (e.g., the source signal line S1) in performing the operation shown in FIG. 19 of the control mode shifting from the basic control mode to the low-power control mode by way of the second low-power control mode, and returning to the basic control mode from the low-power control mode by way of the second low-power control mode. In FIG. 20 and FIG. 21, the frames FR0 to FR2, the sub-frames SF3 to SF44, and the frame FR45 are shown, similarly to FIG. 19.

Figure 22:
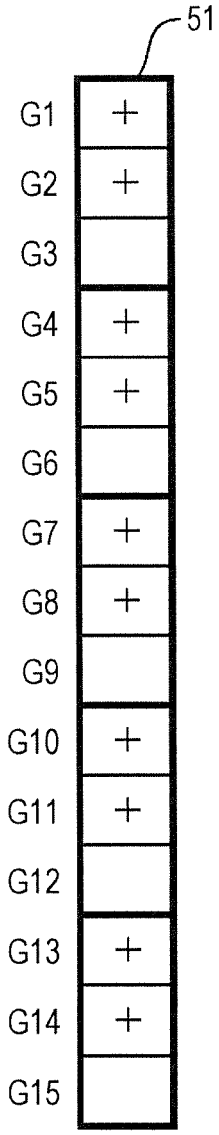
FIG. 22 is a diagram schematically showing the thinning pattern used in the first shift control mode when the control mode shifts from the basic control mode to the second low-power control mode by way of the first shift control mode.
Figure 23A:
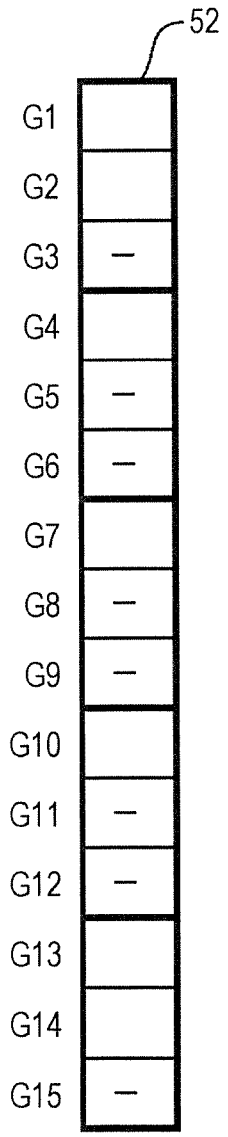
FIG. 23A is a diagram schematically showing the thinning pattern for a former one of two shift frames used in the third shift control mode when the control mode shifts from the second low-power control mode to the low-power control mode by way of the third shift control mode.
Figure 23B:
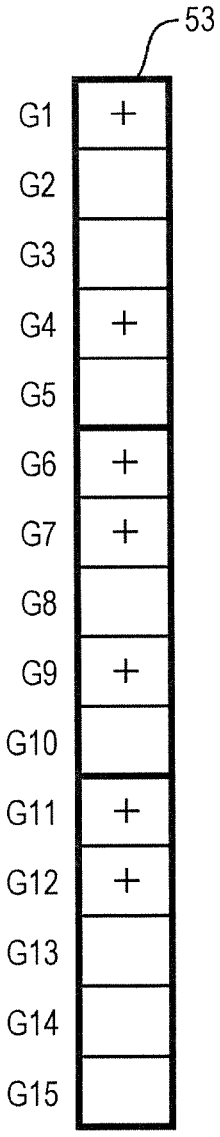
FIG. 23B is a diagram schematically showing the thinning pattern for a latter one of two shift frames used in the third shift control mode when the control mode shifts from the second low-power control mode to the low-power control mode by way of the third shift control mode.

FIG. 22 schematically shows the thinning pattern 51 used in the first shift control mode when the control mode shifts from the basic control mode to the second low-power control mode by way of the first shift control mode. FIG. 23A schematically shows the thinning pattern 52 for a former one of two shift frames used in the third shift control mode when the control mode shifts from the second low-power control mode to the low-power control mode by way of the third shift control mode. FIG. 23B schematically shows the thinning pattern 53 for a latter one of two shift frames used in the third shift control mode when the control mode shifts from the second low-power control mode to the low-power control mode by way of the third shift control mode.

Figure 24A:
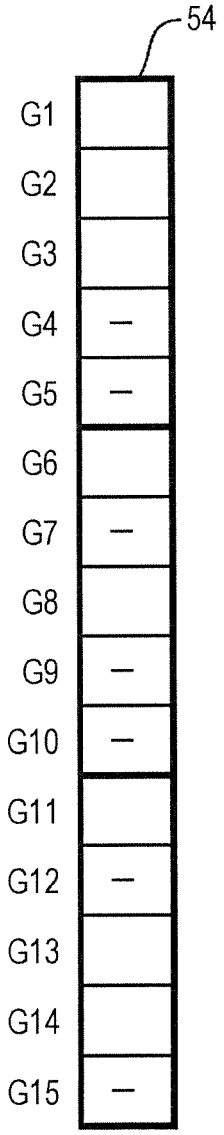
FIG. 24A is a diagram schematically showing the thinning pattern for a former one of two shift frames used in the fourth shift control mode when the control mode returns to the second low-power control mode from the low-power control mode by way of the fourth shift control mode.
Figure 24B:
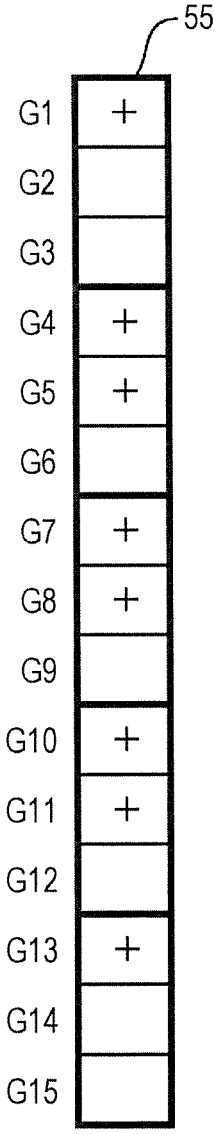
FIG. 24B is a diagram schematically showing the thinning pattern for a latter one of two shift frames used in the fourth shift control mode when the control mode returns to the second low-power control mode from the low-power control mode by way of the fourth shift control mode.
Figure 25:
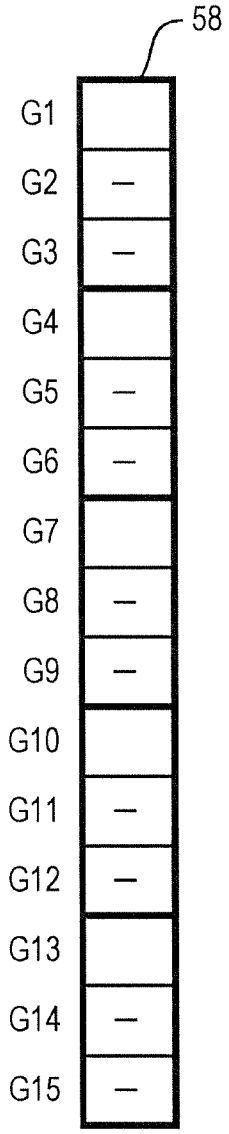
FIG. 25 is a diagram schematically showing the thinning pattern used in the second shift control mode when the control mode returns to the basic control mode from the second low-power control mode by way of the second shift control mode.
Figure 26A:
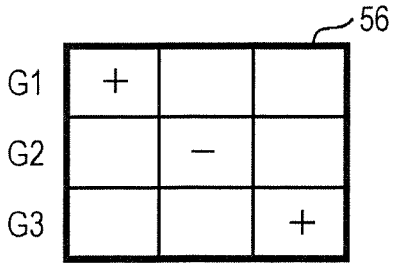
FIGS. 26A and 26B are a diagram schematically showing the thinning pattern used in the second low-power control mode.
Figure 26B:
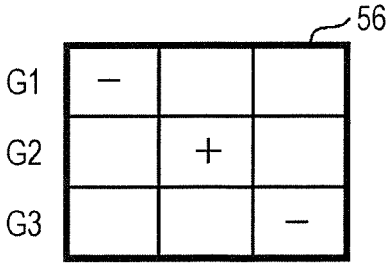

FIG. 24A schematically shows the thinning pattern 54 for a former one of two shift frames used in the fourth shift control mode when the control mode returns to the second low-power control mode from the low-power control mode by way of the fourth shift control mode. FIG. 24B schematically shows the thinning pattern 54 for a latter one of two shift frames used in the fourth shift control mode when the control mode returns to the second low-power control mode from the low-power control mode by way of the fourth shift control mode. FIG. 25 schematically show the thinning pattern 58 used in the second shift control mode when the control mode returns to the basic control mode from the second low-power control mode by way of the second shift control mode. FIGS. 26A and 26B schematically show the thinning pattern 56 used in the second low-power control mode. FIGS. 27A and 27B schematically show the thinning pattern 57 used in the low-power control mode.

In FIG. 20 to FIG. 25, the number N of the gate signal lines is expressed by N=15. In FIGS. 26A and 26B, as the patterns for the gate signal lines G4 to G6, G7 to G9, G10 to G12, and G13 to G15 are the same as the pattern for the gate signal lines G1 to G3, only the pattern for the gate signal lines G1 to G3 is shown. In FIGS. 27A and 27B, as the patterns for the gate signal lines G6 to G10 and G11 to G15 are the same as the pattern for the gate signal lines G1 to G5, only the pattern for the gate signal lines G1 to G5 is shown. The thinning patterns 51 to 58 stored in the thinning pattern storage 23*c* will be described with reference to FIG. 20 to FIG. 27B.

As described with reference to FIG. 19, in the frames FR0 to FR2 in FIG. 20, the control mode is the basic control mode MD1, and the frame frequency F1 for image display is expressed by F1=60 Hz. As shown in FIG. 20, the pixel electrodes are driven in the column inversion drive mode taking the polarity of a voltage applied to the source signal line S1 in the frame FR0 as "−", the polarity of a voltage applied to the source signal line S1 in the frame FR1 as "+", and the polarity of a voltage applied to the source signal line S1 in the frame FR2 as "−".

Further, as described with reference to FIG. 19, the sub-frame SF3 functions as the shift frame TF, and the control mode in the sub-frame SF3 is the first shift control mode MD2. Moreover, the control mode in and after the sub-frame SF4 is the second low-power control mode MD5. In the second low-power control mode MD5, the frame frequency F3 for image display is expressed by F3=20 Hz. Therefore, in the second low-power control mode MD5, the gate signal lines to be scanned are thinned every sub-frame, and the gate signal lines are subjected to the interlaced scanning.

Specifically, the gate signal lines G1 to G15 are subjected to the interlaced scanning every three gate signal lines, the interlaced scanning is repeated three times, and thus all of the gate signal lines G1 to 015 are scanned. In other words, three sub-frame images are respectively displayed in the three sub-frames SF3 to SF5 at 60 Hz. With this, an image is displayed at the frame frequency F3 expressed by F3=20 Hz.

Here, if the thinning pattern 56 shown in FIG. 26A is used in the sub-frames SF3 to SF5, to the gate signal lines G2, G5, G8, G11, and G14 indicated by a circle in FIG. 20, a voltage of "−" polarity is applied continuously in the frame FR2 and the sub-frame SF4.

Thus, in the fourth embodiment, the first shift control mode MD2 is taken as the control mode in the sub-frame SF3, and the thinning pattern 51 shown in FIG. 22 is used. As a result, voltages of "+" polarity are applied to the gate signal lines in the sub-frame SF3 indicated by the circle in FIG. 20. With this, continuous application of voltages of "−" polarity to the pixel electrodes connected to the source signal line S1 is avoided.

If a voltage of "+" polarity is applied in the last frame in the basic control mode MD1 as in the frame FR1, a thinning pattern with polarities inverted from the thinning pattern 51 shown in FIG. 22 can be used in the shift frame TF in the first shift control mode MD2. With this, continuous application of voltages of "+" polarity to the pixel electrodes connected to the source signal line S1 can be avoided.

The second low-power control mode MD5 is taken as the control mode in the sub-frames SF4 to SF7, and the thinning pattern 56 shown in FIGS. 26A and 26B is used. Then, as described with reference to FIG. 19, the control mode in and after the sub-frame SF10 is taken as the low-power control mode MD3.

In the low-power control mode MD3, the thinning pattern 57 shown in FIGS. 27A and 27B is used. In the fourth embodiment, the frame frequency F2 for image display is expressed by F2=12 Hz in the low-power control mode MD3. Therefore, in the low-power control mode MD3, the gate signal lines G1 to G15 are subjected to the interlaced scanning every five gate signal lines, the interlaced scanning is repeated five times, and thus all of the gate signal lines G1 to G15 are scanned. Specifically, five sub-frame images are respectively displayed, for example, in the five sub-frames SF14 to SF18 at 60 Hz. With this, an image is displayed at the frame frequency F2 expressed by F2=12 Hz.

Here, if the thinning pattern 56 shown in FIG. 26B is used as it is in the sub-frames SF6 to SF8, and the thinning pattern 57 shown in FIG. 27A is used as it is in the sub-frames SF9 to SF13, voltages of "−" polarity are applied continuously to the gate signal lines G4, G7, G9, and G12 indicated by a circle in FIG. 20. Similarly, voltages of "+" polarity are applied continuously to the gate signal lines G5, G8, and G11 indicated by a circle in FIG. 20.

Accordingly, in the fourth embodiment, the control mode in the sub-frames SF8 and SF9 is the third shift control mode MD6. Specifically, two shift frames TF are used in the third shift control mode MD6. Further, the thinning pattern 52 shown in FIG. 23A is used in the sub-frame SF8. With this, continuous application of voltages of "+" polarity to the pixel electrodes connected to the source signal line S1 is avoided. Moreover, the thinning pattern 53 shown in FIG. 23B is used in the sub-frame SF9. With this, continuous application of voltages of "−" polarity to the pixel electrodes connected to the source signal line S1 is avoided.

Further, patterns of the thinning pattern 57 shown in FIGS. 27A and 27B are alternately used in the sub-frames SF10 to SF13, SF14 to SF18, and SF19 to SF23 in FIG. 20, and the sub-frames SF24 to SF28, SF29 to SF33, and SF34 to SF37 in FIG. 21. Then, as described with reference to FIG. 19, the control mode returns to the second low-power control mode MD5 from the sub-frame SF40. In the second low-power control mode MD5, the thinning pattern 56 shown in FIGS. 26A and 26B is used as described above.

Here, if the thinning pattern 57 shown in FIG. 27B is used as it is in the sub-frames SF34 to SF38, and the thinning pattern 56 shown in FIG. 26A is used as it is in the sub-frames SF39 to SF41, voltages of "+" polarity are applied continuously to the gate signal lines G4, G7, G9, and G12 indicated by a circle in FIG. 21, and voltages of "−" polarity are applied continuously to the gate signal lines G5, G8, and G11 indicated by a circle in FIG. 21.

Accordingly, in the fourth embodiment, the control mode in the sub-frames SF38 and SF39 is the fourth shift control mode MD7. Specifically, two shift frames TF are used in the fourth shift control mode MD7. Further, the thinning pattern 54 shown in FIG. 24A is used in the sub-frame SF38. With this, continuous application of voltages of "+" polarity to the pixel electrodes connected to the source signal line S1 is avoided. Moreover, the thinning pattern 55 shown in FIG. 24B is used in the sub-frame SF39. With this, continuous application of voltages of "−" polarity to the pixel electrodes connected to the source signal line S1 is avoided.

The control mode in the sub-frames SF40 to SF43 succeeding the fourth shift control mode MD7 is the second low-power control mode MD5, the thinning pattern 56 shown in FIGS. 26A and 26B is used. Then, as described with reference to FIG. 19, the control mode returns to the basic control mode MD1 in the frame FR45, and the gate signal lines G1 to G15 are progressively scanned at the frame frequency F1 of 60 Hz.

Here, if, the thinning pattern 56 shown in FIG. 26B is used as it is in the sub-frame SF44, voltages of "+" polarity are applied continuously to the gate signal lines G2, G5, G8, G11, and G14 indicated by a circle in FIG. 21.

Therefore, in the fourth embodiment, the sub-frame SF44 functions as the shift frame TF, and the control mode in the sub-frame SF44 is the second shift control mode MD4. In the sub-frame SF44, the thinning pattern 58 shown in FIG. 25 is used. With this, continuous application of voltages of "+" polarity to the pixel electrodes connected to the source signal line S1 is avoided.

In the fourth embodiment, the control mode of the sub-frame SF38 is the fourth shift control mode MD7, and the sub-frame SF37 is the last sub-frame in the low-power control mode MD3. Here, a thinning pattern suitable for the fourth shift control mode MD7 when each of the sub-frames SF28 to SF36 is the last sub-frame in the low-power control mode MD3 may be stored in the thinning pattern storage 23*c*. With this, similarly to the first embodiment, regardless of the timing at which the standby mode signal SG2 is turned off, continuous application of voltages of the same polarity to the pixel electrodes connected to the source signal line S1 can be avoided.

Here, for the thinning pattern 56 in FIG. 26A and the thinning pattern 56 in FIG. 26B, gate signal lines to be scanned are the same and only polarities of voltages to be applied are different. Therefore, the thinning pattern storage 23*c* may store only one of the thinning patterns as the thinning pattern 56, and the stored thinning pattern is used by alternately inverting the polarities.

Similarly, for the thinning pattern 57 in FIG. 27A and the thinning pattern 57 in FIG. 27B, gate signal lines to be scanned are the same and only polarities of voltages to be applied are different. Therefore, the thinning pattern storage 23*c* may store only one of the thinning patterns as the thinning pattern 57, and the stored thinning pattern is used by alternately inverting the polarities.

As described above, in the fourth embodiment, by providing the first shift control mode MD2, the second shift control mode MD4, the third shift control mode MD6, and the fourth shift control mode MD7 as the control mode, continuous application of voltages of the same polarity to the pixel electrodes is avoided when the frame frequency changes between the basic control mode MD1 and the second low-power control mode MD5 and between the second low-power control mode MD5 and the low-power control mode MD3. Therefore, according to the fourth embodiment, similarly to the first embodiment, it is possible to prevent image qualities from deteriorating too much due to flickers produced by voltages of the same polarity being continuously applied to the pixel electrodes.

Further, in the fourth embodiment, when the control mode shifts from the basic control mode MD1 (the frame frequency F1) to the low-power control mode MD3 (the frame frequency F2), the control mode shifts through the second low-power control mode MD5 (the frame frequency F3 is expressed by F1>F3>F2), and when the control mode returns to the basic control mode MD1 from the low-power control mode MD3, the control mode returns through the second low-power control mode MD5. Therefore, as a difference between the frame frequencies is smaller than that in a case in which the control mode shifts or returns directly between the basic control mode MD1 and the low-power control mode MD3, it is possible to prevent qualities of images displayed on a display portion from excessively deteriorating when switching the control mode.

In the fourth embodiment, the display device is configured similarly to the first embodiment such that the data controller 30 similarly to the first embodiment is provided. Alternatively, the display device may be configured similarly to the second embodiment such that the data controller 30*a* similarly to the second embodiment, in place of the data controller 30 is provided.

With this display device, as F2=12 Hz, a relation K=F1/F2=5 is established. Therefore, in this case, the number of stages of the delay circuits provided for the data delay controller 61 may be increased by one, and the number of stages of the line memories provided for the data delay portion 62 may be increased by one. Further, in the fourth embodiment, as F3=20 Hz, a relation K=F1/F3=3 is established. Therefore, in this case, the number of stages of the delay circuits provided for the data delay controller 61 may be decreased by one, and the number of stages of the line memories provided for the data delay portion 62 may be decreased by one.

Further alternatively, in the fourth embodiment, the display device may be configured similarly to the third embodiment such that the source drive circuit 14*b* and the image memory portion 16*a* respectively in place of the source drive circuit 14 and the image memory portion 16 are provided.

Fifth Embodiment

Figure 28:
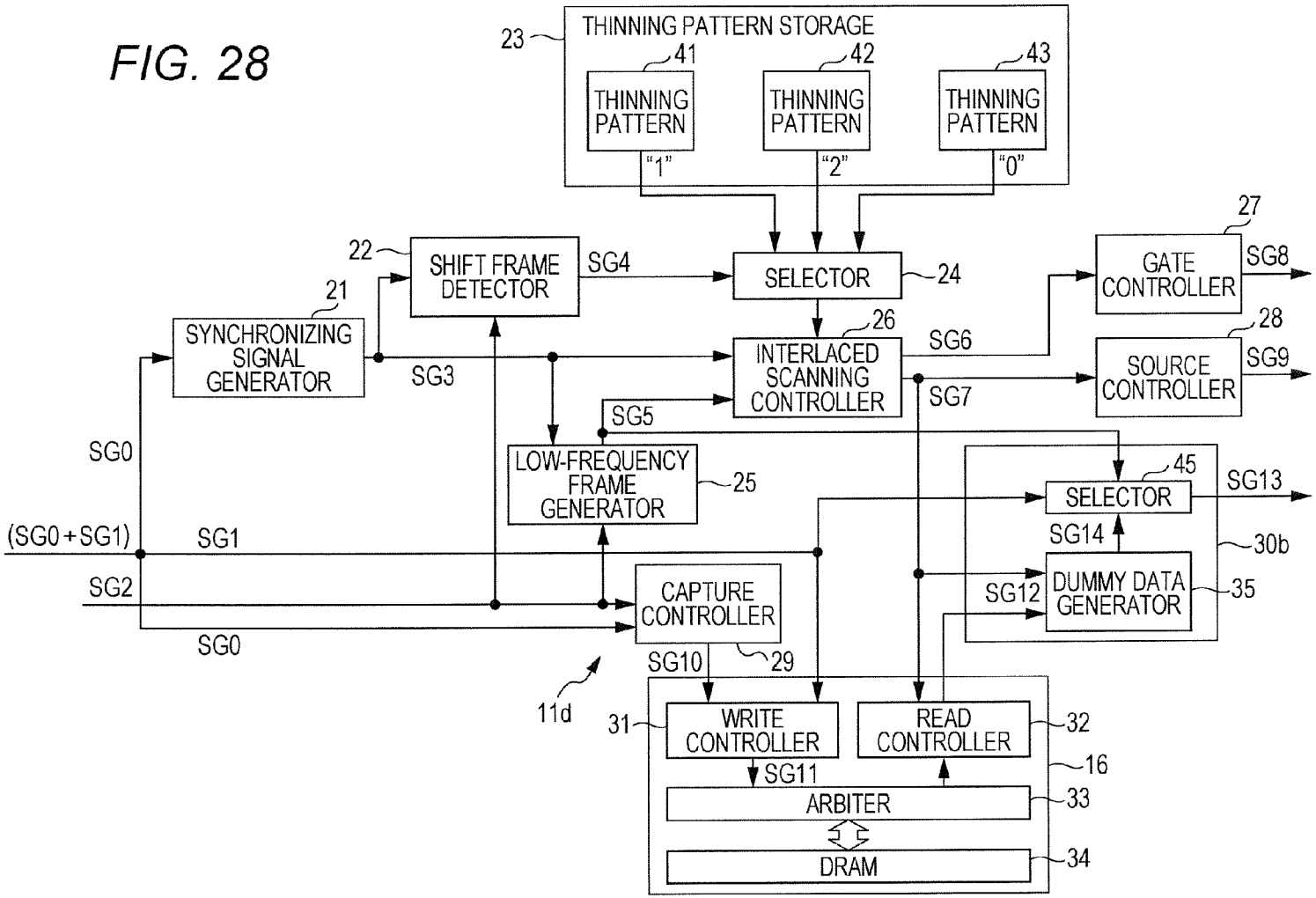
FIG. 28 is a block diagram showing a configuration of a controller and an image memory portion of a display device according to a fifth embodiment.
Figure 29:
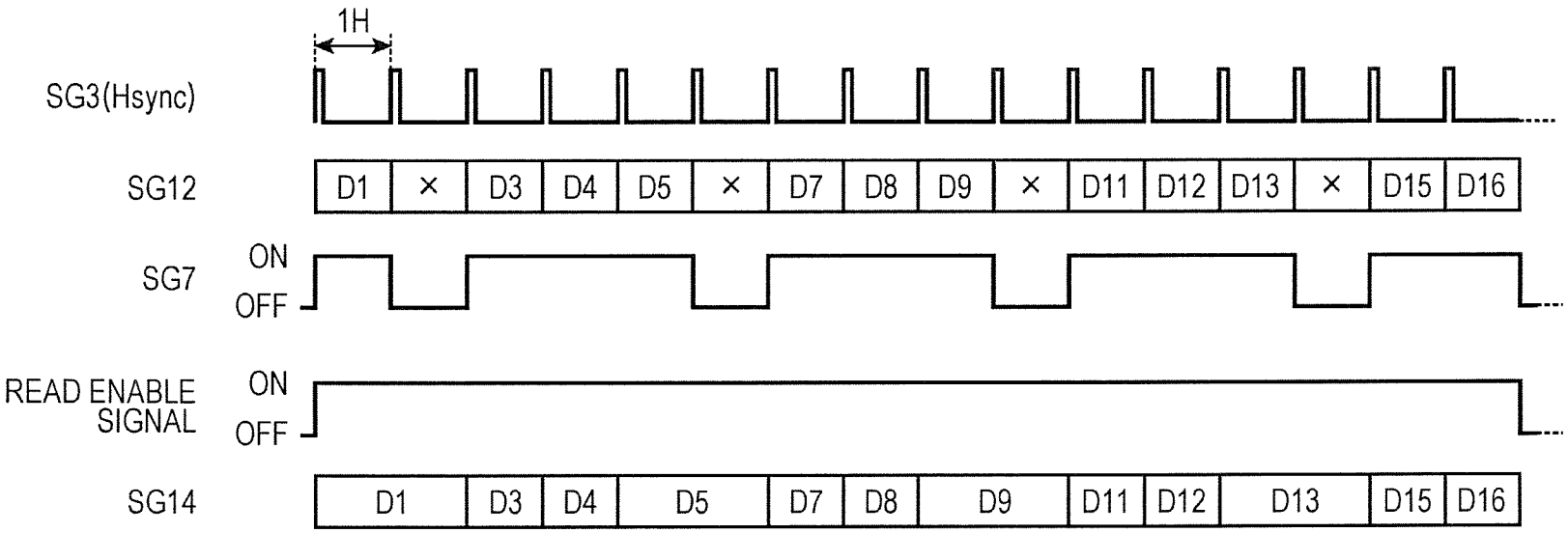
FIG. 29 is a timing chart schematically showing an image signal input to the selector in the first shift control mode.

FIG. 28 is a block diagram showing a configuration of a controller and an image memory portion of a display device according to a fifth embodiment. FIG. 29 is a timing chart schematically showing an image signal input to the selector 45 in the first shift control mode (in the fifth embodiment, the sub-frame SF3 in FIG. 5). In the fifth embodiment, similar components as in the first embodiment are denoted by similar reference numerals.

In the fifth embodiment, similarly to the first embodiment, a frame frequency F1 in the basic control mode is expressed by F1=60 Hz, and a frame frequency F2 in the low-power control mode is expressed by F2=15 Hz. Hereinafter, the fifth embodiment will be described focusing on differences from the first embodiment.

The configuration of the display device according to the fifth embodiment is substantially the same as that of the display device 1 according to the first embodiment shown in FIG. 1. The display device according to the fifth embodiment includes a controller 11*d* in place of the controller 11 of the display device 1 according to the first embodiment.

As shown in FIG. 28, the controller 11*d* according to the fifth embodiment includes the synchronizing signal generator 21, the shift frame detector 22, the thinning pattern storage 23, the selector 24, the low-frequency frame generator 25, the interlaced scanning controller 26, the gate controller 27, the source controller 28, the capture controller 29, and a data controller 30*b*. The data controller 30*b* includes the selector 45 and a dummy data generator 35.

The dummy data generator 35 includes a memory for holding data for one horizontal scanning period (1H). Further, the interlaced scanning controller 26 also outputs the generated data enable signal SG7 to the dummy data generator 35.

When the data enable signal SG7 is turned on, the dummy data generator 35 write the image signal SG12 output from the read controller 32 to the built-in memory in synchronization with the horizontal synchronizing signal Hsync. Specifically, when the data enable signal SG7 is turned off, the image signal SG12 is not written to the memory of the dummy data generator 35.

A read enable signal shown in FIG. 29 is a signal for enabling reading out of data written to the memory of the dummy data generator 35. As shown in FIG. 29, the read enable signal is continuously turned on. Accordingly, the dummy data generator 35 reads the data written to the memory every one horizontal scanning period (1H), and outputs as an image signal SG14 to the selector 45.

As described above, the dummy data generator 35 does not write data to built-in memory when the data enable signal SG7 is turned off. Specifically, as shown in FIG. 29, the image signal D2, the image signal D6, an image signal D10, and an image signal D14 respectively corresponding to the gate signal lines G2, G6, G10, and G14 are not written to the memory of the dummy data generator 35. Accordingly, the image signals D1, D5, D9, and D13 respectively corresponding to the gate signal lines G1, G5, G9, and G13, that are written immediately previously are read as the image signal SG14 from the dummy data generator 35 and are output to the selector 45. As described above, similarly to the first embodiment, according to the display device of the fifth embodiment, it is also possible to output an image signal that is the same as an immediately previously image signal as dummy data to the source drive circuit 14.

Other Embodiments

In the first embodiment, the second embodiment, the third embodiment, and the fifth embodiment, the frame frequency F2 in the low-power control mode MD3 is expressed by F2=15 Hz. Alternatively, the frame frequency F2 may take a different value. For example, the frame frequency F2 may be expressed by F2=12 Hz. In this case, K=F1/F2=5. Therefore, as described in the fourth embodiment, it is possible to display an image for one frame at the frame frequency F2 of 12 Hz by performing the interlaced scanning every five gate signal lines and repeating the generation of sub-frame images five times.

According to the first embodiment, the second embodiment, the third embodiment, and the fifth embodiment, if the frame frequency F2 in the low-power control mode MD3 takes a different value, it is preferable for F2=20 Hz or F2=12 Hz. The reason for this will be described hereinafter.

In the case of F2=15 Hz, as can be seen from FIG. 5, the polarity of a voltage applied to the gate signal line G1, for example, is definitely inverted in the sub-frames SF7, SF11, SF15, and SF19. However, the polarity of a voltage output from the source drive circuit 14 remains the same polarity in the sub-frames SF10 and SF11, in the sub-frames SF14 and SF15, and in the sub-frames SF18 and SF19. Therefore, if a voltage of the same polarity is continuously output, it is highly probably that flickers are produced in these sub-frames.

On the other hand, in the case of F2=20 Hz, as can be seen from FIG. 20 and FIG. 21, the polarity of a voltage applied to the gate signal line G2, for example, is inverted in the sub-frames SF4 and SF7, and inverted in the sub-frames SF40 and SF43. Further, the polarity of a voltage output from the source drive circuit 14 is also inverted in the sub-frames SF5 and SF6, and inverted in the sub-frames SF41 and SF42.

Similarly, in the case of F2=12 Hz, as can be seen from FIG. 20 and FIG. 21, the polarity of a voltage applied to the gate signal line G1, for example, is inverted in the sub-frames SF14, SF19, SF24, SF29 and SF34. Further, the polarity of a voltage output from the source drive circuit 14 is also inverted in the sub-frames SF13 and SF14, inverted in the sub-frames SF18 and SF19 and inverted in the sub-frames SF23 and SF24.

In the case of F2=20 Hz, K=F1/F2=60/20=3 is established, and in the case of F2=12 Hz, K=F1/F2=60/12=5 is established. In other words, if the second frequency F2 is determined such that K takes an odd number, it is possible to invert the polarity of a voltage output from the source drive circuit 14 in any case. Therefore, it is preferable to determine the second frequency F2 such that K takes an odd number.

In the fourth embodiment, the frame frequency F3 in the second low-power control mode MD5 is expressed by F3=20 Hz. Alternatively, the frame frequency F3 may take a different value. For example, the frame frequency F3 may be expressed by F3=30 Hz, or by F3=15 Hz.

In the fourth embodiment, the control mode shifts from the basic control mode MD1 to the low-power control mode MD3 by way of the second low-power control mode MD5. Alternatively, the control mode may shift from the basic control mode to the low-power control mode by way of the second low-power control mode and the third low-power control mode. Specifically, for example, the control mode may shift from the basic control mode in which the frame frequency is 60 Hz to the low-power control mode in which the frame frequency is 12 Hz by way of the second low-power control mode in which the frame frequency is 30 Hz and the third low-power control mode in which the frame frequency is 20 Hz.

In each of the above embodiments, the column inversion drive mode is employed as the drive mode of the pixel electrodes. Alternatively, a frame inversion drive mode or a dot inversion drive mode may be employed.

The aforementioned embodiments mainly include the display devices having the following features.

In one general aspect, the instant application describes a display device having a display portion including a plurality of source signal lines, a plurality of gate signal lines, and a plurality of pixel electrodes, each pixel electrode being connected to one of the plurality of source signal lines and one of the plurality of gate signal lines, the display portion being configured to display a frame image for a vertical synchronizing signal, the frame image being represented by image signals corresponding to the pixel electrodes, a source driver configured to apply voltages to the pixel electrodes corresponding to the image signals via the plurality of source signal lines, a gate driver configured to scan the plurality of gate signal lines by outputting a gate signal to each of the plurality of gate signal lines, and a controller configured to control the source driver and the gate driver based on a control mode for displaying the frame image on the display portion. The control mode includes a basic control mode, a low-power control mode, and a first shift control mode. The display portion includes N adjacent gate signal lines as the plurality of gate signal lines, where N is an integer not less than 3. In the basic control mode, the controller is configured to display the frame image on the display portion by causing the gate driver to progressively scan all of the N gate signal lines within a predetermined time period. In the low-power control mode, the controller is configured to display a sub-frame image on the display portion by causing the gate driver to scan W gate signal lines within the predetermined time period, and to perform interlaced scanning of the plurality of gate signal lines every K lines, where W is an integer that is not less than 2 and is less than N and K is an integer expressed by N/W. In the low-power control mode, the controller is configured to cause the gate driver to scan all of the N gate signal lines by repeating display of the sub-frame image for K times, and thus displaying the frame image constituted by K sub-frame images on the display portion. In the first shift control mode, the controller is configured to display a first intermediate sub-frame image on the display portion by causing the gate driver to scan Z1 gate signal lines within the predetermined time period, where Z1 is an integer expressed by W<Z1<N. The control mode is configured to shift from the basic control mode to the low-power control mode by way of the first shift control mode.

According to such a configuration, the display portion includes N adjacent gate signal lines (N is an integer that is not less than 3) as the gate signal lines. In the basic control mode, as a result of progressively scanning all of the N gate signal lines within a predetermined time period by the gate driver, the frame image is displayed on the display portion. In the low-power control mode, a sub-frame image is displayed on the display portion by the gate driver scanning W gate signal lines (W is an integer that is not less than 2 and less than N) within the predetermined time period, and interlaced scanning being performed to the gate signal lines every K lines (K is an integer expressed by N/W). Further, in the low-power control mode, by repeating display of the sub-frame image K times, all of the N gate signal lines are scanned by the gate driver, and the frame image constituted by K sub-frame images is displayed on the display portion. In the first shift control mode, as a result of scanning Z1 gate signal lines (Z1 is an integer expressed by W<Z1<N) within the predetermined time period by the gate driver, a first intermediate sub-frame image is displayed on the display portion. The control mode shifts from the basic control mode to the low-power control mode by way of the first shift control mode when the control mode shifts from the basic control mode to the low-power control mode.

Here, when the control mode directly shifts from the basic control mode to the low-power control mode, the number of the gate signal lines to be scanned within the predetermined time period changes from N to W. On the other hand, when the control mode shifts from the basic control mode to the low-power control mode by way of the first shift control mode, the number of the gate signal lines to be scanned within the predetermined time period changes from N to Z1, and then changes from Z1 to W. In this manner, as compared to the case in which the control mode directly shifts from the basic control mode to the low-power control mode, when the control mode shifts from the basic control mode to the low-power control mode by way of the first shift control mode, it is possible to reduce an amount of change in the number of the gate signal lines to be scanned within the predetermined time period. As a result, it is possible to prevent qualities of frame images displayed on the display portion from excessively deteriorating when the control mode shifts from the basic control mode to the low-power control mode. It should be noted that the description "N gate signal lines" means to provide N gate signal lines that contribute to display, and does not include dummy gate signal lines that do not contribute to display.

The above general aspect may include one or more of the following features. The controller is configured to control the source driver in the basic control mode such that polarities of the voltages applied to the respective plurality of pixel electrodes are inversed every time the frame image is displayed. The controller is configured to control the source driver in the low-power control mode such that the polarities of the voltages applied to the respective plurality of pixel electrodes are inversed every time the sub-frame image is displayed. The controller is configured to cause the gate driver to scan the Z1 gate signal lines and control the source driver in the first shift control mode, such that the polarities of the voltages applied to the respective plurality of pixel electrodes are inversed every time a voltage is applied from a last voltage application in the basic control mode to a first voltage application in the low-power control mode through a voltage application in the first shift control mode.

According to such a configuration, in the first shift control mode, the gate driver scans the Z1 gate signal lines and the source driver is controlled such that the polarities of the voltages applied to the respective plurality of pixel electrodes are inversed every time a voltage is applied from a last voltage application in the basic control mode to a first voltage application in the low-power control mode through a voltage application in the first shift control mode. Therefore, continuous application of voltages of the same polarity to the pixel electrodes is avoided. As a result, it is possible to reduce flickers produced by voltages of the same polarity continuously applied to a part of pixel electrodes.

The display device further includes the pattern storage storing a first thinning pattern indicating the Z1 gate signal lines determined based on values of W and K, such that the polarities of the voltages applied to the respective plurality of pixel electrodes are inversed every time a voltage is applied from the last voltage application in the basic control mode to the first voltage application in the low-power control mode through a voltage application in the first shift control mode. In the first shift control mode, the controller is further configured to cause the gate driver to scan the Z1 gate signal lines indicated by the first thinning pattern.

According to such a configuration, a pattern storage stores a first thinning pattern indicating the Z1 gate signal lines set based on values of W and K, such that the polarities of the voltages applied to the respective plurality of pixel electrodes are inversed every time a voltage is applied from a last voltage application in the basic control mode to a first voltage application in the low-power control mode through a voltage application in the first shift control mode. In the first shift control mode, the gate driver scans the Z1 gate signal lines indicated by the first thinning pattern. Therefore, continuous application of voltages of the same polarity to pixel electrodes can reliably be avoided from the last voltage application in the basic control mode to the first voltage application in the low-power control mode through the voltage application in the first shift control mode.

The control mode further includes a second shift control mode. The controller is configured to display, in the second shift control mode, a second intermediate sub-frame image on the display portion by causing the gate driver to scan Z2 gate signal lines within the predetermined time period, where Z2 is an integer expressed by W<Z2<N. The controller is configured to cause the control mode to return to the basic control mode from the low-power control mode by way of the second shift control mode when the control mode returns to the basic control mode from the low-power control mode after the control mode has shifted from the basic control mode to the low-power control mode.

According to such a configuration, in the second shift control mode, as a result of scanning Z2 gate signal lines (Z2 is an integer expressed by W<Z2<N) within the predetermined time period by the gate driver, a second intermediate sub-frame image is displayed on the display portion. When the control mode returns to the basic control mode from the low-power control mode, the control mode returns to the basic control mode from the low-power control mode by way of the second shift control mode.

Here, when the control mode directly returns to the basic control mode from the low-power control mode, the number of the gate signal lines to be scanned within the certain time period changes from W to N. On the other hand, when the control mode returns from the low-power control mode to the basic control mode by way of the second shift control mode, the number of the gate signal lines to be scanned within the certain time period changes from W to Z2, and then changes from Z2 to N. In this manner, as compared to the case in which the control mode directly returns to the basic control mode from the low-power control mode, when the control mode returns to the basic control mode from the low-power control mode by way of the second shift control mode, it is possible to reduce an amount of change in the number of the gate signal lines to be scanned within the certain time period. As a result, it is possible to prevent qualities of images displayed on the display portion from excessively deteriorating when the control mode returns to the basic control mode from the low-power control mode.

The controller is configured to cause the gate driver to scan the Z2 gate signal lines and control the source driver in the second shift control mode, such that the polarities of the voltages applied to the respective plurality of pixel electrodes are inversed every time a voltage is applied from the last voltage application in the low-power control mode to the first voltage application in the basic control mode through a voltage application in the second shift control mode.

According to such a configuration, in the second shift control mode, the gate driver scans the Z2 gate signal lines and the source driver is controlled, such that the polarities of the voltages applied to the respective plurality of pixel electrodes are inversed every time a voltage is applied from the last voltage application in the low-power control mode to the first voltage application in the basic control mode through a voltage application in the second shift control mode. Therefore, continuous application of voltages of the same polarity to the pixel electrodes is avoided. As a result, it is possible to reduce flickers produced by voltages of the same polarity continuously applied to a part of pixel electrodes.

The pattern storage further stores a second thinning pattern indicating the Z2 gate signal lines determined based on a combination of the values of W and K and the W gate signal lines that have been scanned when a last sub-frame images is displayed in the low-power control mode, such that the polarities of the voltages applied to the respective plurality of pixel electrodes are inversed every time a voltage is applied from the last voltage application in the low-power control mode to the first voltage application in the basic control mode through a voltage application in the second shift control mode. In the second shift control mode, the controller is configured to cause the gate driver to scan the Z2 gate signal lines indicated by the second thinning pattern.

According to such a configuration, the pattern storage stores a second thinning pattern indicating the Z2 gate signal lines set based on a combination of the values of W and K and the W gate signal lines that have been scanned when a last one of the sub-frame images is displayed in the low-power control mode, such that the polarities of the voltages applied to the respective plurality of pixel electrodes are inversed every time a voltage is applied from the last voltage application in the low-power control mode to the first voltage application in the basic control mode through a voltage application in the second shift control mode. In the second shift control mode, the gate driver scans the Z2 gate signal lines indicated by the second thinning pattern. Therefore, continuous application of voltages of the same polarity to pixel electrodes can reliably be avoided from the last voltage application in the low-power control mode to the first voltage application in the basic control mode through the voltage application in the second shift control mode.

The controller is configured to control the gate driver such that a horizontal scanning period (H) is constant regardless of the control mode.

According to such a configuration, the gate driver is controlled such that the horizontal scanning period (H) is constant regardless of the control mode. Therefore, in the low-power control mode, it is possible to operate with less power than that in the basic control mode.

The gate signal line that is to be scanned by the gate driver is defined to be a scan target signal line. The controller is configured to input a gate start signal to the gate driver, the gate start signal instructing the gate driver to start scanning the plurality of gate signal lines, to input the image signals to the source driver In at least one of the first shift control mode, the second shift control mode, and the low-power control mode, input the gate start signal to the gate driver after a predetermined delay time from rising of a vertical synchronizing signal such that the corresponding image signal is input to the scan target signal line that is being selected, and input the image signals to the source driver by delaying the image signals by a time period C*H, where C is an integer expressed by $0 \leq C \leq (K-1)$.

According to such a configuration, the controller inputs a gate start signal to the gate driver, the gate start signal instructing to start scanning of the gate signal lines. The controller inputs the image signals to the source driver. In at least one of the first shift control mode, the second shift control mode, and the low-power control mode, the controller inputs the gate start signal to the gate driver after predetermined delay time from the rising of the vertical synchronizing signal such that corresponding one of the image signals is input to the scan target signal line that is being selected, and inputs the image signals to the source driver by delaying the image signals by a time period C*H (C is an integer expressed by $0 \leq C \leq (K-1)$). Therefore, in at least one of the first shift control mode, the second shift control mode and the low-power control mode, an image signal corresponding to a gate signal line is input appropriately.

In at least one of the first shift control mode, the second shift control mode and the low-power control mode, the controller is configured to delay timing for inputting the gate start signal to the gate driver at least by a time period (K−1)*H as compared to the basic control mode, and to control the source driver such that one of the image signals first input to the source driver after the vertical synchronizing signal is output from the source driver when a time period K*H lapses from the input.

According to such a configuration, the controller inputs the gate start signal to the gate driver by delaying the gate start signal at least by a time period (K−1)*H in at least one of the shift control mode and the low-power control mode as compared to the basic control mode. Further, in at least one of the shift control mode and the low-power control mode, the controller controls the source driver such that one of the image signals first input to the source driver after the vertical synchronizing signal is output from the source driver when a time period K*H lapses from the input. Therefore, in at least one of the shift control mode and the low-power control mode, the first image signal after the vertical synchronizing signal is appropriately input to the corresponding gate signal line.

The controller is configured to repeatedly input a latch timing signal to the source driver, the latch timing signal being for controlling operational timing of the source driver, and input the image signals in synchronization with the input of the latch timing signal. The source driver is configured to output voltages based on the image signals that have been input in synchronization with the input of the latch timing signal, via the source signal line in synchronization with a next input of the latch timing signal, when the image signal corresponding to the scan target signal line is input from the controller, the source driver is configured to output a voltage based on the input image signal to one of the pixel electrodes corresponding to the image signal via the source signal line. In the first shift control mode, when a scan target signal line that is being selected is an L-th line from a previous scan target signal line, the controller is configured to input, to the source driver, one of the image signals corresponding to the scan target signal line that is being selected by delaying the image signal by a time period (K−L)*H, where L is an integer that is not less than 1 and not greater than K.

According to such a configuration, the controller is configured repeatedly to input a latch timing signal to the source driver, the latch timing signal being for controlling operational timing of the source driver, and inputs the image signals in synchronization with the input of the latch timing signal. The source driver is configured to output voltages based on the image signals that have been input in synchronization with the input of the latch timing signal, via the source signal line in synchronization with a next input of the latch timing signal. When the image signal corresponding to the scan target signal line is input to the source driver from the controller, the source driver is configured to output a voltage based on the input image signal to one of the pixel electrodes corresponding to the image signal through the source signal line. In the first shift control mode, if a scan target signal line that is being selected is an L-th line from a previous scan target signal line (L is an integer that is not less than 1 and not greater than K), one of the image signals corresponding to the scan target signal line that is being selected is input to the source driver by delaying the image signal by a time period (K−L)*H. Therefore, at timing suitable for an interval between scan target signal lines, the image signal corresponding to the scan target signal line that is being selected is input to the source driver. As a result, it is possible to output voltages based on the input image signals at appropriate timing from the source driver.

The controller is configured to repeatedly input a latch timing signal to the source driver, the latch timing signal being for controlling operational timing of the source driver, and input the image signals in synchronization with the input of the latch timing signal. The source driver is configured to output voltages based on the image signals that have been input in synchronization with the input of the latch timing signal, via the source signal line in synchronization with a next input of the latch timing signal. In the first shift control mode, the controller is configured to change an interval between latch timing signals to be input to the source driver within a range of (1 to K)*H according to an interval between lines of the scanning for outputting the gate signal to the gate signal lines. A relation of I(J)=O(J)+P is established when an interval between a J-th latch timing signal and a (J+1)-th latch timing signal from the vertical synchronizing signal is P*H, where J is an integer that is not less than 2 and P is an integer that is not less than 1 and not greater than K. I(J) is a number of a gate signal line, counted in a sub scanning direction, corresponding to the image signal input to the source driver in synchronization with the J-th latch timing signal. O(J) is a number of a gate signal line, counted in the sub scanning direction, corresponding to the voltage output from the source driver in synchronization with the J-th latch timing signal.

According to such a configuration, the controller repeatedly inputs a latch timing signal to the source driver, the latch timing signal being for controlling operational timing of the source driver, and the image signals are input in synchronization with the input of the latch timing signal. The source driver outputs voltages based on the image signals that have been input in synchronization with the input of the latch timing signal, via the source signal line in synchronization with a next input of the latch timing signal. In the first shift control mode, the controller changes an interval between latch timing signals to be input to the source driver within a range of (1 to K)*H according to the interval between lines of the scanning for outputting the gate signal to the gate signal lines. The relation of I(J)=O(J)+P is established when the interval between the J-th latch timing signal and the (J+1)-th latch timing signal from the vertical synchronizing signal (J is an integer that is not less than 2) is P*H (P is an integer that is not less than 1 and not greater than K). Here, I(J) is a number of a gate signal line, counted in a sub scanning direction, corresponding to the image signal input to the source driver in synchronization with the J-th latch timing signal, and O(J) is a number of a gate signal line, counted in the sub scanning direction, corresponding to the voltage output from the source driver in synchronization with the J-th latch timing signal.

Therefore, the interval between the latch timing signals is controlled at timing suitable for the interval between the gate signal lines for scanning. As a result, it is possible to appropriately control the gate signal line corresponding to the image signal input to the source driver in synchronization with the latch timing signal and the gate signal line corresponding to a voltage output from the source driver in synchronization with the latch timing signal.

In the first shift control mode, when the gate driver first scans a U-th gate signal line and then a (U+V)-th gate signal line out of the N gate signal lines, the controller is configured to cause a voltage output from the source driver in response to the scanning of the U-th gate signal line to be continuously output for a time period V*H from the source driver. U is an integer that is not less than 1 and is less than N, and V is an integer that is not less than 1 and is not greater than K.

According to such a configuration, in the first shift control mode, when the gate driver first scans the U-th gate signal line (U is an integer that is not less than 1 and less than N) and then the (U+V)-th gate signal line (V is an integer that is not less than 1 and not greater than K) out of the N gate signal lines, the controller causes the voltage output from the source driver in response to the scanning of the U-th gate signal line to be continuously output for the time period V*H from the source driver.

Therefore, voltages output from the source driver do not change in the (V−1) horizontal scanning period (V−1)*H in which the gate signal lines are not scanned. Accordingly, unnecessary discharge and charge may not be produced in the source driver in the horizontal scanning period in which the gate signal lines are not scanned. As a result, it is possible to prevent power consumption from excessively increasing.

In the first shift control mode, during a horizontal scanning period corresponding to the gate signal line that is not scanned by the gate driver, the controller is configured to cause a voltage output from the source driver in a horizontal scanning period corresponding to the gate signal line scanned immediately previously by the gate driver to be continuously output from the source driver.

According to such a configuration, in the first shift control mode, during a horizontal scanning period corresponding to the gate signal line that is not scanned by the gate driver, the controller is configured to causes a voltage output from the source driver in a horizontal scanning period corresponding to the gate signal line scanned immediately previously by the gate driver to be continuously output from the source driver. Accordingly, unnecessary discharge and charge may not be produced in the source driver in the horizontal scanning period corresponding to the gate signal lines that are not scanned. As a result, it is possible to prevent power consumption from excessively increasing.

The display device further includes an image storage configured to store the image signals. The controller is configured to store the image signals in the image storage when a frame image represented by the image signals input from outside represents a still picture, and cause the control mode to shift from the basic control mode to the low-power control mode. In the low-power control mode, the controller is configured to read the image signals stored in the image storage, and display the frame image representing the still picture on the display portion based on the read image signals. In the first shift control mode, during the horizontal scanning period corresponding to the gate signal line that is not scanned, the controller is configured to again read the image signals that have been read from the image storage in the horizontal scanning period corresponding to the gate signal line scanned immediately previously, and output voltages based on the again read image signals from the source driver.

According to such a configuration, when a frame image represented by the image signals input from outside represents a still picture, the image signals are stored in the image storage by the controller and the control mode shifts from the basic control mode to the low-power control mode. In the low-power control mode, the controller reads the image signals stored in the image storage, and the frame image representing the still picture is displayed on the display portion based on the read image signals. In the first shift control mode, during the horizontal scanning period corresponding to the gate signal line that is not scanned, the controller again reads the image signals that have been read from the image storage in the horizontal scanning period corresponding to the gate signal line scanned immediately previously, and voltages based on the again read image signals are output from the source driver.

Accordingly, with a simple configuration of again reading the image signals from the image storage, it is possible to output a voltage output from the source driver in a horizontal scanning period corresponding to the gate signal line scanned immediately previously continuously from the source driver, during the horizontal scanning period corresponding to the gate signal line that is not scanned.

According to the present disclosure, it is possible to reduce an amount of change in the number of the gate signal lines to be scanned within the certain time period when the control mode shifts from the basic control mode to the low-power control mode by way of the first shift control mode, as compared to the case in which the control mode directly shifts from the basic control mode to the low-power control mode. Therefore, it is possible to prevent qualities of frame images displayed on the display portion from excessively deteriorating when the control mode shifts from the basic control mode to the low-power control mode.

A display device having a display portion for displaying a frame image is useful as a display device capable of preventing qualities of an image displayed on the display portion from excessively deteriorating.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

As used herein, the phrase "at least one of" preceding a series of items, with the term "and" or "or" to separate any of the items, modifies the list as a whole, rather than each member of the list (e.g., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112(f), unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A display device comprising:

a display portion including a plurality of source signal lines, a plurality of gate signal lines, and a plurality of pixel electrodes, each pixel electrode being connected to one of the plurality of source signal lines and one of the plurality of gate signal lines, the display portion being configured to display a frame image for a vertical synchronizing signal, the frame image being represented by image signals corresponding to the pixel electrodes;

a source driver configured to apply voltages to the pixel electrodes corresponding to the image signals via the plurality of source signal lines;

a gate driver configured to scan the plurality of gate signal lines by outputting a gate signal to each of the plurality of gate signal lines; and a controller configured to control the source driver and the gate driver based on a control mode for displaying the frame image on the display portion, the control mode including a basic control mode, a low-power control mode, and a first shift control mode, wherein:

the display portion includes N adjacent gate signal lines as the plurality of gate signal lines, where N is an integer not less than 3, in the basic control mode, the controller is configured to display the frame image on the display portion by causing the gate driver to progressively scan all of the N gate signal lines within a predetermined time period, in the low-power control mode, the controller is configured to display a sub-frame image on the display portion by causing the gate driver to scan W gate signal lines within the predetermined time period, and to perform interlaced scanning of the plurality of gate signal lines every K lines, where W is an integer that is not less than 2 and is less than N and K is an integer expressed by N/W, in the low-power control mode, the controller is configured to cause the gate driver to scan all of the N gate signal lines by repeating display of the sub-frame image for K times, and thus displaying the frame image constituted by K sub-frame images on the display portion, in the first shift control mode, the controller is configured to display a first intermediate sub-frame image on the display portion by causing the gate driver to scan Z1 gate signal lines within the predetermined time period, where Z1 is an integer expressed by W<Z1<N, and the control mode is configured to shift from the basic control mode to the low-power control mode by way of the first shift control mode.

2. The display device according to claim 1, wherein the controller is configured to control the source driver in the basic control mode such that polarities of the voltages applied to the respective plurality of pixel electrodes are inversed every time the frame image is displayed, the controller is configured to control the source driver in the low-power control mode such that the polarities of the voltages applied to the respective plurality of pixel electrodes are inversed every time the sub-frame image is displayed, and the controller is configured to cause the gate driver to scan the Z1 gate signal lines and control the source driver in the first shift control mode, such that the polarities of the voltages applied to the respective plurality of pixel electrodes are inversed every time a voltage is applied from a last voltage application in the basic control mode to a first voltage application in the low-power control mode through a voltage application in the first shift control mode.

3. The display device according to claim 2, further comprising:

a pattern storage storing a first thinning pattern indicating the Z1 gate signal lines determined based on values of W and K, such that the polarities of the voltages applied to the respective plurality of pixel electrodes are inversed every time a voltage is applied from the last voltage application in the basic control mode to the first voltage application in the low-power control mode through a voltage application in the first shift control mode, wherein in the first shift control mode, the controller is further configured to cause the gate driver to scan the Z1 gate signal lines indicated by the first thinning pattern.

4. The display device according to claim 3, wherein the control mode further includes a second shift control mode, the controller is configured to display, in the second shift control mode, a second intermediate sub-frame image on the display portion by causing the gate driver to scan Z2 gate signal lines within the predetermined time period, where Z2 is an integer expressed by W<Z2<N, and the controller is configured to cause the control mode to return to the basic control mode from the low-power control mode by way of the second shift control mode when the control mode returns to the basic control mode from the low-power control mode after the control mode has shifted from the basic control mode to the low-power control mode.

5. The display device according to claim 4, wherein the controller is configured to cause the gate driver to scan the Z2 gate signal lines and control the source driver in the second shift control mode, such that the polarities of the voltages applied to the respective plurality of pixel electrodes are inversed every time a voltage is applied from the last voltage application in the low-power control mode to the first voltage application in the basic control mode through a voltage application in the second shift control mode.

6. The display device according to claim 5, wherein the pattern storage further stores a second thinning pattern indicating the Z2 gate signal lines determined based on a combination of the values of W and K and the W gate signal lines that have been scanned when a last sub-frame images is displayed in the low-power control mode, such that the polarities of the voltages applied to the respective plurality of pixel electrodes are inversed every time a voltage is applied from the last voltage application in the low-power control mode to the first voltage application in the basic control mode through a voltage application in the second shift control mode, and in the second shift control mode, the controller is configured to cause the gate driver to scan the Z2 gate signal lines indicated by the second thinning pattern.

7. The display device according to claim 1, wherein the controller is configured to control the gate driver such that a horizontal scanning period (H) is constant regardless of the control mode.

8. The display device according to claim 7, wherein a gate signal line that is to be scanned by the gate driver is defined to be a scan target signal line, and the controller is configured to:

input a gate start signal to the gate driver, the gate start signal instructing the gate driver to start scanning the plurality of gate signal lines, input the image signals to the source driver, and in at least one of the first shift control mode, the second shift control mode, and the low-power control mode, input the gate start signal to the gate driver after a predetermined delay time from rising of a vertical synchronizing signal such that the corresponding image signal is input to the scan target signal line that is being selected, and input the image signals to the source driver by delaying the image signals by a time period C*H, where C is an integer expressed by $0 \leq C \leq (K-1)$.

9. The display device according to claim 8, wherein in at least one of the first shift control mode, the second shift control mode and the low-power control mode, the controller is configured to:

delay timing for inputting the gate start signal to the gate driver at least by a time period (K−1)*H as compared to the basic control mode, and control the source driver such that one of the image signals first input to the source driver after the vertical synchronizing signal is output from the source driver when a time period K*H lapses from the input.

10. The display device according to claim 8, wherein the controller is configured to repeatedly input a latch timing signal to the source driver, the latch timing signal being for controlling operational timing of the source driver, and input the image signals in synchronization with the input of the latch timing signal, the source driver is configured to output voltages based on the image signals that have been input in synchronization with the input of the latch timing signal, via the source signal line in synchronization with a next input of the latch timing signal, when the image signal corresponding to the scan target signal line is input from the controller, the source driver is configured to output a voltage based on the input image signal to one of the pixel electrodes corresponding to the image signal via the source signal line, and in the first shift control mode, when a scan target signal line that is being selected is an L-th line from a previous scan target signal line, the controller is configured to input, to the source driver, one of the image signals corresponding to the scan target signal line that is being selected by delaying the image signal by a time period (K−L)*H, where L is an integer that is not less than 1 and not greater than K.

11. The display device according to claim 7, wherein the controller is configured to repeatedly input a latch timing signal to the source driver, the latch timing signal being for controlling operational timing of the source driver, and input the image signals in synchronization with the input of the latch timing signal, the source driver is configured to output voltages based on the image signals that have been input in synchronization with the input of the latch timing signal, via the source signal line in synchronization with a next input of the latch timing signal, in the first shift control mode, the controller is configured to change an interval between latch timing signals to be input to the source driver within a range of (1 to K)*H according to an interval between lines of the scanning for outputting the gate signal to the gate signal lines, and a relation of I(J)=O(J)+P is established when an interval between a J-th latch timing signal and a (J+1)-th latch timing signal from the vertical synchronizing signal is P*H, where J is an integer that is not less than 2 and P is an integer that is not less than 1 and not greater than K, where, I(J) is a number of a gate signal line, counted in a sub scanning direction, corresponding to the image signal input to the source driver in synchronization with the J-th latch timing signal, and O(J) is a number of a gate signal line, counted in the sub scanning direction, corresponding to the voltage output from the source driver in synchronization with the J-th latch timing signal.

12. The display device according to claim 7, wherein in the first shift control mode, when the gate driver first scans a U-th gate signal line and then a (U+V)-th gate signal line out of the N gate signal lines, the controller is configured to cause a voltage output from the source driver in response to the scanning of the U-th gate signal line to be continuously output for a time period V*H from the source driver, where:

U is an integer that is not less than 1 and is less than N, and V is an integer that is not less than 1 and is not greater than K.

13. The display device according to claim 7, wherein in the first shift control mode, during a horizontal scanning period corresponding to the gate signal line that is not scanned by the gate driver, the controller is configured to cause a voltage output from the source driver in a horizontal scanning period corresponding to the gate signal line scanned immediately previously by the gate driver to be continuously output from the source driver.

14. The display device according to claim 13, further comprising:

an image storage configured to store the image signals, wherein the controller is configured to store the image signals in the image storage when a frame image represented by the image signals input from outside represents a still picture, and cause the control mode to shift from the basic control mode to the low-power control mode, in the low-power control mode, the controller is configured to read the image signals stored in the image storage, and display the frame image representing the still picture on the display portion based on the read image signals, and in the first shift control mode, during the horizontal scanning period corresponding to the gate signal line that is not scanned, the controller is configured to again read the image signals that have been read from the image storage in the horizontal scanning period corresponding to the gate signal line scanned immediately previously, and output voltages based on the again read image signals from the source driver.

15. The display device according to claim 2, wherein the controller is configured to control the gate driver such that a horizontal scanning period (H) is constant regardless of the control mode.

16. The display device according to claim 3, wherein the controller is configured to control the gate driver such that a horizontal scanning period (H) is constant regardless of the control mode.

17. The display device according to claim 4, wherein the controller is configured to control the gate driver such that a horizontal scanning period (H) is constant regardless of the control mode.

18. The display device according to claim 5, wherein the controller is configured to control the gate driver such that a horizontal scanning period (H) is constant regardless of the control mode.

19. The display device according to claim 6, wherein the controller is configured to control the gate driver such that a horizontal scanning period (H) is constant regardless of the control mode.

* * * * *